US011731014B2

(12) United States Patent
Greaney et al.

(10) Patent No.: US 11,731,014 B2
(45) **Date of Patent: *Aug. 22, 2023**

(54) GOLF CLUB

(71) Applicant: Taylor Made Golf Company, Inc., Carlsbad, CA (US)

(72) Inventors: Mark Vincent Greaney, Vista, CA (US); Todd P. Beach, Encinitas, CA (US); Andrew Kickertz, San Diego, CA (US); Craig Richard Slyfield, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/524,056

(22) Filed: Nov. 11, 2021

(65) Prior Publication Data

US 2022/0212067 A1 Jul. 7, 2022

Related U.S. Application Data

(63) Continuation of application No. 16/517,172, filed on Jul. 19, 2019, now Pat. No. 11,179,608, which is a (Continued)

(51) Int. Cl.

| | |
|---|---|
| ***A63B 53/04*** | (2015.01) |
| ***A63B 71/06*** | (2006.01) |
| ***A63B 60/42*** | (2015.01) |

(52) U.S. Cl.

CPC ..... *A63B 53/0466* (2013.01); *A63B 71/0619* (2013.01); *A63B 53/0437* (2020.08); (Continued)

(58) Field of Classification Search

CPC . A63B 53/0466; A63B 60/42; A63B 53/0437; A63B 53/0441; A63B 2209/00; (Continued)

(56) References Cited

U.S. PATENT DOCUMENTS

| | | | |
|---|---|---|---|
| 1,291,967 | A | 1/1919 | McDougal |
| 1,402,537 | A | 1/1922 | Reach |

(Continued)

OTHER PUBLICATIONS

AdamsGolf, "DiXX Blu Putter," retrieved from https://web.archive.org/web/20080913151800/http://www.adamsgolf.com/products/shortgame/dixx.php, document dated Sep. 13, 2008, 1 page.

*Primary Examiner* — Sebastiano Passaniti

(74) *Attorney, Agent, or Firm* — Klarquist Sparkman, LLP

(57) ABSTRACT

Golf clubs have a primary alignment feature including a paint or masking line which delineates the transition between at least a first portion of the crown having an area of contrasting shade or color with the shade or color of the face. Some have a primary alignment feature including a paint or masking line which delineates the transition between a first portion of the crown having an area of contrasting shade or color and the area of shade or color of the face. A secondary alignment feature includes a paint or masking line that delineates the transition between the first portion of the crown having an area of contrasting shade or color with the shade or color of the face and a second portion of the crown having an area of contrasting shade or color with the shade or color of the first portion.

29 Claims, 23 Drawing Sheets

Related U.S. Application Data continuation-in-part of application No. 16/046,106, filed on Jul. 26, 2018, now abandoned, which is a continuation of application No. 15/197,551, filed on Jun. 29, 2016, now Pat. No. 10,052,530.

(60) Provisional application No. 62/185,882, filed on Jun. 29, 2015.

(52) U.S. Cl.
CPC ..... *A63B 53/0441* (2020.08); *A63B 60/42* (2015.10); *A63B 2209/00* (2013.01)

(58) Field of Classification Search
CPC ..... A63B 2053/0491; A63B 53/0433; A63B 53/0445; A63B 53/042; A63B 71/0619
USPC ..... 473/324–350, 287–292
See application file for complete search history.

(56) References Cited

U.S. PATENT DOCUMENTS 1,660,126 A 2/1928 Heeter
D89,332 S 10/1930 Bartsch
2,908,504 A 11/1958 Pratt
2,934,347 A 4/1960 Siniscalchi
2,954,231 A 9/1960 Macintyre
3,753,564 A 8/1973 Brandell
D231,624 S 5/1974 Wilmoth
D237,289 S 10/1975 Calton
4,157,830 A 6/1979 Taylor et al.
5,131,660 A 7/1992 Marocco
5,213,328 A 5/1993 Long
5,433,446 A 7/1995 Lindstedt, Jr.
5,489,094 A 2/1996 Pritchett
5,776,011 A 7/1998 Su et al.
5,788,584 A 8/1998 Parente
5,935,020 A 8/1999 Stites et al.
6,196,932 B1 3/2001 Marsh et al.
6,248,024 B1 6/2001 Nelson et al.
6,729,967 B2 5/2004 Ford
D496,084 S 9/2004 Imamoto
D505,701 S 5/2005 Dogan
6,929,565 B2 8/2005 Nakahara
6,969,326 B2 11/2005 De Shiell
7,022,030 B2 4/2006 Best
D529,564 S 10/2006 Grace
7,166,038 B2 1/2007 Williams
7,235,021 B2 6/2007 Solheim
7,303,487 B2 12/2007 Kumamoto
7,344,451 B2 3/2008 Tang
7,377,858 B2 5/2008 Kubota
7,396,289 B2 7/2008 Soracco
7,422,531 B2 9/2008 Tarng et al.
7,481,715 B2 1/2009 Byrne
7,510,481 B2 3/2009 Sevon
7,828,669 B1 11/2010 Stites
7,993,216 B2 8/2011 Lee
8,025,589 B2 9/2011 Brinton
8,083,612 B2 12/2011 Stites
8,096,896 B2 1/2012 De Schiell et al.
8,210,960 B1 7/2012 Davenport
8,257,191 B2 9/2012 Stites et al.
8,348,780 B2 1/2013 Stites
8,353,786 B2 1/2013 Beach et al.
8,414,410 B1 4/2013 Flaherty et al.
8,449,402 B2 5/2013 Jaekel et al.
8,556,742 B2 10/2013 John
8,636,609 B2 1/2014 Chao et al.
8,690,700 B2 4/2014 Flaherty et al.
8,721,471 B2 5/2014 Albertsen et al.
8,727,909 B2 5/2014 Guerrette et al.
8,821,312 B2 9/2014 Burnett et al.
8,827,831 B2 9/2014 Burnett et al.
9,011,267 B2 4/2015 Burnett et al.
9,056,230 B2 6/2015 Golden et al.
9,089,749 B2 7/2015 Burnett et al.
9,168,428 B2 10/2015 Albertsen et al.
9,168,434 B2 10/2015 Burnett et al.
9,174,101 B2 11/2015 Burnett et al.
9,333,400 B2 5/2016 Girard et al.
D767,694 S 9/2016 Nielson
9,604,136 B1 3/2017 Ricky
9,662,548 B2 5/2017 Guerrette et al.
9,750,991 B2 9/2017 Chao et al.
9,962,582 B2 5/2018 Antku
10,052,530 B2 8/2018 Greaney
10,065,084 B2 9/2018 Myrhum et al.
10,065,090 B2 9/2018 Guerrette et al.
10,099,102 B1 10/2018 Koo
10,155,145 B2 12/2018 Girard et al.
10,195,497 B1 2/2019 Greaney et al.
10,207,160 B2 2/2019 Johnson et al.
10,207,171 B2 2/2019 Davenport
10,293,219 B2 5/2019 Hayashi
10,300,351 B2 5/2019 Greaney et al.
D857,816 S 8/2019 Bazzel
10,391,369 B2 8/2019 Greaney et al.
10,413,784 B2 9/2019 Beach et al.
10,463,927 B2 11/2019 Bovee et al.
10,561,922 B2 2/2020 Sanchez et al.
10,576,335 B2 3/2020 Greaney et al.
10,632,350 B2 4/2020 Beach et al.
10,751,585 B2 8/2020 Johnson et al.
10,799,778 B2 10/2020 Guerrette et al.
10,843,053 B2 11/2020 Carter
10,874,922 B2 12/2020 Harbert et al.
10,888,746 B1 1/2021 Greaney et al.
11,045,696 B2 6/2021 Burnett et al.
11,179,608 B2 * 11/2021 Greaney ..... A63B 60/52
11,219,803 B2 * 1/2022 Greaney ..... A63B 53/0441
2003/0130059 A1 7/2003 Billings
2003/0203762 A1 10/2003 Ross
2005/0187028 A1 8/2005 Chang et al.
2005/0209021 A1 * 9/2005 Hoffman ..... A63B 53/0466 473/334
2007/0004524 A1 1/2007 Harrison
2007/0026958 A1 2/2007 Barasch et al.
2007/0232409 A1 10/2007 Byrne
2008/0009344 A1 1/2008 Graham et al.
2008/0015045 A1 1/2008 Payne et al.
2009/0314398 A1 12/2009 Shaar
2010/0066677 A1 3/2010 Garrett et al.
2010/0093458 A1 4/2010 Davenport et al.
2010/0130298 A1 5/2010 Dugan et al.
2010/0173720 A1 7/2010 Kim
2010/0248852 A1 9/2010 Lee
2011/0081982 A1 4/2011 John
2011/0159986 A1 6/2011 Chao et al.
2014/0057738 A1 2/2014 Albertsen et al.
2014/0127659 A1 5/2014 Barasch et al.
2014/0179460 A1 6/2014 Beach et al.
2014/0206469 A1 7/2014 Girard et al.
2014/0213390 A1 7/2014 Guerrette et al.
2014/0228153 A1 8/2014 Albertsen et al.
2014/0274446 A1 9/2014 Greaney et al.
2014/0342848 A1 11/2014 Burnett et al.
2014/0371002 A1 12/2014 Burnett et al.
2014/0373630 A1 12/2014 Taniguchi
2015/0182822 A1 7/2015 Burnett et al.
2015/0231455 A1 8/2015 Burnett et al.
2016/0016054 A1 1/2016 Burnett et al.
2016/0236046 A1 8/2016 Girard et al.
2016/0299570 A1 10/2016 Davydov
2016/0317896 A1 11/2016 Albelo
2017/0232313 A1 8/2017 Guerrette et al.
2018/0185719 A1 7/2018 Johnson et al.
2018/0345099 A1 12/2018 Harbert et al.
2019/0009145 A1 1/2019 Guerrette et al.
2019/0111326 A1 4/2019 Girard et al.
2019/0184246 A1 6/2019 Harbert et al.
2019/0336834 A1 7/2019 Greaney et al.
2019/0232120 A1 8/2019 Johnson et al.
2019/0232121 A1 8/2019 Greaney et al.

(56) References Cited

U.S. PATENT DOCUMENTS

| | | | |
|---|---|---|---|
| 2021/0001189 | A1 | 1/2021 | Johnson et al. |
| 2021/0146203 | A1 | 2/2021 | Greaney et al. |
| 2021/0060392 | A1 | 3/2021 | Greaney et al. |
| 2021/0069559 | A1 | 3/2021 | Albertsen et al. |
| 2021/0113896 | A1 | 4/2021 | Greensmith et al. |
| 2021/0138323 | A1 | 5/2021 | Harbert et al. |
| 2021/0170248 | A1 | 6/2021 | Girard et al. |
| 2021/0213334 | A1 | 7/2021 | Honea et al. |
| 2022/0176211 | A1 | 6/2022 | Greaney et al. |

* cited by examiner

GOLF CLUB

CROSS-REFERENCE TO RELATED APPLICATIONS

This application is a continuation of U.S. patent application Ser. No. 16/517,172, filed Jul. 19, 2019, which is a continuation-in-part of U.S. patent application Ser. No. 16/046,106, filed Jul. 26, 2018, now abandoned, which is a continuation of U.S. patent application Ser. No. 15/197,551, filed Jun. 29, 2016, now U.S. Pat. No. 10,052,530, which claims the benefit of priority under 35 U.S.C. § 119(e) to Provisional Application No. 62/185,882 entitled "GOLF CLUB" filed Jun. 29, 2015, all of which are incorporated by reference herein in their entirety. This application references U.S. Pat. No. 8,771,095 to Beach, et. al, entitled "CONTRAST-ENHANCED GOLF CLUB HEADS," filed Mar. 18, 2011.

BACKGROUND

When a golf club head strikes a golf ball, a force is seen on the club head at the point of impact. If the point of impact is aligned with the center face of the golf club head in an area of the club face typically called the sweet spot, then the force has minimal twisting or tumbling effect on the golf club. However, if the point of impact is not aligned with the center face, outside the sweet spot for example, then the force can cause the golf club head to twist around the center face. This twisting of the golf club head causes the golf ball to acquire spin. For example, if a typical right handed golfer hits the ball near the toe of the club this can cause the club to rotate clockwise when viewed from the top down. This in turn causes the golf ball to rotate counter-clockwise which will ultimately result in the golf ball curving to the left. This phenomenon is what is commonly referred to as "gear effect."

Bulge and roll are golf club face properties that are generally used to compensate for this gear effect. The term "bulge" on a golf club typically refers to the rounded properties of the golf club face from the heel to the toe of the club face.

The term "roll" on a golf club typically refers to the rounded properties of the golf club face from the crown to the sole of the club face. When the club face hits the ball, the ball acquires some degree of backspin. Typically this spin varies more for shots hit below the center line of the club face than for shots hit above the center line of the club face.

FIELD

This disclosure relates to golf clubs. More specifically, this disclosure relates to golf club alignment.

SUMMARY

Aspects of the invention are directed to golf club heads including a body having a face, a crown and a sole together defining an interior cavity, the golf club body including a heel and a toe portion and having x, y and z axes which are orthogonal to each other having their origin at USGA center face and wherein the golf club head has a primary alignment feature comprising a paint or masking line which delineates the transition between at least a first portion of the crown having an area of contrasting shade or color with the shade or color of the face.

In some embodiments the golf club head includes a body having a face, a sole and a crown, the crown having a first portion having a first color or shade and a second portion having a second color or shade, the face crown and sole together defining an interior cavity, the golf club body including a heel and a toe portion and having x, y and z axes which are orthogonal to each other having their origin at USGA center face and wherein the golf club head has a primary alignment feature comprising a paint or masking line which delineates the transition between at least a first portion of the crown having an area of contrasting shade or color and the area of shade or color of the face, and the club head also includes a secondary alignment feature including a paint or masking line which delineates the transition between the first portion of the crown having an area of contrasting shade or color with the shade or color of the face; and a second portion of the crown having an area of contrasting shade or color with the shade or color of the first portion, the secondary alignment feature comprising a first elongate side having a length of from about 0.5 inches to about 1.7 inches, and a second and third elongate side extending back from the face and rearward from and at an angle to the first elongate side.

In some embodiments the golf club heads have a body having a face, a crown and a sole together defining an interior cavity, the golf club body also includes a heel and a toe portion and a portion of the crown comprises an electronic display, wherein the electronic display includes an organic light-emitting diode (OLED) display for providing active color and wherein the OLED display is divided into independently operating electronic display zones.

In some embodiments the golf club heads have a body having a face, a crown and a sole together defining an interior cavity, the golf club body also includes a heel and a toe portion and a portion of the crown or a layer covering at least a portion of the crown of the golf club head is covered by a dielectric coating system.

In some embodiments, a golf club head is provided with a golf club body. The golf club body has a face, a crown and a sole, together defining an interior cavity. The golf club body also includes a heel and a toe portion, and has an x, y and z axes which are orthogonal to each other having their origin at USGA center face. At least one of the sole, crown, or face may be at least in part a composite material. The golf club head further has a primary alignment feature comprising a paint or masking line which delineates a transition between at least a first portion of the crown having an area of contrasting shade or color with a shade or color of the face and a $CG_x$ of 0 to about −4 mm. The primary alignment feature has a Sight Adjusted Perceived Face Angle (SAPFA) of from about −2 to about 10 degrees, a Sight Adjusted Perceived Face Angle 25 mm Heelward (SAPFA25H) of from about −5 to about 2 degrees, a Sight Adjusted Perceived Face Angle 25 mm Toeward (SAPFA25T) of from 0 to about 9 degrees, a Sight Adjusted Perceived Face Angle 50 mm Toeward (SAPFA50T) of from about 2 to about 9 degrees, and a Radius of Curvature (circle fit) of from about 300 to about 1000 mm.

In some embodiments, score lines are provided in a location on the face corresponding to center of gravity at the negative location with respect to the x-axis.

In some embodiments, a toe side roll contour is more lofted than the center face roll contour, a heel side roll contour is less lofted than the center face roll contour, a crown side bulge contour is more open than the center face bulge contour, and a sole side bulge contour is more closed than the center face bulge contour.

In some embodiments, the golf club body has a discretionary mass on the sole positioned at an angle with respect to the striking face, the discretionary mass positioned toeward along the negative x-axis and rearward along the positive y-axis.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1B:
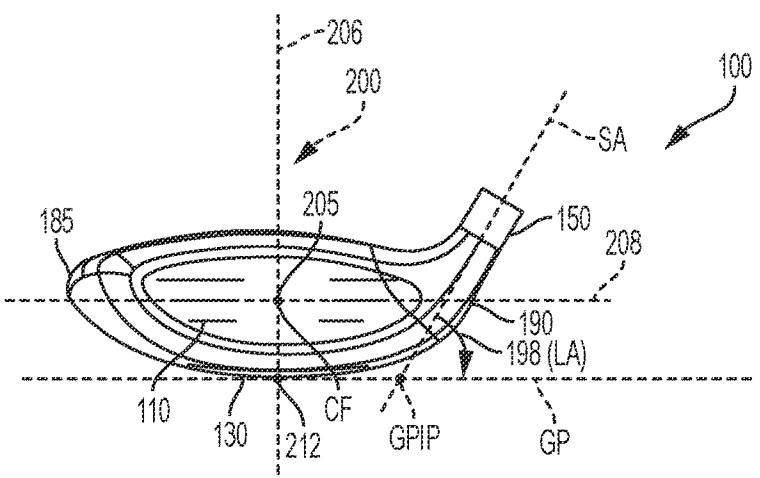
FIG. 1B is a face side view of the golf club head of FIG. 1A.

Disclosed are various golf clubs as well as golf club heads including alignment features along with associated methods, systems, devices, and various apparatus. It would be understood by one of skill in the art that the disclosed golf clubs and golf club heads are described in but a few exemplary embodiments among many. No particular terminology or description should be considered limiting on the disclosure or the scope of any claims issuing therefrom.

The sport of golf is fraught with many challenges. Enjoyment of the game is increased by addressing the need to hit the golf ball further, straighter, and with more skill. As one progresses in golfing ability, the ability to compete at golf becomes a source of enjoyment. However, one does not simply hit a golf ball straighter or further by mere desire. Like most things, skill is increased with practice—be it repetition or instruction—so that certain elements of the game become easier over time. But it may also be possible to improve one's level of play through technology.

Much technological progress in the past several decades of golf club design has emphasized the ability to hit the golf ball further. Some of these developments include increased coefficient of restitution (COR), larger golf club heads, lighter golf club heads, graphite shafts for faster club speed, and center of gravity manipulation to improve spin characteristics, among others. Other developments have addressed a golfer's variability from shot-to-shot, including larger golf club heads, higher moment of inertia (MOI), variable face thickness to increase COR for off-center shots, and more. Still further developments address a golfer's consistent miss-hits—of which the most common miss-hit is a slice—including flight control technology (FCT, such as loft and lie connection sleeves to adjust, inter alia, face angle), moveable weights, sliding weight technologies, and adjustable sole pieces (ASP). Such technologies aid golfers in fixing a consistent miss, such that a particular error can be addressed.

As such, modern technology has done much to improve the golfer's experience and to tailor the golf club to the needs of the particular player. However, some methods are more effective than others at achieving the desired playing results. For example, research suggests that—for a drive of about 280 yards—a 1° difference in face angle at impact may account for about 16 yards of lateral dispersion in the resultant shot. Similarly, for moveable weights, changes in balance of weight by 12 grams moving for about 50 mm may result in about 15 yards of lateral dispersion on the resultant shot. However, it is also understood that a change in lie angle of the golf club head affects the face angle, but at a much smaller degree. As such, simply by increasing lie angle by 1°, the face angle alignment of the golf club head may be adjusted by 0.1° open or closed. As such, for better players who are simply trying to tune their ball flight, adjusting lie angle may be much more finely tunable than adjusting face angle. However, for many golfers, slicing (a rightward-curving shot for a right-handed golfer, as understood in the art) is the primary miss, and correction of such shot is paramount to enjoyment of the game.

One of the major challenges in the game of golf involves the difference between perception and reality. Golf includes psychological challenges—as the player's confidence wanes, his or her ability to perform particular shots often wanes as well. Similarly, a player's perception of his or her own swing or game may be drastically different from the reality. Some technology may address the player's perception and help aid in understanding the misconceptions. For example, technology disclosed in U.S. Pat. No. 8,771,095 to Beach, et. al, entitled "CONTRAST-ENHANCED GOLF CLUB HEADS," filed Mar. 18, 2011, provides a player with a clearer understanding of his or her alignment than some of the preexisting art at the time, which may improve that player's ability to repeat his or her shots. However, it may be more helpful to provide those players a method to address the misconceptions and provide correction for them.

We have now surprisingly found that alignment features that includes all or a portion of the interface region between the areas of contrasting shade or color on the crown of the club head and the face of the club head and/or all or a portion of the interface region between areas of contrasting shade or color on different portions on the crown of the club head allows for improved performance in the resulting clubs by accounting for not only the actual alignment of the club head by the golfer during the shot but also as modified by the perceived alignment of the club head by the golfer. One example of a combination of contrasting colors or shades would be for example a black or metallic grey or silver color contrasting with white, but also included are other combinations which provide at a minimum a "just noticeable difference" to the human eye.

Figure 11:
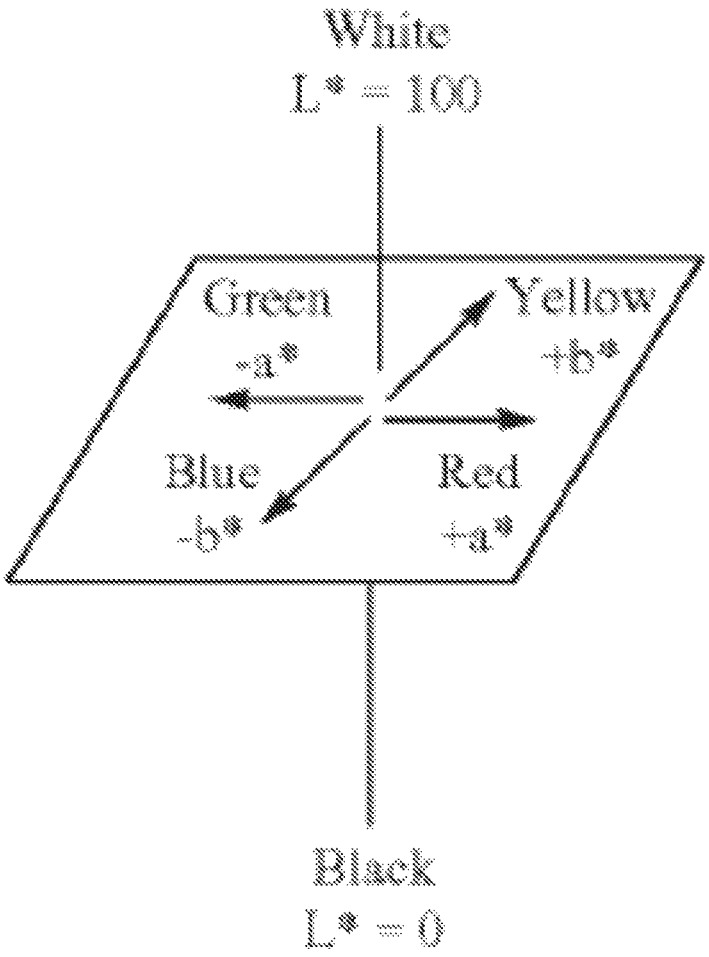
FIG. 11 is a reference to the CIELAB color system.

Although a "just noticeable difference" in terms of colors of a golf club head is to a degree somewhat subjective based on an individual's visual acuity, it can be quantified with reference to the CIELAB color system, a three dimensional system which defines a color space with respect to three channels or scales, one scale or axis for Luminance (lightness) (L) an "a" axis which extends from green (−a) to red (+a) and a "b" axis from blue (−b) to yellow (+b). This three dimensional axis is illustrated in FIG. 11.

A color difference between two colors can then be quantified using the following formula;

$$\Delta E^*_{ab}=\sqrt{(L^*_2-L^*_1)^2+(a^*_2-a^*_1)^2+(b^*_2-b^*_1)^2}$$

where ($L^*_1$, $a^*_1$ and $b^*_1$) and ($L^*_2$, $a^*_2$ and $b^*_2$) represents two colors in the L,a,b space and where $\Delta E^*_{ab}=2.3$ sets the threshold for the "just noticeable difference" under illuminant conditions using the reference illuminant D65 (similar to outside day lighting) as described in CIE 15.2-1986.

Thus, for the alignment features of the golf clubs of the present invention, a contrasting color difference, $\Delta E^*_{ab}$, is greater than 2.3, preferably greater than 10, more preferably greater than 20, even more preferably greater than 40 and even more preferably greater than 60.

Figure 1D:
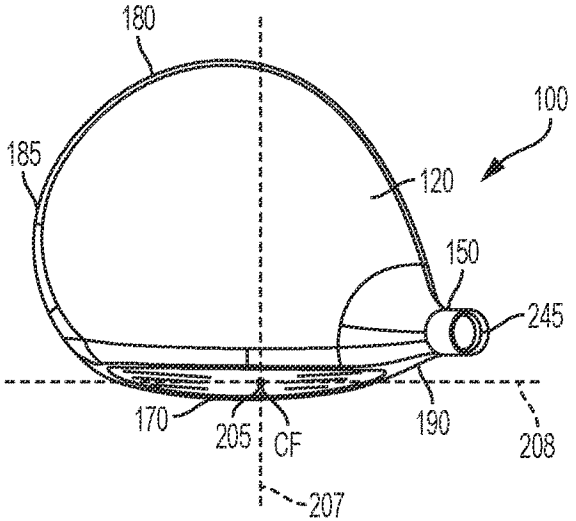
FIG. 1D is a top view of the golf club head of FIG. 1A.
Figure 1A:
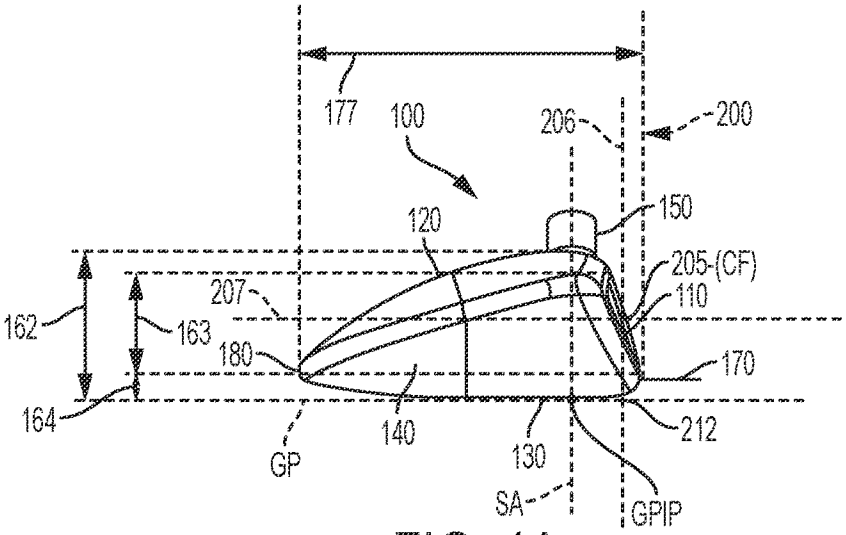
FIG. 1A is a toe side view of a golf club head in accord with one embodiment of the current disclosure.
Figure 1C:
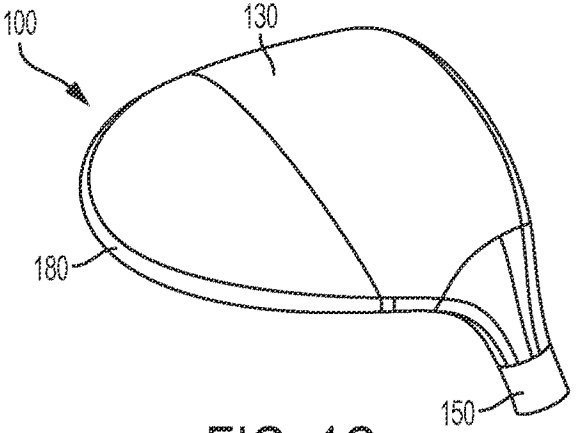
FIG. 1C is perspective view of the golf club head of FIG. 1A.

For general reference, a golf club head 100 is seen with reference to FIGS. 1A-1D. One embodiment of a golf club head 100 is disclosed and described with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure.

The metal wood club head 100 has a volume, typically measured in cubic-centimeters ($cm^3$), equal to the volumetric displacement of the club head 100, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports. In several embodiments, a golf club head of the present application can be configured to have a head volume between about 110 $cm^3$ and about 600 $cm^3$. In more particular embodiments, the head volume is between about 250 $cm^3$ and about 500 $cm^3$. In yet more specific embodiments, the head volume is between about 300 $cm^3$ and about 500 $cm^3$, between 300 $cm^3$ and about 360 $cm^3$, between about 360 $cm^3$ and about 420 $cm^3$ or between about 420 $cm^3$ and about 500 $cm^3$.

In the case of a driver, the golf club head has a volume between approximately 300 $cm^3$ and approximately 460 $cm^3$, and a total mass between approximately 145 g and approximately 245 g. In the case of a fairway wood, the golf club head 10 has a volume between approximately 100 $cm^3$ and approximately 250 $cm^3$, and a total mass between approximately 145 g and approximately 260 g. In the case of a utility or hybrid club the golf club head 10 has a volume between approximately 60 $cm^3$ and approximately 150 $cm^3$, and a total mass between approximately 145 g and approximately 280 g.

A three dimensional reference coordinate system 200 is shown. An origin 205 (CF) of the coordinate system 200 is located at the center of the face (CF) of the golf club head 100. See U.S.G.A. "Procedure for Measuring the Flexibility of a Golf Clubhead," Revision 2.0, Mar. 25, 2005, for the methodology to measure the center of the striking face of a golf club. The coordinate system 200 includes a z-axis 206, a y-axis 207, and an x-axis 208 (shown in FIG. 1B). Each axis 206,207,208 is orthogonal to each other axis 206,207, 208. The x-axis 208 is tangential to the face 110 and parallel to a ground plane (GP). The golf club head 100 includes a leading edge 170 and a trailing edge 180. For the purposes of this disclosure, the leading edge 170 is defined by a curve, the curve being defined by a series of forward most points, each forward most point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

As seen with reference to FIG. 1B, the x-axis 208 is parallel to the GP onto which the golf club head 100 may be properly soled—arranged so that the sole 130 is in contact with the GP in the desired arrangement of the golf club head 100. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 (LA) is known in the art as the lie angle (LA) of the golf club head 100. A ground plane intersection point (GPIP) of the SA and the GP is shown for reference. In various embodiments, the GPIP may be used as a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP. The top view seen in FIG. 1D shows another view of the golf club head 100. The shaft bore 245 can be seen defined in the hosel 150.

Referring back to FIG. 1A, a crown height 162 is shown and measured as the height from the GP to the highest point of the crown 120 as measured parallel to the z-axis 206. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In various embodiments, the effective face position height 164 may be 2-6 mm. In various embodiments, the effect face position height 164 may be 0-10 mm. A distance 177 of the golf club head 100 as measured in the direction of the y-axis 207 is seen as well with reference to FIG. 1A. The distance 177 is a measurement of the length from the leading edge 170 to the trailing edge 180. The distance 177 may be dependent on the loft of the golf club head in various embodiments.

For the sake of the disclosure, portions and references disclosed above will remain consistent through the various embodiments of the disclosure unless modified. One of skill in the art would understand that references pertaining to one embodiment may be included with the various other embodiments.

Figure 2:
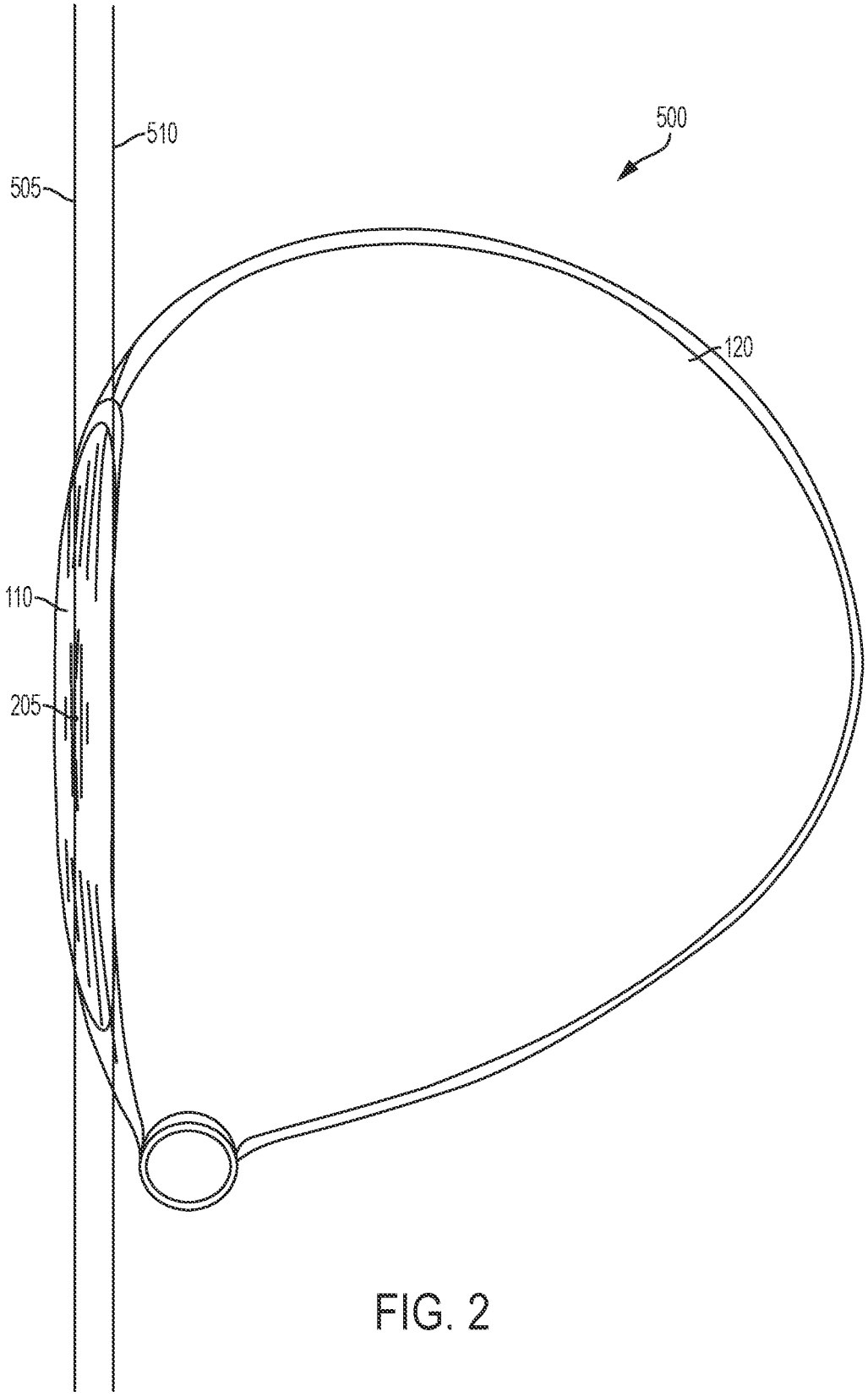
FIG. 2 is a top view of a golf club head in accord with one embodiment of the current disclosure.

As seen with reference to FIG. 2, a golf club head 500 includes a painted crown 120 and unpainted face 110. Painted or otherwise contrast-enabled crowns have been utilized as described in U.S. Pat. No. 8,771,095 to Beach, et. al, entitled "CONTRAST-ENHANCED GOLF CLUB HEADS," filed Mar. 18, 2011, to provide golfers with aided alignment. Typically the golfer employs the crown to face transition or top-line to align the club with the desired direction of the target line. The top-line transition is clearly delineated by a masking line between the painted crown and the unpainted face. While such features may have been described to some degree, use of the features to bias alignment has not been conceived in the art. With the golf club head 500 of the current embodiment, one of skill in the art would understand that the high-contrast described in U.S. Pat. No. 8,771,095 to Beach, et. al, entitled "CONTRAST-ENHANCED GOLF CLUB HEADS," filed Mar. 18, 2011, may be beneficial for emphasizing various alignment features. As such, the disclosure is incorporated by reference herein in its entirety.

For reference, a face angle tangent 505 is seen in FIG. 2. The face angle tangent 505 indicates a tangent line to the center face 205. The face angle tangent 505 in the current embodiment is coincident with the x-axis 206 (as seen with reference to prior FIGS.). Also seen in FIG. 2 is a top tangent 510. In the current embodiment, the top tangent 510 is a line made tangent to a top of the face 110 because, in the current embodiment, a joint between the face 110 and the crown 120 is coincident with paint lines. The top tangent 510 in the several embodiments of the current disclosure will follow the contours of various paint lines of the crown 120, and one of skill in the art would understand that the top tangent 510 need not necessarily be coincident with a tangent to the face 110. However, in the current embodiment, the top tangent 510 is parallel to the face angle tangent 505. As such, the paint of the crown 120 can be described as appearing square with the face angle.

The purpose of highlighting such features of the golf club head 500 is to provide a basis for the discussion of alignment with respect to the current disclosure. Through variations in alignment patterns, it may be possible to influence the golfer such that the golfer alters his or her play because of the appearance of misalignment. If a player perceives that the golf club head is such that the face is open with reference to the intended target, he or she would be more likely to try to "square up" the face by manually closing it. Many golfers prefer not to perceive a metal wood golf club head as appearing closed, as such an appearance is difficult to correct. However, even if such a player were to perceive the metal wood head as being closed, such perception does not mean that the golf club head is aligned in a closed position relative to the intended target.

Figure 3:
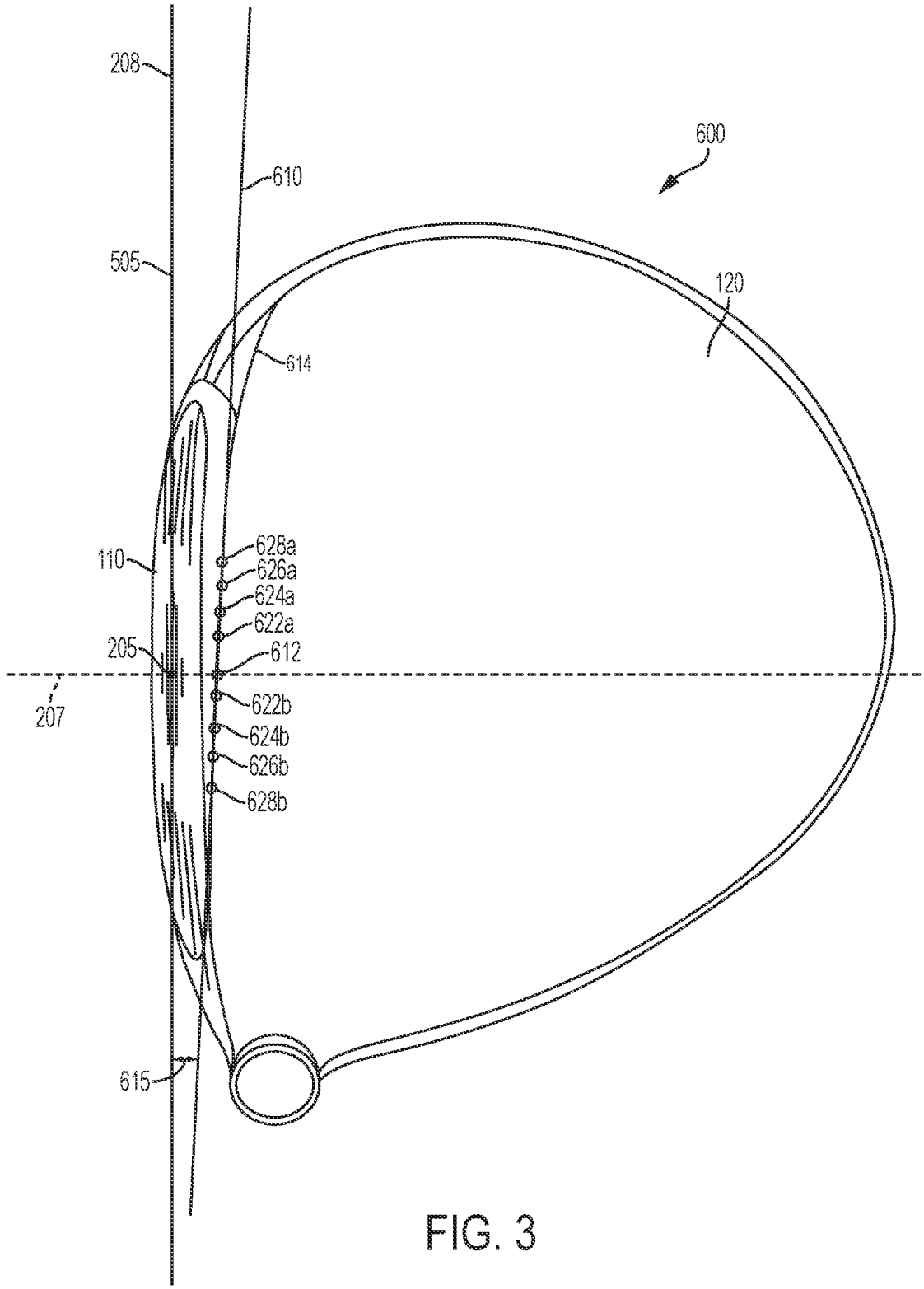
FIG. 3 is a top view of a golf club head in accord with one embodiment of the current disclosure.

As seen with reference to FIG. 3, a golf club head 600 includes similar head geometries to golf club head 500. However, the golf club head 600 includes a feature to alter the perceived angle of the face 110 for the user. In the current embodiment, a top tangent 610 that is aligned at an angle 615 with respect to the face angle tangent 505 such that the perceived angle of the face (Perceived Face Angle, PFA) is different from the actual alignment of the face angle tangent 505. In the current embodiment, the angle 615 is about 4°. In various embodiments, the angle 615 may be 2°-6°. In various embodiments, the angle 615 may be less than 7°. In various embodiments, the angle 615 may be 5-10°. In various embodiments, the angle 615 may be less than 12°. In various embodiments, the angle 615 may be up to 15°. As indicated with respect to top tangent 510, the top tangent 610 is an indicator of the alignment of an edge of an area of contrasting paint or shading of the crown 120 delineated by a masking line between the painted crown and the unpainted face relative to the color or shading of the face 110 and is the line that is tangent to an edge 614 of the contrasting crown paint or crown shading at a point 612 where the edge 614 intersects a line parallel to the y-axis 207.

In various embodiments, a perceived angle may be determined by finding a linear best-fit line of various points. For such approximation, a perceived angle tangent may be determined by best fitting points on the edge 614 at coordinates of the x-axis 208 that are coincident with center face 205—point 612—and at points ±5 mm of CF 205 (points 622*a,b*), at points ±10 mm of CF 205 (points 624*a,b*), at points ±15 mm of CF 205 (points 626*a,b*), and at points ±20 mm of CF 205 (points 628*a,b*). As such, nine points are defined along the edge 614 for best fit of the top tangent 610. In the current embodiment, the perceived angle tangent is the same as the top tangent 610.

However, such method for determining the perceived angle tangent may be most useful in cases where the edge 614 of an area of contrasting paint or shading of the crown 120 relative to the color or shading of the face 110 includes different radii of relief along the toe portion and the heel portion. In such an embodiment, a line that is tangent to the edge 614 at point 612 may not adequately represent the appearance of the alignment of the golf club head 600. Such an example can be seen with reference to FIG. 4.

Figure 4:
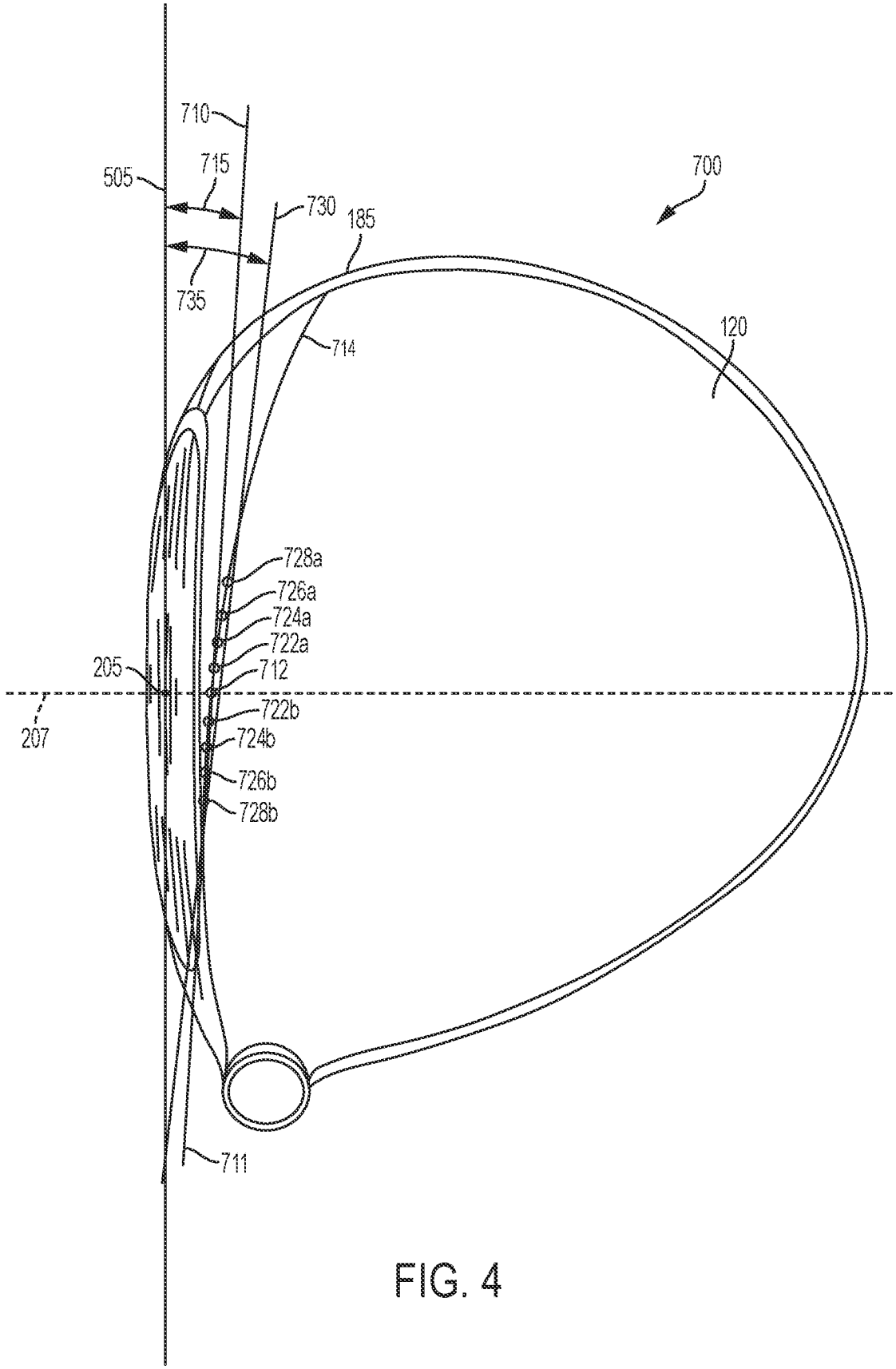
FIG. 4 is a top view of a golf club head in accord with one embodiment of the current disclosure.

As seen in FIG. 4, a golf club head 700 includes an edge 714 of an area of contrasting paint or shading of the crown 120 relative to the color or shading of the face 110 that is more aggressively rounded proximate the toe 185 than prior embodiments. As such, a line 711 that is literally tangent to the edge 714 at a point 712 that is coincident with the y-axis 207 may not adequately describe the perception. Such a line would be the top tangent 710. However as noted previously with reference to golf club head 600, points 712, 722*a,b*, 724*a,b*, 726*a,b*, and 728*a,b*, can be used to form a best fit line 730 that is aligned at a perceived angle 735 that is greater than an angle 715 of the top tangent 710. In various embodiments, the perceived angle 735 may be within the increments of angle 615, above, or may be up to 20° in various embodiments. In most embodiments, the perceived angle 735 may be 8-10°. In various embodiments, the perceived angle 735 may be 9-10°. In various embodiments, the perceived angle 735 may be 7-11®. In various embodiments, the perceived angle 735 may be 7-8.5°. In various embodiments, alignment may be influenced by the inclusion of an alignment feature that does not invoke an edge such as edges 614, 714. As seen with reference to FIG. 5, various embodiments of alignment features may be suggestive of the face angle and, as such, provide an appearance of alignment to the golfer without modifying paint lines.

Figure 5:
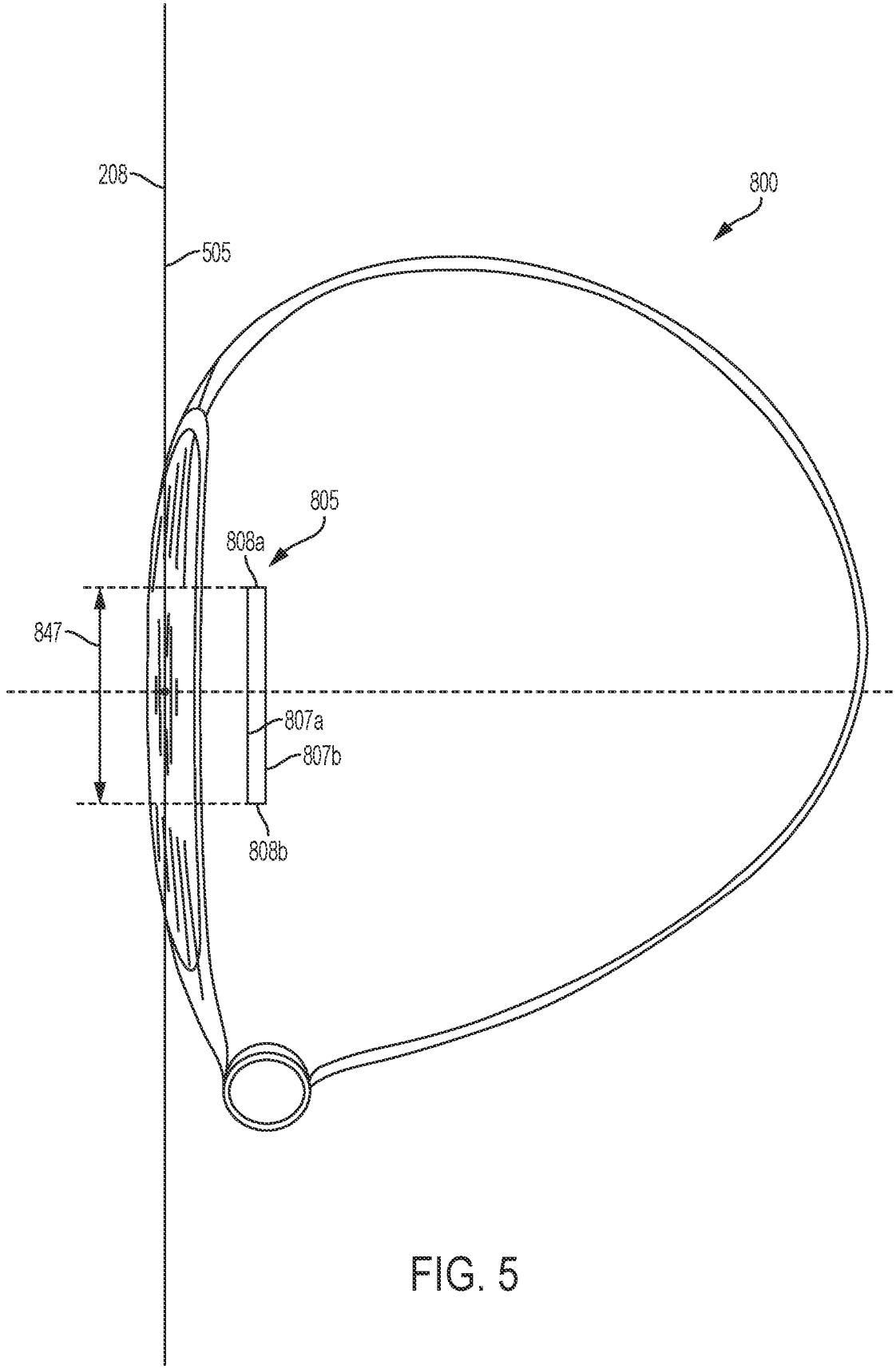
FIG. 5 is a top view of a golf club head in accord with one embodiment of the current disclosure.

A golf club head 800, as seen in FIG. 5, includes an alignment feature 805. The alignment feature 805 of the current embodiment includes at least one elongate side 807—and in the current embodiment, two elongate sides 807*a* and 807*b* are included. The alignment feature 805 of the current embodiment also includes two additional sides 808*a* and 808*b*. As can be seen, the alignment feature 805 is arranged such that the at least one elongate side 807 is aligned about parallel to the x-axis. As such, a golfer is able to use the alignment feature 805 by aligning the direction of the elongate side 807 in an orientation that is about perpendicular to the intended target. The alignment feature 805 has a length 847 as measured parallel to the x-axis 208. In the current embodiment, the length 847 is about the same as the diameter of a golf ball, or about 1.7 inches. However, in various embodiments, the length 847 may be 0.5 inches, 0.75 inches, 1 inch, 1.25 inches, 1.5 inches, 1.75 inches, 2 inches, 2.25 inches, 2.5 inches, or various lengths therein. If the length 847 of the dominant elongate side 807*a* or 807*b* is less than about 0.3 inches, the impact of the alignment feature 805 on biasing the golfer's perception decreases substantially.

However, with sufficient use, the alignment feature 805 can become the primary focus of the golfer's attention and, as such, modifications to the arrangement of the alignment feature 805 with respect to the x-axis 208 (which is coincident with the face angle tangent 505) may allow the golfer to bias his or her shots and thereby modify his or her outcome.

Figure 6:
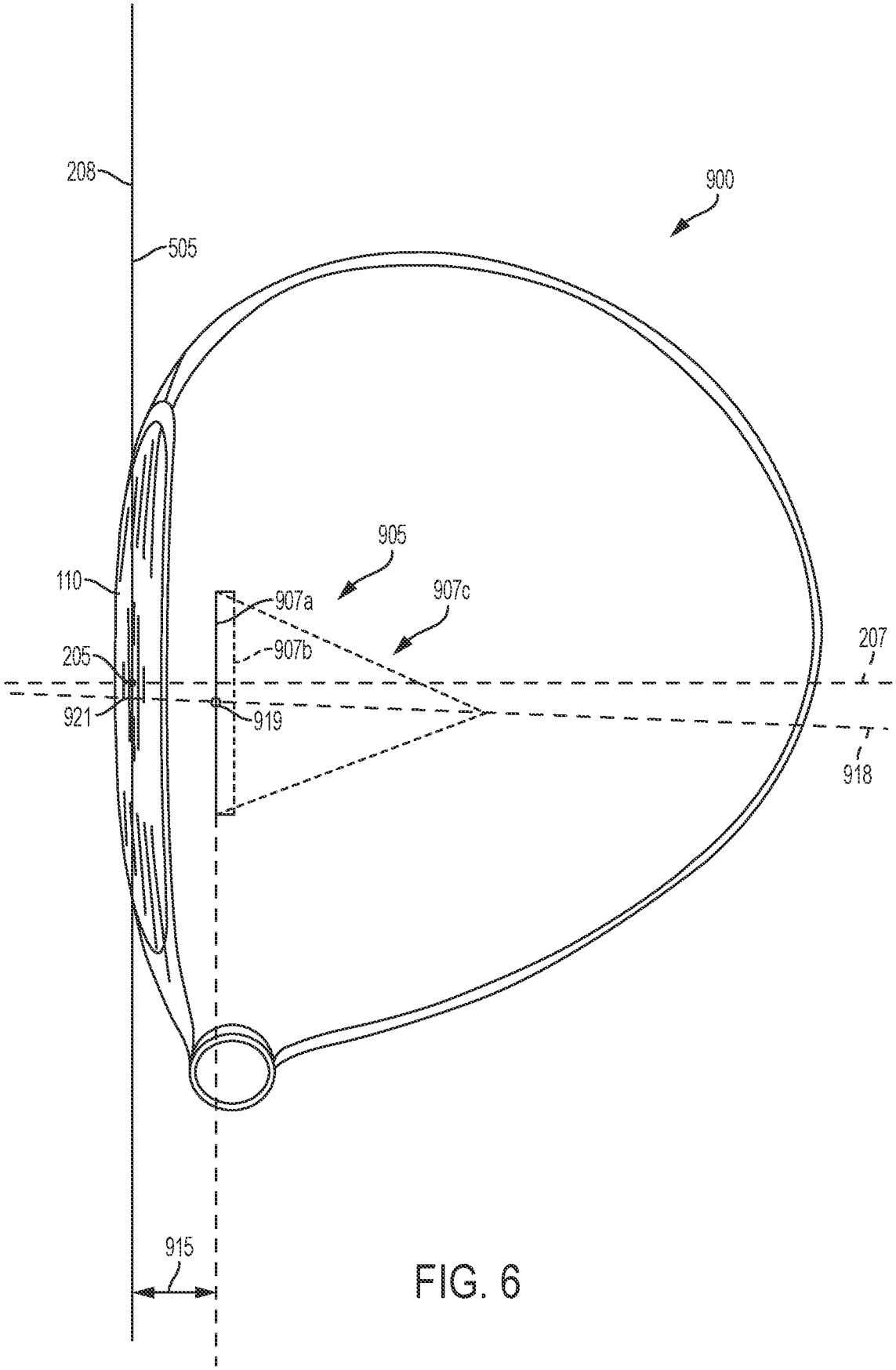
FIG. 6 is a top view of a golf club head in accord with one embodiment of the current disclosure.

As seen with reference to FIG. 6, a golf club head 900 includes an alignment feature 905. The alignment feature 905 of the current embodiment includes one elongate side 907*a* on a side of the alignment feature 905 that is proximate the face 110. The alignment feature 905 includes several potential rear portions. Similar to golf club head 800, golf club head 900 includes the alignment feature 905 having a potential second elongate side 907*b* in one embodiment. In another embodiment, an extended rear portion 907*c* may also be included or may be included separately from elongate side 907*b*. In the current embodiment, the elongate side 907*b* is oriented at an angle 915 with respect to the face angle tangent 505.

For the embodiment including second elongate side 907*b*, the second elongate side 907*b* is about parallel to the elongate side 907*a*. As such, the embodiment is similar to golf club head 800 but is oriented at angle 915. With respect to extended rear portion 907*c*, the orientation of such an embodiment may appear less askew and, consequently, may be more effective at modifying the golfer's perception of the club's alignment. A perpendicular reference line 918 is seen as a reference for being orthogonal to the elongate side 907*a*. The perpendicular reference line 918 intersects the elongate side 907*a* at a point 919 that bisects the elongate side 907*a*. Further, the perpendicular reference line 918 intersects the x-axis 208 at an intersection point 921 that is heelward of the center face 205. In the current embodiment, the intersection point 921 is heelward of center face 205 by about 2 mm. In various embodiments, the intersection point 921 may be about the same as center face 205. In various embodiments, the intersection point 921 may be up to 2 mm heelward of center face 205. In various embodiments, the intersection point 921 may be up to 5 mm heelward of center face 205. In various embodiments, the intersection point 921 may be somewhat toeward of center face 205. In various embodiments, the intersection point 921 may be ±2 mm of the center face 205.

Figure 7:
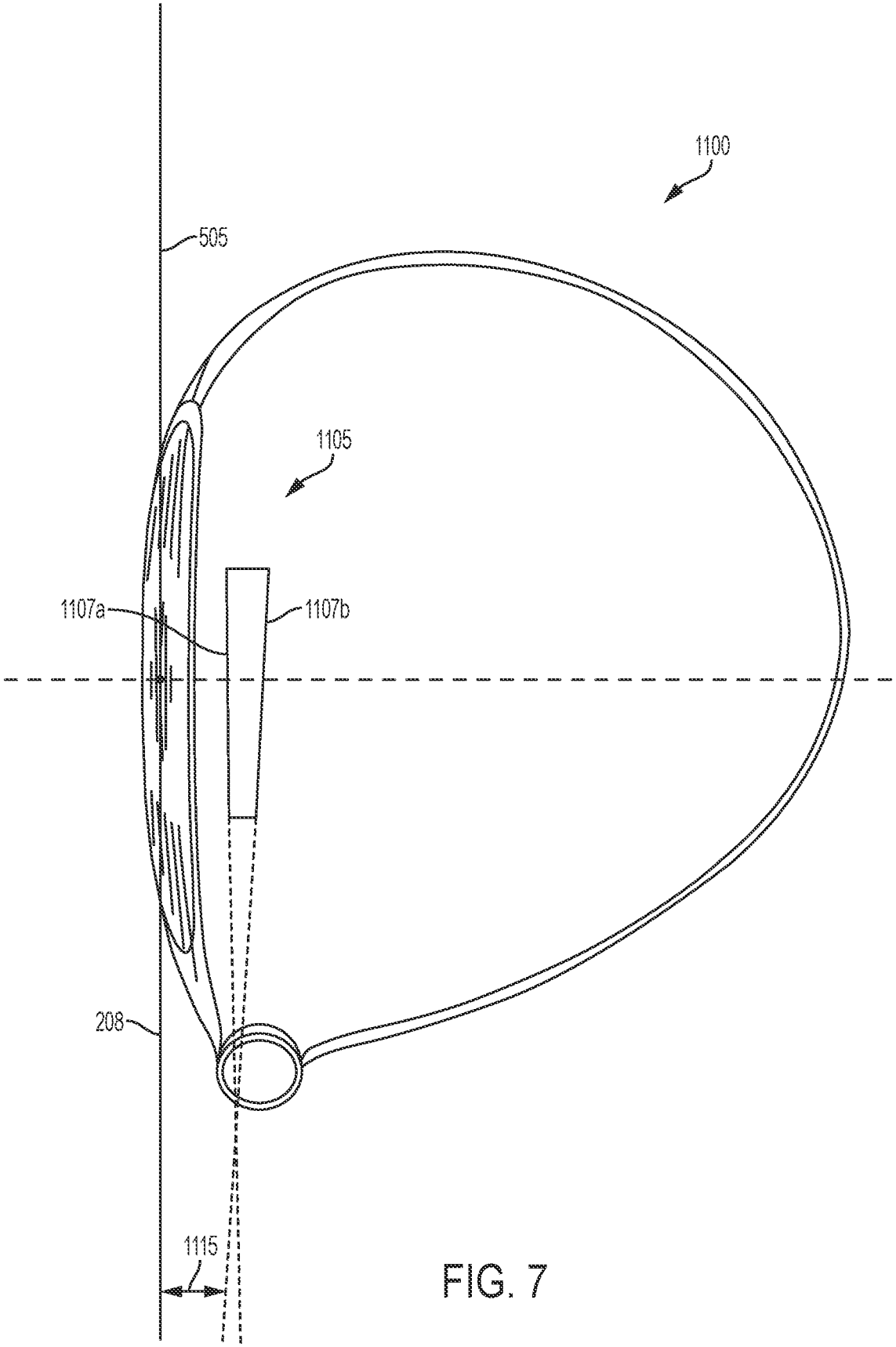
FIG. 7 is a top view of a golf club head in accord with one embodiment of the current disclosure.

Another embodiment of a golf club head 1100, shown in FIG. 7, includes an alignment feature 1105. The alignment feature has a first elongate side 1107*a* and a second elongate side 1107*b*. In the current embodiment, however, the first elongate side 1107*a* is about parallel with the face angle tangent 505 and the x-axis 208. However, the second elongate side 1107*b* is oriented at an angle 1115 with respect to the face angle tangent 505 such that the golfer's perception of alignment may be altered.

A preferred method for measuring the perceived face angle observed by a golfer further takes into account the fact that most golfers have a dominant left eye and when they address the ball with the club head, a direct line between the left eye and center face would actually cross the topline heel ward of center face and thus this is where an alignment feature which includes an edge of an area of contrasting paint or shading of the crown 120 relative to the color or shading of the face 110 would exert the most effect on the golfer's perception of the face angle. This perceived face angle is thus called a Sight Adjusted Perceived Face Angle (SAPFA) and is measured using the apparatus shown in FIGS. 8A-8C.

Figure 8B:
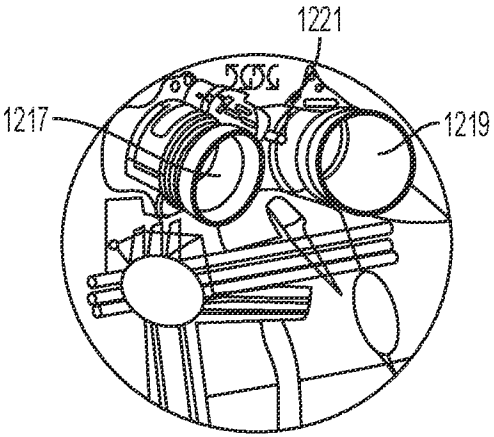
FIG. 8B is a close up view of the arrangement of the laser and cameras in the apparatus used for measuring a Sight Adjusted Perceived Face Angle in accordance with the current disclosure.
Figure 8A:
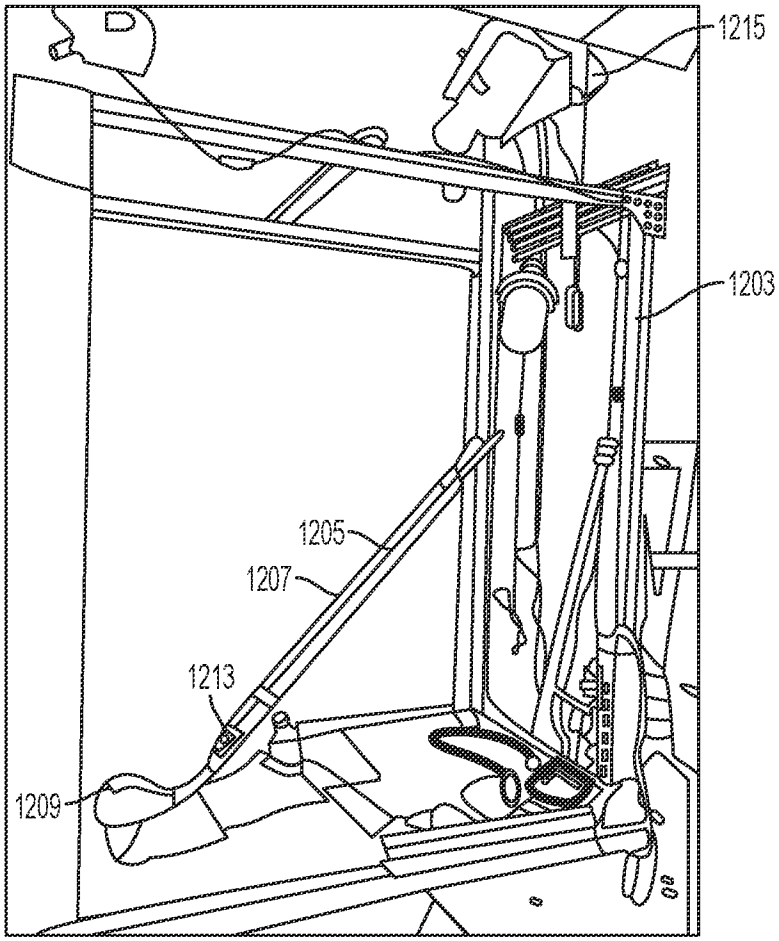
FIG. 8A is a front view of the apparatus used for measuring a Sight Adjusted Perceived Face Angle in accordance with the current disclosure.
Figure 8C:
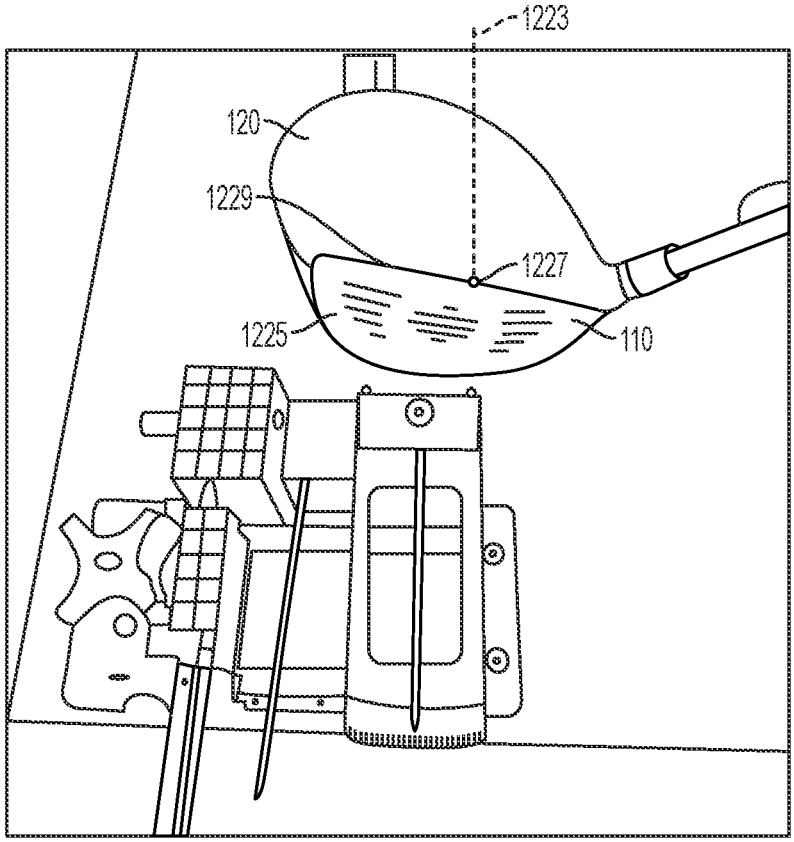
FIG. 8C is a side view of a golf club head fixture in apparatus used for measuring a Sight Adjusted Perceived Face Angle in accordance with the current disclosure.

The apparatus used is shown in FIGS. 8A, 8B and 8C and includes a frame 1203 which holds a fixture 1205 for holding and aligning a golf club shaft 1207 and attached golf club head 1209 at a Lie Angle of 45°. The face of the golf club head 1209 is also set at a face angle of 0° using a face angle gauge 1211. The face angle gauge may be any commonly used in the industry such as a De la Cruz face angle gauge). After setting the loft and lie angle the club is clamped in the fixture using a screw clamp 1213. The frame 1203 also includes an attachment point 1215 for mounting two cameras 1217 and 1219 and a Calpac Laser CP-TIM-230-9-1L-635 (Fine/Precise Red Line Laser Diode Module Class II: 1 mW/635 nm), 1221. The center of the lens of camera 1219 is situated at the x, y and z coordinates (namely 766 mm, 149 mm, 1411 mm) using the previously defined x y and z axes with USGA center face (as measured using the procedure in U.S.G.A. "Procedure for Measuring the Flexibility of a Golf Clubhead," Revision 2.0, Mar. 25, 2005, "USGA Center Face") as the origin, and where a positive x coordinate represents a position heel ward of center face, a positive y coordinate represent a position rearward of center face and a positive z coordinate represents a position above center face. The laser is situated between the two cameras.

As shown in FIG. 8C the laser produces a line 1223 having an axis parallel to the camera axis and projecting along the y axis which is adjusted such that the line intersects USGA Center Face 1225. The point 1227 at which the line then intersects the edge of an area of contrasting paint or shading of the crown 120 relative to the color or shading of the face 110 which in this case corresponds to the white paint line of the crown 1229 is then physically marked on the paint line using a marker and acts a the datum or reference point. A camera is then activated to take an image of the club head including the datum or reference point 1227 and the paint line 1229.

The image from the camera is then analyzed using an image analyzer software package (which can be any of these known in the art able to import an image and can fit a line to the image using a curve fitting function). A best fit line to the paint line is then determined. For most embodiments the best fit to the paint line results from fitting the line to a quadratic equation of the form $y=ax^2+bx+c$. Two points are then selected on this best fit line at arc length between +/−0.25 mm from the datum point. A straight line is then drawn between the two points and a line perpendicular to this line is then drawn through the datum. The Sight Adjusted Perceived Face Angle (SAPFA) is then measured as the angle between the perpendicular line and the y axis.

Using this method the Sight Adjusted Perceived Face Angle (SAPFA) of the golf clubs of the present invention may be from −2 to 10, preferably from 0 to 6, more preferably from 0.5 to 4 even more preferably from 1 to 2.5 and most preferably from 1.5 to 2 degrees.

EXAMPLES

Four identical club heads were taken and the paint line edge of an area of contrasting paint or shading of the crown 120 relative to the color or shading of the face 110 was varied and the Sight Adjusted Perceived Face Angles (SAPFA) measured.

In addition to the Sight Adjusted Perceived Face Angles (SAPFA) four additional measurements were taken to describe the paint line edge alignment feature of the four clubs and these values are summarized in Table 1.

In addition to the SAPFA, three additional angles were measured at different points as measured from the datum along the best fit line to the paint line edge alignment feature determined as for the SAPFA. The first angle was obtained at a point along the best fit line at an arc length 25 mm heelward of the datum. Again as for the SAPFA measurement, two points at arc length between +/−0.25 mm from the 25 mm point were selected. A straight line is then drawn between these two points and a line perpendicular to this line is then drawn at the 25 mm point. The angle is then measured between this perpendicular line and the y axis. This angle is reported as the Sight Adjusted Perceived Face Angle 25 mm Heelward ("$SAPFA_{25H}$").

The second angle was obtained at a point along the best fit line at an arc length 25 mm toeward of the datum. Again as for the SAPFA measurement, two points at arc length between +/−0.25 mm from the 25 mm point were selected. A straight line is then drawn between the two points and a line perpendicular to this line is then drawn at the 25 mm point. The angle is then measured between this perpendicular line and the y axis. This angle is reported as the Sight Adjusted Perceived Face Angle 25 mm Toeward ("$SAPFA_{25T}$").

In addition, to capture any effect of greater rounding of the paint line edge alignment feature towards the toe of the golf club head, a third angle was obtained at a point along the best fit line at an arc length 50 mm toeward of the datum. Again as for the SAPFA measurement, two points at arc length between +/−0.25 mm from the 25 mm point were selected. A straight line is then drawn between the two points and a line perpendicular to this line is then drawn at the 50 mm point. The angle is then measured between this perpendicular line and the y axis. This angle is reported as the Sight Adjusted Perceived Face Angle 50 mm Toeward ("$SAPFA_{50T}$").

Finally, in an attempt to describe more of the paint line edge alignment feature, the image of the paint line edge alignment feature imported into the image analyzer as for the SAPFA measurement was also fit to a circle using the formula $(x-a)^2+(y-b)^2=r^2$, and the radius of curvature of this circular fit line determined and reported in Table 1 as the Radius of Curvature (circle fit).

TABLE 1

| Example No. | Sight Adjusted Perceived Face Angle (SAPFA) (degrees) | Radius of Curvature (circle fit, mm) | Angle 25 mm Heelward (degrees) | Angle 25 mm Toeward (degrees) | Angle 50 mm Toeward (degrees) |
|---|---|---|---|---|---|
| 1 | 3.5722 | 570.47 | 1.1377 | 5.9453 | 8.2757 |
| 2 | 5.2813 | 419.53 | 1.7509 | 8.6871 | 11.9168 |
| 3 | 0.2927 | 781.02 | −1.4461 | 2.0189 | 3.7129 |
| 4 | −0.5925 | 568.21 | −3.06 | 1.8533 | 4.245 |

Each club was then hit between 6 to 12 times by 10 different players into a blank screen with no trajectory or other feedback available to the player, and a Trackman 3e launch monitor and the TPS software package were used to calculate the total dispersion from a center target line with a positive total dispersion indicating the number of yards right of the center target line and a negative total dispersion indicating the number of yards left of the center target line. Thus, a player who has a tendency to slice the ball i.e. produce a ball flight right of the target line would be assisted in producing a shot closer to the target line if the golf club tended to yield a more negative dispersion.

Figure 9:
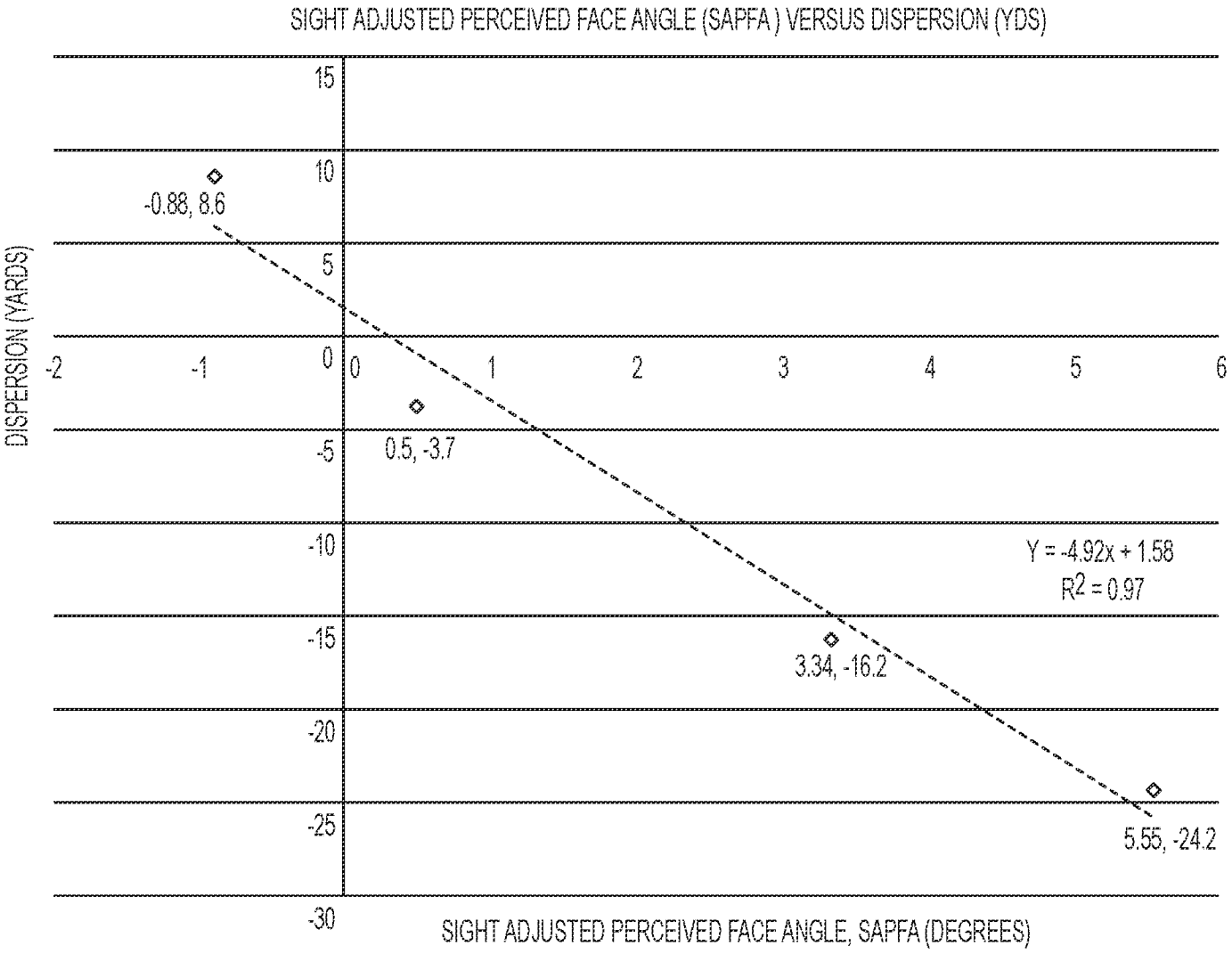
FIG. 9 is a graph of the Sight Adjusted Perceived Face Angle vs. the Dispersion in Ball Flight for four clubs having the alignment features in accordance with the current disclosure.

The graph in FIG. 9 plots the Sight Adjusted Perceived Face Angle (SAPFA) versus the average total dispersion of each club when hit 6-12 times by each player. The data show that adjustment of the edge of an area of contrasting paint or shading of the crown relative to the color or shading of the face such that the Sight Adjusted Perceived Face Angle (SAPFA) of the golf club goes from −0.88 degrees through 0.5 degrees through 3.34 degrees to 5.55 degrees results in an overall change in total dispersion from 8.6 yards to the right of the target line to 24.2 yards to the left of the target i.e. an absolute change in total dispersion of 32.8 yards from the same club head by solely manipulating the appearance of the paint line comprising the primary alignment feature.

The golf club heads of the present invention have a Sight Adjusted Perceived Face Angle (SAPFA) of from about −2 to about 10, preferably of from about 0 to about 6, more preferably of from about 0.5 to about 4 even more preferably of from about 1 to about 2.5 and most preferably of from about 1.5 to about 2 degrees.

The golf club heads of the present invention also have a Sight Adjusted Perceived Face Angle 25 mm Heelward ("$SAPFA_{25H}$") of from about −5 to about 2, more preferably of from about −3 to 0, even more preferably of from about −2 to about −1 degrees.

The golf club heads of the present invention also have a Sight Adjusted Perceived Face Angle 25 mm Toeward ("$SAPFA_{25T}$") of from 0 to about 9, more preferably of from about 1 to about 4.5, even more preferably of from about 2 to about 4 degrees.

The golf club heads of the present invention also have a Sight Adjusted Perceived Face Angle 50 mm Toeward ("$SAPFA_{50T}$") of from about 2 to about 9, more preferably of from about 3.5 to about 8, even more preferably of from about 4 to about 7 degrees.

The golf club heads of the present invention also have a Radius of Curvature (circle fit) of from about 300 to about 1000, more preferably of from about 400 to about 900, even more preferably of from about 500 to about 775 mm.

In other embodiments, the golf club head in addition to having a first or primary alignment feature as described earlier with reference to FIGS. 1-4, may also have a second or secondary alignment feature including the alignment features as described earlier with reference to FIGS. 5, 6 and 7.

Figure 10B:
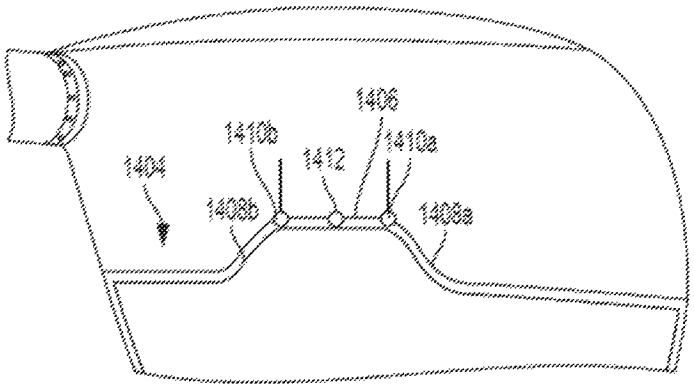
FIG. 10B is a top view of a golf club head in accord with one embodiment of the current disclosure.
Figure 10A:
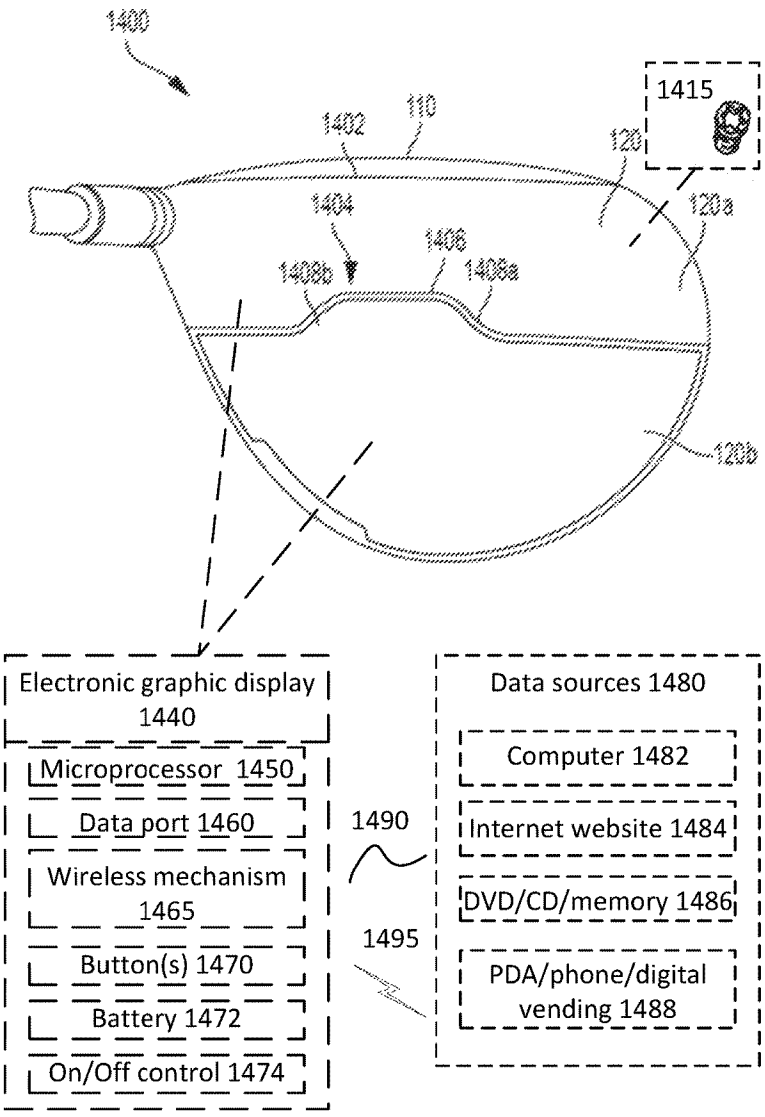
FIG. 10A is a top view of a golf club head in accord with one embodiment of the current disclosure.

In an especially preferred embodiment, shown in FIG. 10A and FIG. 10B, the golf club head 1400 of the present invention can have a crown 120 having a first crown portion 120*a* having a first color or shade and a second crown portion 120*b* having a second color or shade, and a primary alignment feature consisting of a an edge 1402 of an area of contrasting paint or shading of the first crown portion 120*a* relative to the color or shading of the face 110 as described earlier and illustrated, e.g., in FIGS. 3 and 4. In addition, the club head has a secondary alignment feature 1404 proximate the face but rearward of the primary alignment feature and delineated by a second paint or masking line which delineates the transition between the first crown portion 120*a* having an area of contrasting shade or color with the shade or color of the face 110; and a second crown portion 120*b* having an area of contrasting shade or color with the shade or color of the first crown portion 120*a*. The secondary alignment feature a comprises an elongate side 1406 having a length of from about 0.5 inches to about 1.7 inches, and a second and third elongate side 1408 *a* and 1408 *b* extending back from the face and at an angle to elongate side 1406 and rearward of elongate side 1406.

The Sight Adjusted Perceived Face Angle Secondary Alignment Feature, ("$SAPFA_{SAF}$") of the secondary alignment feature constituting elongate side 1406 and the second and third elongate sides 1408*a* and 1408*b* may be measured by importing the image of the club head obtained as per the measurement for the SAPFA. Points 1410*b* and 1410*a* are selected which are the innermost ends of the radii connecting lines 1408*b* and 1408*a* with elongate side 1406 as shown in FIG. 10B. A best fit quadratic line is then fit for the secondary alignment feature between point 1410*a* and 1410*b* and then a datum 1412 is determined as the center point along the arc length of the best fit line, again as for the SAPFA measurement, two points at arc length between +/−0.25 mm from the datum were selected. A straight line is then drawn between these two points and a line perpendicular to this line is then drawn at the datum. The Sight Adjusted Perceived Face Angle Secondary Alignment Feature, ("$SAPFA_{SAF}$") is then measured as the angle between this perpendicular line and the y axis.

In some embodiments, the golf club heads of the present invention also have a Sight Adjusted Perceived Face Angle Secondary Alignment Feature, ("$SAPFA_{SAF}$") of from about −2 to about 6, more preferably of from 0 to about 5, even more preferably of from about 1.5 to about 4 degrees.

The primary and secondary alignment features as described herein typically utilize paint lines which demark the edge of an area of contrasting paint, e.g., between first crown portion 120*a* and second crown portion 120*b*, or shading of the crown 120 relative to the color or shading of the face 110. Preferably the contrasting colors are white in the crown area (e.g., first crown portion 120*a*) and black in the face area. Typically painting or shading of golf club heads is performed at the time of manufacture and thus are fixed for the lifetime of the club absent some additional painting performed after purchase by the owner. It would be highly advantageous if the profile of the alignment features could be adjusted by the user using a simple method which would allow adjustment of the perceived face angle by the user in response to the golfer's observed ball direction tendency on any given day.

In some embodiments of the golf club heads of the present invention the crown 120 comprises a rotatable or otherwise movable portion, e.g., the first crown portion 120*a*, with one side of said portion including the edge of an area of contrasting paint or shading of the crown 120 relative to the color or shading of the face 110 or relative to the color or shading of the second crown portion 120*b*, which can be rotated or moved sufficient to yield the desired Perceived Face Angle, PFA and/or Sight Adjusted Perceived Face Angle (SAPFA) and/or Sight Adjusted Perceived Face Angle Secondary Alignment Feature, ("$SAPFA_{SAF}$") to produce the desired ball flight. The movable portion of the crown is held in position by a fastening device such as a screw or bolt or other fastening means 1415, which is loosened to allow for rotation or movement and then subsequently tightened to fix the position of the crown after adjustment.

In addition to a portion of the crown being movable, other embodiments include a movable layer or cover on top of the crown with one side of said movable layer or cover including the edge of an area of contrasting paint or shading of the crown 120, e.g., the first crown portion 120*a*, relative to the color or shading of the face 110 or relative to the color or shading of the second crown portion 120*b*, which can be rotated or moved sufficient to yield the desired Perceived Face Angle, PFA and/or Sight Adjusted Perceived Face Angle (SAPFA) and/or Sight Adjusted Perceived Face Angle Secondary Alignment Feature, ("$SAPFA_{SAF}$"). The movable portion of the layer or cover is again held in position by a fastening device such as a screw or bolt or other fastening means 1415, which is loosened to allow for rotation or movement and then subsequently tightened to fix the position of the movable layer or cover after adjustment.

In other embodiments a portion of the crown 120, e.g., first crown portion 120*a*, second crown portion 120*b*, or both, may comprise electronic features, e.g. electronic graphic display 1440, e.g. as illustrated in FIG. 10A, which can be selectively activated to generate the required appearance including but not limited to light emitting diodes (LED), organic LED's (OLED), printed electronics with illumination devices, embedded electronics with illumination devices, electroluminescent devices, and so-called quantum dots.

In other embodiments, a portion of the crown 120, e.g., first crown portion 120*a*, second crown portion 120*b*, or both, may comprise a coating that alters its characteristics when exposed to external conditions including but not limited to thermochromic coatings, photochromic coatings, electrochromic coatings and paramagnetic paint.

In one preferred embodiment, illustrated, e.g., with regard to FIG. 10A, at least a portion of the crown 120 of the golf club head, e.g., first crown portion 120*a*, second crown portion 120*b*, or both, or a layer covering at least a portion of the crown of the golf club head, comprises an electronic graphic display 1440. The display 1440 provides active color and graphic control for either the entire top portion of the crown 120 or layer covering at least a portion of the crown e.g., first crown portion 120*a*, second crown portion 120*b*, or both. The display 1440 may be constructed from flexible organic light-emitting diodes (OLED) displays, e-ink technology, digital fabrics, or other known means of active electronic color and graphic display means. For example, an organic light emitting diode (OLED) (e.g., a light emitting polymer (LEP), and organic electro luminescence (OEL)) is a light-emitting diode (LED) whose emissive electroluminescent layer is composed of a film of organic compounds. The layer usually contains a polymer substance that allows suitable organic compounds to be deposited in rows and columns onto a carrier substrate such as the at least a portion of the crown of the golf club head or a layer covering at least a portion of the crown of the golf club head, by a simple "printing" process. The resulting, matrix of pixels can emit light of different colors.

In some embodiments, the at least a portion of the crown 120 of the golf club head, e.g., first crown portion 120*a*, second crown portion 120*b*, or both or a layer covering at least a portion of the crown of the golf club head is segmented into portions which may be controlled differently from each other. For example, one side of the alignment feature, e.g. second crown portion 120*b* or face 110, has a static surface color and the other side, e.g., first crown portion 120*a* or crown 120, a second, contrasting surface color display capability, e.g., electronic graphic display 1440.

The display 1440 is operatively connected to a microprocessor 1450 disposed in the golf club head (e.g., via wires). The microprocessor is further operatively connected to a data port 1460, for example a universal serial bus (USB) port (e.g., via wires). The data port allows transfer and retrieval of data to and from the microprocessor. Data ports and data transfer protocols are well known to one of ordinary skill in the art. The data port (e.g., a USB port) may be disposed in the rearward area of the golf club head.

Data can be obtained from a variety of sources 1480. In some embodiments, an Internet website 1484 is dedicated to support of the golf club head of the present invention. For example, the website may contain downloadable data and protocols (e.g., colors, color patterns, images, video content, logos, etc.) that can be uploaded into the microprocessor 1450 of the golf club head (via the data port 1460, via a cable, via a computer 1482). As an example, the website may have a gallery for choosing colors to be displayed, as well as patterns of the colors In some embodiments, data can be uploaded from other sources 1480, for example DVDs, CDs, memory devices (e.g., flash memory) 1486, and the like, Sources may also include cellular phones, smart phones, personal digital assistants (PDAs), digital vending kiosks 1488, and the like. In some embodiments, the data can be uploaded and downloaded via other mechanisms, for example, wired mechanisms 1490 or wirelessly 1495, e.g., via a wireless mechanism 1465. Such mechanisms may include Bluetooth™, infrared datalink (IrDa), Wi-Fi, UWB, and the like.

In some embodiments, as illustrated in FIG. 10A, one or more control buttons 1470 are disposed on the golf club head allowing a user to manipulate the display 1440 as desired. The control buttons are operatively connected to the microprocessor 1450. The microprocessor is configured to receive input signals from the control buttons and further send output commands to manipulate the display. The control buttons may be operatively connected to the display and/or the microprocessor via one or more wires.

The microprocessor 1450 and/or display 1440 are operatively connected to a power source, for example a battery 1472. The battery may be rechargeable. In some embodiments, the battery comprises a control means 1474 for turning on and off the device. All wires and data ports and other electronic systems are adapted to sustain the impact forces incurred when a golfer hits a golf ball with the golf club head.

In other embodiments of the golf club heads of the present invention a method to accomplish user adjustably of the alignment feature would involve at least a portion of the crown 120 of the golf club head, e.g., first crown portion 120*a*, second crown portion 120*b*, or both, or a layer covering at least a portion of the crown of the golf club head, being covered by a dielectric electroluminescent coating system using as one example the materials and methods as described in U.S. Pat. No. 6,926,972 by M. Jakobi et al., issuing on Aug. 9, 2005 and assigned to the BASF Corporation, the entire contents of which are incorporated by reference herein. Using this technology an electric current (provided by a small battery e.g., battery 1472, fixed securely in the golf club head cavity) could be selectively employed to use electroluminescence to highlight (or eliminate) a particular color thereby adjusting the orientation of the primary or secondary alignment features described herein.

In some embodiments, the golf club head may include sensors, such as described in U.S. patent application Ser. No. 15/996,854, filed Jun. 4, 2018, which is incorporated herein by reference. For example, the golf club may include one or more sensors for measuring swing speed, face angle, lie angle, tempo, swing path, face angle to swing path relationships, dynamic loft, and shaft lean. Other measurements may include back stroke time, forward stroke time, total stroke time, tempo, impact stroke speed, impact location, back stroke length, back stroke rotation, forward stroke rotation, rotation change, lie, and loft. Further measurements may include golf shot locations during play and golf shot distance data. Additional and different measurements may also be captured. The measurements may be captured during a full swing, short game, putting, or during other golf swings.

The one or more sensors may include motion sensors, accelerometers, gyro sensors, magnetometers, global positioning system (GPS) sensors, optical markers, or other sensors. The one or more sensors may be attached to the golf club head, integrated into a display of the golf club, attached to or integrated into the shaft of the golf club (e.g., proximate to the butt end of golf club grip, along the shaft, or at another location), housed within the golf club grip, and/or attached to or integrated into another portion of the golf club. In an embodiment, multiple sensors are provided on the golf club, such as at the same or different portions of the golf club. For example, a first sensor may be attached to or integrated into the golf club head and a second sensor housed within the grip of the golf club or attached to the golf club shaft. Additional and different multiple sensor arrangements may be used.

In an embodiment, a display or another electronic feature of the golf club may display one or more of the measured values on the crown or another portion of the golf club head. For example, the display or another electronic feature may be a removable display device, or may integrated into user device, such as a PDA, smart phone, iPhone, iPad, iPod, or other computing device. The one or more measured values may be displayed using an application running on the display device or using a device associated with the display or other electronic feature of the golf club head. In some embodiments, the sensors may be configured to communicate with an external device, such as a computing device (e.g., personal computer (PC), laptop computer, tablet, smart phone, cell phone, iPhone, iPad, Personal Digital Assistant (PDA), server computer, or another computing device), a launch monitor, a club fitting platform, or another device. In these embodiments, the one or more measured values may be displayed using an application running on the external device. In some embodiments, the one or more sensors interact with an external device, such as a video camera, to capture one or more measured values.

Referring back to FIG. 1B, a coordinate system for measuring a center of gravity (CG) location is located at the face center 205. In one embodiment, the positive x-axis 208 is projecting toward the heel side of the club head and the negative x-axis 208 is projecting toward the toe side of the golf club head. Further, the positive z-axis 206 is projecting toward the crown side of the club head and the negative z-axis 206 is projecting toward the sole side of the golf club head. Finally, the positive y-axis 209 is projecting toward the rear of the club head parallel to a ground plane.

In exemplary embodiments, a projected CG location on the striking face is considered the "sweet spot" of the club head. The projected CG location is found by balancing the clubhead on a point. The projected CG location is generally projected along a line that is perpendicular to the face of the club head. In some embodiments, the projected CGy (y-axis coordinate) location is less than 2 mm above the center face location, less than 1 mm above the center face, or up to 1 mm or 2 mm below the center face location 205. In some embodiments, the golf club head has a CG with a CGx (x-axis) coordinate between about −10 mm and about 10 mm from the center face location 205, a CGy between about 15 mm and about 50 mm, and a CGz (z-axis coordinate) between about −10 mm and about 5 mm. In some embodiments, the CGy is between about 20 mm and about 50 mm.

The golf club head also has moments of inertia defined about three axes extending through the golf club head CG orientation, including: a CGz extending through the CG in a generally vertical direction relative to the ground plane when the club head is at address position, a CGx extending through the CG in a heel-to-toe direction generally parallel to the striking face 110 and generally perpendicular to the CGz, and a CGy extending through the CG in a front-to-back direction and generally perpendicular to the CGx and the CGz. The CGx and the CGy both extend in a generally horizontal direction relative to the ground plane when the club head 100 is at the address position.

The moment of inertia about the golf club head CGx is calculated by the following equation:

$$I_{CG_x}=\int(y^2+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CGx and the CGz. The CG xy-plane is a plane defined by the CGx and the CGy.

The moment of inertia about the golf club head CGy is calculated by the following equation:

$$I_{CG_y}=\int(x^2+z^2)dm$$

In the above equation, x is the distance from a golf club head CG yz-plane to an infinitesimal mass dm and z is the distance from a golf club head CG xy-plane to the infinitesimal mass dm. The golf club head CG yz-plane is a plane defined by the CGy and the CGz. The CG yx-plane is a plane defined by the CGy and the CGx.

Moreover, a moment of inertia about the golf club head CGz is calculated by the following equation:

$$I_{CG_z}=\int(x^2+y^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CGy and the CGz.

In certain implementations, the club head can have a moment of inertia about the CGz between about 450 kg·mm$^2$ and about 650 kg·mm$^2$, and a moment of inertia about the CGx between about 300 kg·mm$^2$ and about 500 kg·mm$^2$, and a moment of inertia about the CGy between about 300 kg·mm$^2$ and about 500 kg·mm$^2$.

For a variety of reasons, it may be advantageous to orient the center of gravity (CG) of the golf club head toward the toe. For example, users often strike the golf ball high (e.g., +3 to +4 mm on the z-axis) and toeward (e.g., −5 to −7 mm on the x-axis) on the striking face. Striking the ball off-center (i.e., in a location different from the projected CG location on the striking face) generally decreases ball-speed, and as a result, decreases the distance traveled by the golf ball.

Further, as discussed above, striking the face toeward also produces a gear effect, producing hook spin. Increasing the negative CGx orientation (i.e., from −2 to −10 mm on the x-axis) may alter the gear effect by decreasing the counter-clockwise spin (i.e., for a right-handed golfer) which ultimately results in the golf ball curving to the left.

Additionally, in order to maximize the moment of inertia (MOI) about a z-axis extending through the CGz, a negative CGx orientation may be provided. Working in conjunction with the weight of the hosel of the golf club, a negative CGx orientation allows for greater MOI about the z-axis by strategically distributing club head weight on the x-axis at corresponding positive and negative orientations.

Alternatively, it may be advantageous to orient the CG of the golf club head toward the heel. For example, by increasing positive CGx orientation (i.e., from +2 mm to 0 mm on the x-axis), the club head may close faster (i.e., at 400-500 rpm), increasing local club head speed and producing more ball-speed, and as a result, increasing the distance traveled by the golf ball.

In certain implementations, the golf club head can have a CGx between about +2 and about −10 mm. For example, the CGx for a golf club head with adjustable weights (discussed below) is between about −3 mm to about −4 mm. In certain implementations, the club head can have a low CGz of less than 0, such as between 0 and about −4 mm. In certain implementations, the club head can have a CGz positioned below a geometric center of the face. In certain implementations, the club head can have a moment of inertia about the CGz (also referred to as "Izz") above 400 kg·mm$^2$, above 460 kg·mm$^2$ or above 480 kg·mm$^2$. A moment of inertia about the CGx (also referred to as "Ixx") can be above 300 kg·mm$^2$. The moments of inertia of the golf club head can also be expressed as a ratio, such as a ratio of Ixx to Izz. For example, in some embodiments, a ratio of Ixx to Izz is at most 0.6, or 60%. In an example, the golf club head can have an Ixx above 300 kg·mm$^2$ and an Izz above 500 kg·mm$^2$, such that Ixx/Izz is less than or equal to 0.6. In another example, the Ixx is greater than 280 kg·mm$^2$ and the Izz is greater than 465 kg·mm$^2$.

In certain implementations, the golf club head can have a Zup less than 30 mm. For example, above ground, an alternative club head coordinate system places the head origin at the intersection of the z-axis and the ground plane, providing positive z-axis coordinates for every club head feature. As used herein, "Zup" means the CG z-axis location determined according to this above ground coordinate system. Zup generally refers to the height of the CG above the ground plane as measured along the z-axis.

In certain implementations, the golf club head can have a Delta 1 (i.e., measure of how far rearward in the golf club head body the CG is located) greater than 20, such as greater than 26 in certain implementations. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the golf club head face. Thus, for embodiments of the disclosed golf club heads in which the projected CG on the ball striking club face is lower than the geometric center, reducing Delta 1 can lower the projected CG and increase the distance between the geometric center and the projected CG. Note also that a lower projected CG can promote a higher launch and a reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

The United States Golf Association (USGA) regulations constrain golf club head shapes, sizes, and moments of inertia. Due to these constraints, golf club manufacturers and designers struggle to produce golf club heads having maximum size and moment of inertia characteristics while maintaining all other golf club head characteristics. For example, one such constraint is a volume limitation of 460 cm$^3$. In general, volume is measured using the water displacement method. However, the USGA will fill any significant cavities in the sole or series of cavities which have a collective volume of greater than 15 cm$^3$.

In some embodiments, as in the case of a fairway wood, the golf club head may have a volume between about 100 cm$^3$ and about 300 cm$^3$, such as between about 150 cm$^3$ and about 250 cm$^3$, or between about 130 cm$^3$ and about 190 cm$^3$, or between about 125 cm$^3$ and about 240 cm$^3$, and a total mass between about 125 g and about 260 g, or between about 200 g and about 250 g. In the case of a utility or hybrid club, the golf club head may have a volume between about 60 cm$^3$ and about 150 cm$^3$, or between about 85 cm$^3$ and about 120 cm$^3$, and a total mass between about 125 g and about 280 g, or between about 200 g and about 250 g. In the case of a driver, the golf club head may have a volume between about 300 cm$^3$ and about 600 cm$^3$, between about 350 cm$^3$ and about 600 cm$^3$, and/or between about 350 cm$^3$ and about 500 cm$^3$, and can have a total mass between about 145 g and about 1060 g, such as between about 195 g and about 205 g.

Historically, $CG_x$ locations were heelward about 4-6 mm. More recently, $CG_x$ locations have been moved toeward to about −1 mm. $CG_x$ locations will likely continue to be toeward, such as in the example $CG_x$ locations described in U.S. patent application Ser. No. 16/171,237, filed Oct. 25, 2018, which is incorporated herein by reference. For example, club head has a center of gravity (CG), the location of which may be defined in terms of the coordinate system described above and shown in FIGS. 1A, 1B and 1D, and in some embodiments, the club head has a $CG_x$ toeward of center face as, for example, no more than −2 mm toeward. In some embodiments the club head has a $CG_x$ of 0 to −4 mm. In some embodiments the club head has a moment of inertia about the z-axis ($I_{zz}$) of 480 to 600 Kg·mm$^2$ or in some embodiments greater than 490 Kg·mm$^2$, a moment of inertia about the x-axis ($I_{xx}$) of about 280 to 420 Kg·mm$^2$ or in some embodiments greater than 280 Kg·mm$^2$.

There are a variety of ways to position the CG orientations of the golf club head. For example, in some embodiments, a composite crown and/or sole is provided to help overcome manufacturing challenges associated with conventional golf club heads having normal continuous crowns made of titanium or other metals, and can replace a relatively heavy component of the crown with a lighter material, freeing up discretionary mass which can be strategically allocated elsewhere within the golf club head. In certain embodiments, the crown may comprise a composite material, such as those described herein and in the incorporated disclosures, having a density of less than 2 grams per cubic centimeter. In still further embodiments, the composite material has a density of no more than 1.5 grams per cubic centimeter, or a density between 1 gram per cubic centimeter and 2 grams per cubic centimeter. Providing a lighter crown further provides the golf club head with additional discretionary mass, which can be used elsewhere within the golf club head to serve the purposes of the designer. For example, with the discretionary mass, additional weight can be strategically added to the hollow interior of the golf club head, or strategically located on the exterior of the golf club head, to shift the effective CG fore or aft, toeward or heelward or both (apart from any further CG adjustments made possible by adjustable weight features), and/or to improve desirable MOI characteristics, as described above.

In some embodiments, the crown and/or sole may be formed in whole or in part from a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12/004,387, 11/960,609, 11/960,610, and 12/156,947, which are incorporated herein by reference.

Alternatively, the crown and/or sole may be formed from short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 Mpa) as measured by ASTM D 638; a Flexural Strength of 50000 psi (345 Mpa) as measured by ASTM D 790; and a Flexural Modulus of $2.60\times10^6$ psi (17927 Mpa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 Mpa as measured by ISO 527; a Tensile Elongation of 1.4% as measured by ISO 527; a Tensile Modulus of 41500 Mpa as measured by ISO 527; a Flexural Strength of 580 Mpa as measured by ISO 178; and a Flexural Modulus of 34500 Mpa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 Mpa as measured by ISO 527; a Tensile Elongation of 1.3% as measured by ISO 527; a Tensile Modulus of 28500 Mpa as measured by ISO 527; a Flexural Strength of 385 Mpa as measured by ISO 178; and a Flexural Modulus of 23,000 Mpa as measured by ISO 178.

In other embodiments, the crown and/or sole is formed as a two layered structure comprising an injection molded inner layer and an outer layer comprising a thermoplastic composite laminate. The injection molded inner layer may be prepared from the thermoplastic polymers, with preferred materials including a polyamide (PA), or thermoplastic urethane (TPU) or a polyphenylene sulfide (PPS). Typically the thermoplastic composite laminate structures used to prepare the outer layer are continuous fiber reinforced thermoplastic resins. The continuous fibers include glass fibers (both roving glass and filament glass) as well as aramid fibers and carbon fibers. The thermoplastic resins which are impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS).

The laminates may be formed in a continuous process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein.

The composite laminates structure of the outer layer may also be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 MPa as measured by ASTM D 638; a Tensile Modulus of 53 GPa as measured by ASTM D 638; a Flexural Strength of 760 MPa as measured by ASTM D 790; and a Flexural Modulus of 45 GPa) as measured by ASTM D 790.

Another preferred example is TEPEX® dynalite 208, a thermoplastic polyurethane (TPU)-based formulation with reinforcing carbon fiber, which has a density of 1.5 g/cm$^3$, a fiber content of, 45 vol %, a Tensile Strength of 710 MPa as measured by ASTM D 638; a Tensile Modulus of 48 GPa as measured by ASTM D 638; a Flexural Strength of 745 MPa as measured by ASTM D 790; and a Flexural Modulus of 41 GPa as measured by ASTM D 790.

Another preferred example is TEPEX® dynalite 207, a polyphenylene sulfide (PPS)-based formulation with reinforcing carbon fiber, which has a density of 1.6 g/cm$^3$, a fiber content of 45 vol %, a Tensile Strength of 710 MPa as measured by ASTM D 638; a Tensile Modulus of 55 GPa as measured by ASTM D 638; a Flexural Strength of 650 MPa as measured by ASTM D 790; and a Flexural Modulus of 40 GPa as measured by ASTM D 790.

There are various ways in which the multilayered composite crown may be formed. In some embodiments the outer layer, is formed separately and discretely from the forming of the injection molded inner layer. The outer layer may be formed using known techniques for shaping thermoplastic composite laminates into parts including but not limited to compression molding or rubber and matched metal press forming or diaphragm forming.

The inner layer may be injection molded using conventional techniques and secured to the outer crown layer by bonding methods known in the art including but not limited to adhesive bonding, including gluing, welding (preferable welding processes are ultrasonic welding, hot element welding, vibration welding, rotary friction welding or high frequency welding (Plastics Handbook, Vol. 3/4, pages 106-107, Carl Hanser Verlag Munich & Vienna 1998)) or calendaring or mechanical fastening including riveting, or threaded interactions.

Before the inner layer is secured to the outer layer, the outer surface of the inner layer and/or the inner of the outer layer may be pretreated by means of one or more of the following processes (disclosed in more detail in Ehrenstein, "Handbuch Kunststoff-Verbindungstechnik", Carl Hanser Verlag Munich 2004, pages 494-504):

- Mechanical treatment, preferably by brushing or grinding,
- Cleaning with liquids, preferably with aqueous solutions or organics solvents for removal of surface deposits
- Flame treatment, preferably with propane gas, natural gas, town gas or butane
- Corona treatment (potential-loaded atmospheric pressure plasma)
- Potential-free atmospheric pressure plasma treatment
- Low pressure plasma treatment (air and $O_2$ atmosphere)
- UV light treatment
- Chemical pretreatment, e.g. by wet chemistry by gas phase pretreatment
- Primers and coupling agents In an especially preferred method of preparation a so called hybrid molding process may be used in which the composite laminate outer layer is insert molded to the injection molded inner layer to provide additional strength. Typically the composite laminate structure is introduced into an injection mold as a heated flat sheet or, preferably, as a preformed part. During injection molding, the thermoplastic material of the inner layer is then molded to the inner surface of the composite laminate structure the materials fuse together to form the crown as a highly integrated part. Typically the injection molded inner layer is prepared from the same polymer family as the matrix material used in the formation of the composite laminate structures used to form the outer layer so as to ensure a good weld bond.

In addition to being formed in the desired shape for the aft body of the club head, a thermoplastic inner layer may also be formed with additional features including one or more stiffening ribs to impart strength and/or desirable acoustical properties as well as one or more weight ports to allow placement of additional tungsten (or other metal) weights.

The thickness of the inner layer is typically of from about 0.25 to about 2 mm, preferably of from about 0.5 to about 1.25 mm.

The thickness of the composite laminate structure used to form the outer layer, is typically of from about 0.25 to about 2 mm, preferably of from about 0.5 to about 1.25 mm, even more preferably from 0.5 to 1 mm.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell (or sole) may be made of a composite material, such as, for example, a carbon fiber reinforced epoxy, carbon fiber reinforced polymer, or a polymer. Furthermore, U.S. patent application Ser. No. 12/974,437 (now U.S. Pat. No. 8,608,591) describes golf club heads with lightweight crowns and soles.

Composite materials used to construct the crown and/or sole should exhibit high strength and rigidity over a broad temperature range as well as good wear and abrasion behavior and be resistant to stress cracking. Such properties include, a) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039);

b) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039);

c) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790);

d) a Flexural Modulus at room temperature of from about 0.4 Msi to about 21 Msi, from about 0.5 Msi to about 20 Msi, more preferably of from about 10 Msi to about 19 Msi (as measured by ASTM D 790);

Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. (FAW is the weight of the fiber portion of a given quantity of prepreg, in units of $g/m^2$.) FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 g/m$^2$ may be used. Generally, cost is the primary prohibitive factor in prepreg plies having FAW values below 70 g/m$^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Each of the golf club heads discussed throughout this application may include a separate crown, sole, and/or face that may be a composite, such as, for example, a carbon fiber reinforced epoxy, carbon fiber reinforced polymer, or a polymer crown, sole and/or face.

In some embodiments, the CGx, CGy and CGz orientations of the golf club head may be adjustable. For example, in an embodiment, the golf club head is provided with one or more adjustable weight features, such as weight ports, tracks, and/or slots in conjunction with one or more adjustable weights located in the weight port(s), track(s), and/or slot(s). For example, U.S. Pat. No. 9,868,036, which is incorporated herein by reference, describes weight tracks with slidable weights for adjusting the CG orientations of the golf club head. Other adjustable weight features may be used to adjust the CG orientations.

In some embodiments, the CGx, CGy and CGz orientations of the golf club head are positioned in conjunction with the aerodynamic properties of the golf club head. In some implementations, aerodynamic drag forces on the golf club head are reduced by the shape of the striking face. For example, aerodynamic drag forces can be reduced by providing a striking face that is shorter along the positive x-axis 208 projecting toward the heel side of the club head and taller on the negative x-axis 208 is projecting toward the toe side of the golf club head. In other words, the striking face may be provided with bulge oriented in the portion of the face in the negative x-axis. For example, as discussed below, the golf club head may have a crown height to face height ratio of at least 1.12. As a result of this configuration, more material and mass is provided along the negative x-axis of the striking face than along the positive x-axis, which may orient the CGx on the negative x-axis. This aerodynamic shape tends to move CGx toeward naturally.

In addition to the features described above, additional aerodynamic shapes are described in U.S. Pat. Nos. 8,858,359 and 9,861,864. For example, various properties may be modified to improve the aerodynamic aspects of the golf club head. In various embodiments, the volume of the golf club head may be 430 cc to 500 cc. In various embodiments, there may be no inversions, indentations, or concave shaping elements on the crown of the golf club head, and, as such, the crown remains convex over its body, although the curvature of the crown may be variable in various embodiments.

For example, in an embodiment, the golf club head a face height of about 59.1 mm and a crown height of about 69.4 mm. As can be seen, a ratio of the crown height to the face height is 69.4/59.1, or about 1.17. In other embodiments, the golf club head may have a crown height to face height ratio of at least 1.12. Other crown height to face height ratios may be used. For example, a face height of about 58.7 mm may be provided in an embodiment. The corresponding crown height is about 69.4 mm in the current embodiment. A ratio of the crown height to the face height is 69.4/58.7, or about 1.18. Alternatively, a face height of about 58.7 mm may be provided in another embodiment. The crown height is about 69.4 mm in the current embodiment. A ratio of the crown height to the face height is 69.4/58.7, or about 1.18. As such, the ratio of crown height to face height may be between about 1 and about 2, depending on the embodiment.

In another example, the golf club head may have may have a minimum and/or a maximum face area. For example, the larger the face area, the more drag is produced (i.e., lowers aerodynamic features of the golf club head. In addition to aerodynamic features, the minimum and/or maximum face areas may be dictated by other golf club head properties, such as mass savings and ball speed benefits. Accordingly, in one embodiment, the golf club head has a minimum face area of 3300 mm$^2$. In other embodiments, the golf club head has a face area between about 3700 mm$^2$ and about 4000 mm$^2$. In other embodiments, the golf club head has a face area between about 3500 mm$^2$ and about 4200 mm$^2$. In yet another embodiment, the golf club head has a maximum face area of about 4500 mm$^2$. Other face areas may be used.

In some implementations, discretionary mass is strategically positioned at an angle with respect to the striking face 110, such as in the same plane as the golf club head as the club is designed to travel on the downswing. In some embodiments, the discretionary mass is strategically provided low (along the negative z-axis), rearward (along the positive y-axis 209), and toeward (along the negative x-axis 208), orienting the mass in the location where air is flowing, thereby reducing aerodynamic drag forces and orienting CGx on the negative x-axis.

Examples of strategically positioned discretionary masses are described in U.S. provisional patent application Ser. No. 62/755,319, which is incorporated herein by reference. For example, as illustrated in FIGS. 12, 13, 14A, 15-19, golf club head 300 comprises an inertia generator 360, which may comprise an elongate center sole portion 362 that extends in a generally Y-direction—though as illustrated, and as further described below, is also angled toewardly—from a position proximate the golf club head center of gravity 350 to the rear portion of the body.

In one or more embodiments, golf club head 300 includes a hollow body 310 defining a crown portion 312, a sole portion 314, a skirt portion 316, and a striking surface 318. The striking surface 318 can be integrally formed with the body 310 or attached to the body. The body 310 further includes a hosel 320, which defines a hosel bore 324 adapted to receive a golf club shaft. The body 310 further includes a heel portion 326, a toe portion 328, a front portion 330, and a rear portion 332. Included are a number of features that may improve playability, including at least an inertia generator 360, front channel 390, a slot or channel insert 395, one or more front channel support ribs 396, an additional rib 397 that connects to front channel support ribs 396, as well as composite panels on the sole 344, 348 and on the crown 335, along with discretionary mass elements and other additional features, as will be further described herein. The front channel 390 may have a certain length L (which may be measured as the distance between its toeward end and heelward end), width W (e.g., the measurement from a forward edge to a rearward edge of the front channel 390), and offset distance OS from the front end, or striking surface 318 (e.g., the distance between the face 318 and the forward edge of front channel 390. During development, it was discovered that the COR feature length L and the offset distance OS from the face play an important role in managing the stress which impacts durability, the sound or first mode frequency of the club head, and the COR value of the club head. All of these parameters play an important role in the overall club head performance and user perception.

Figure 12:
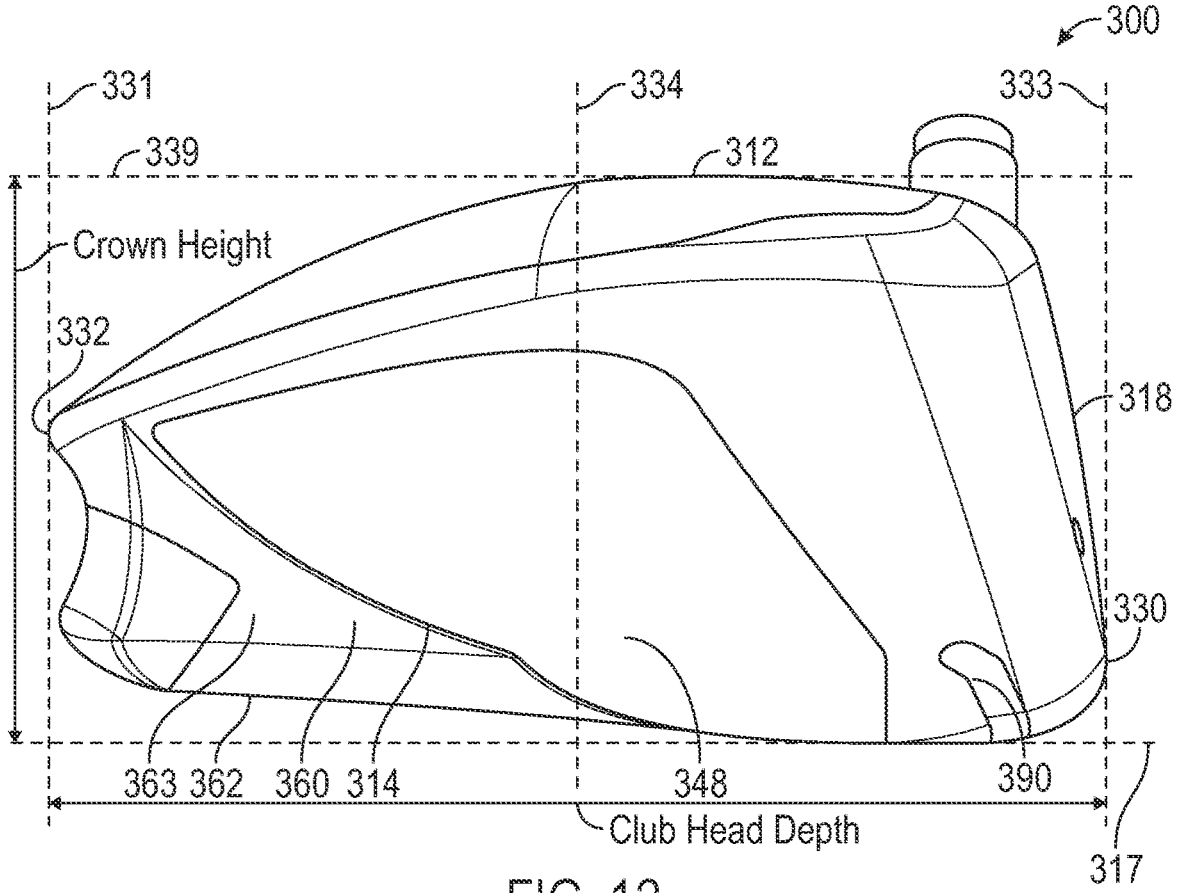
FIG. 12 is a side elevation view from a toe side of a golf club head in accord with one embodiment of the current disclosure.
Figure 13:
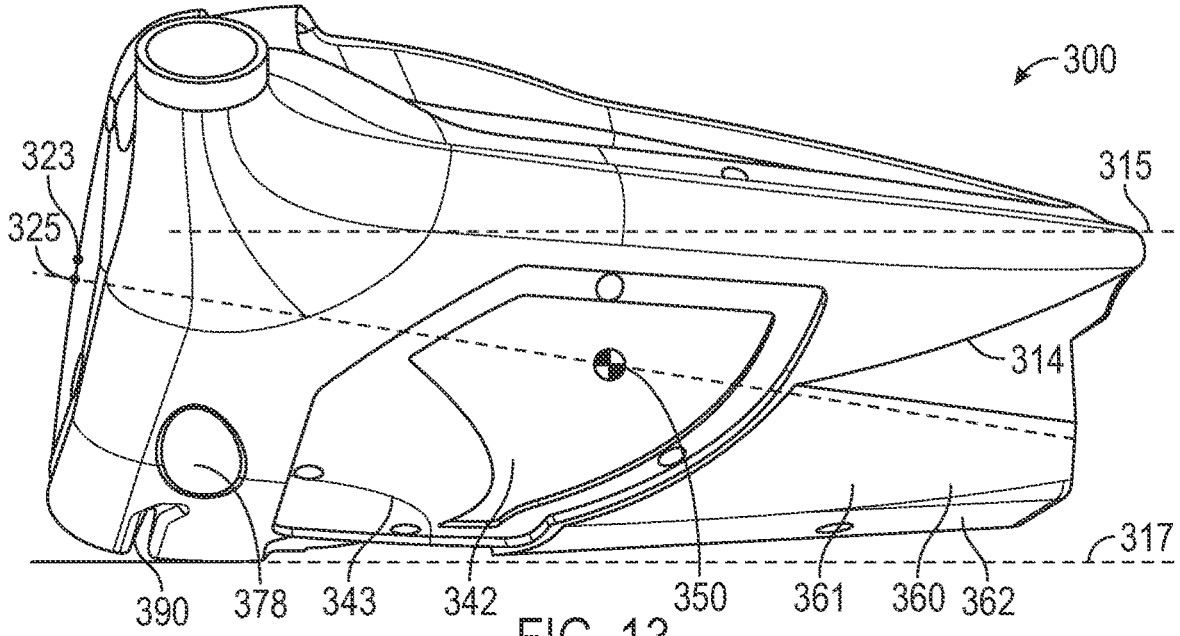
FIG. 13 is a side elevation view from a heel side of a golf club head in accord with one embodiment of the current disclosure, with sole and crown inserts removed.

A front plane 331 that extends from a forwardmost point of the golf club head, and a rear plane 333 that extends from a rearwardmost point of the golf club head. Each of these planes extends from its respective point and is perpendicular to the ground plane 317. Together, the planes may be used to measure the front to back depth of the golf club head ("club head depth"), as illustrated in FIG. 12. A midpoint plane 334 extends perpendicular to the ground plane 317 halfway between the front plane 331 and the rear plane 333. As illustrated in FIG. 13, a center 323 is disposed on the striking surface 318. Also shown on the face is the projected CG point 325. Golf club head 300 also has a skirt height 315, which may measure the lowest point above the ground plane at which the skirt meets the crown. In some embodiments, the skirt height 315 may be between 25 mm and 40 mm, such as between 30 mm and 40 mm, or between 30 mm and 35 mm.

Figure 14A:
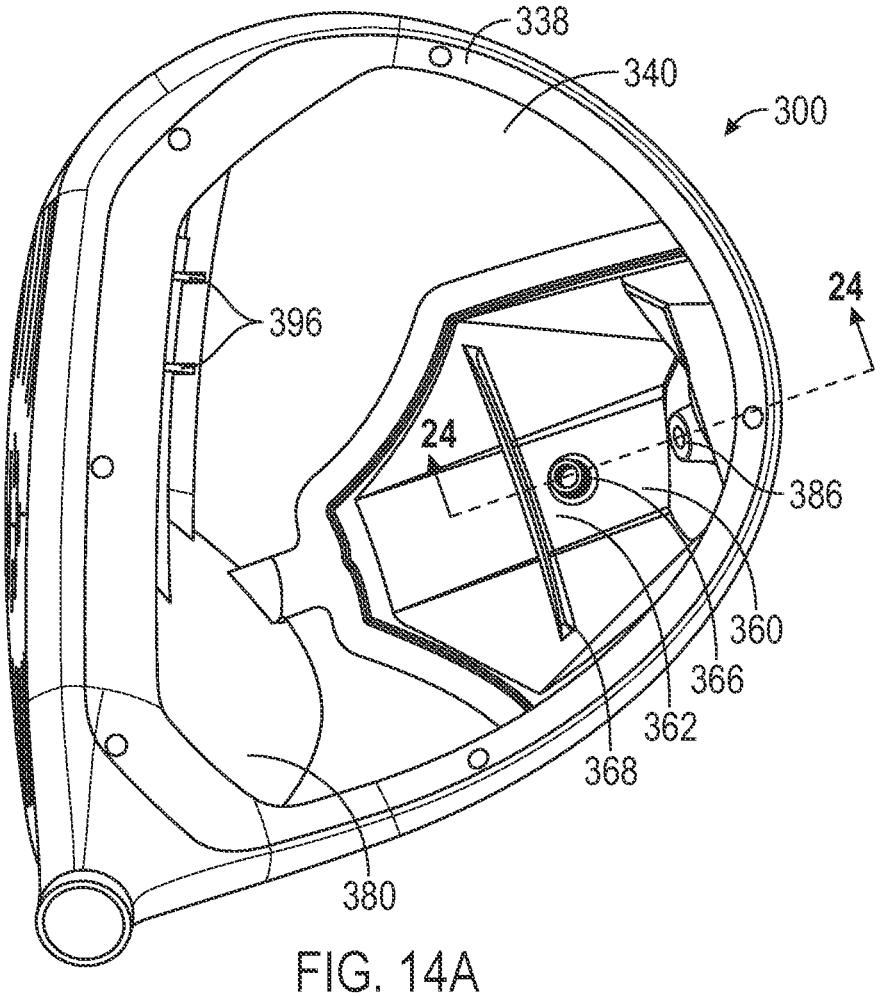
FIG. 14A is a top view of a golf club head in accord with one embodiment of the current disclosure, with a crown insert removed.
Figure 14B:
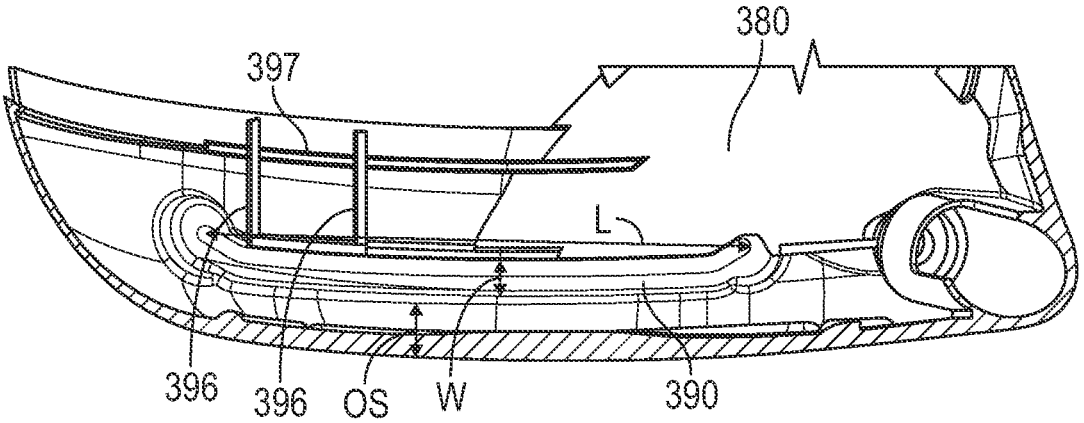
FIG. 14B is a top cross-sectional view of a front portion of a golf club head in accord with one embodiment of the current disclosure.
Figure 15:
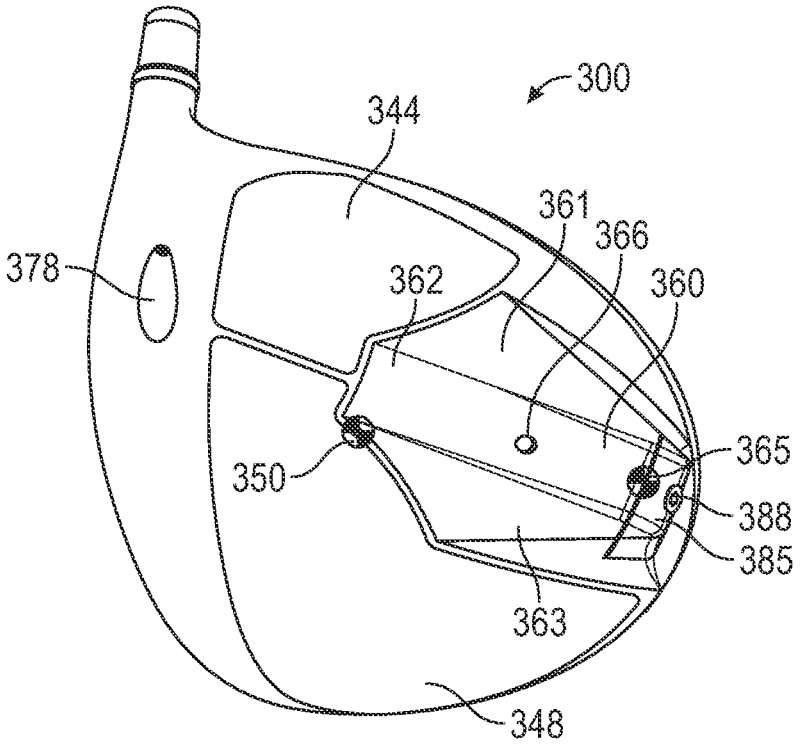
FIG. 15 is a bottom perspective view of a golf club head in accord with one embodiment of the current disclosure.
Figure 16:
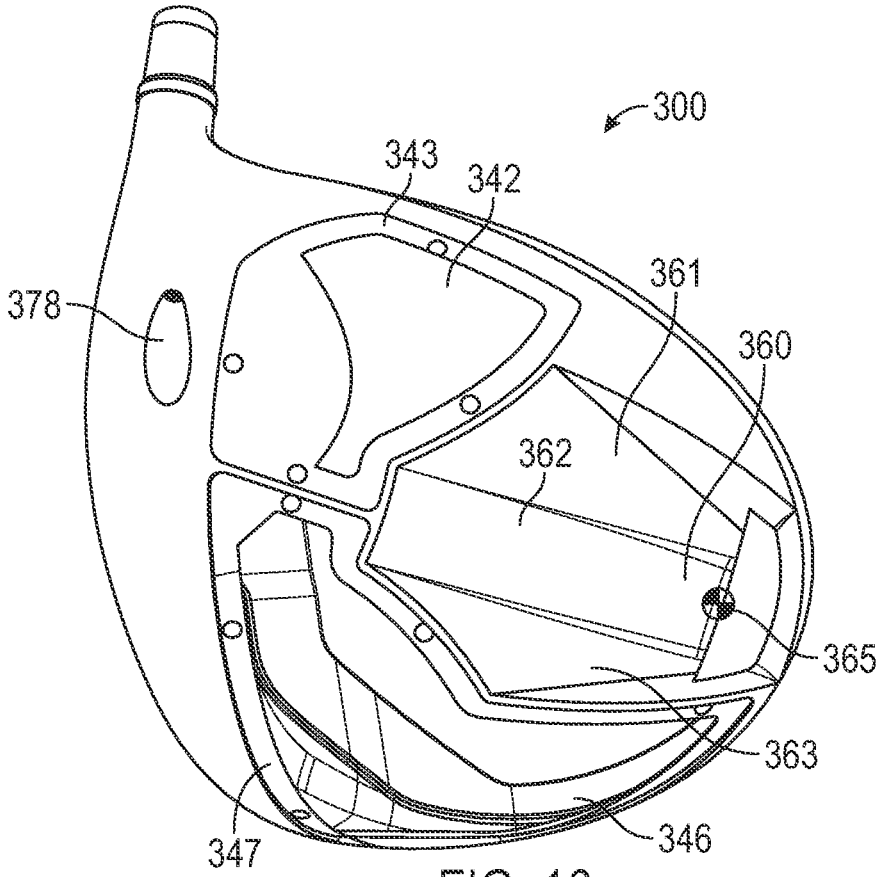
FIG. 16 is a bottom perspective view of a golf club head in accord with one embodiment of the current disclosure, with two sole inserts removed.

As best illustrated in FIGS. 12 and 13, the center sole portion 362 comprises an elongate and substantially planar surface that is closer to the ground plane 317 than the surrounding portions of the sole 314 that are toeward and heelward of the inertia generator 360. In certain embodiments, the inertia generator 360 is angled so that a rear end of the inertia generator is toeward of a front end. An angle of the inertia generator relative to the y-axis may be in the range of 10 to 25 degrees, such as between 15 and 25 degrees, such as between 17 and 22 degrees. As illustrated in FIGS. 14A and 15, an aperture 366 may be provided within the center sole portion 362, which aperture may be used for introducing hot melt into the inner cavity of the golf club head. Also provided is an inertia generator support rib 368, which may run along the inside of the golf club head under inertia generator 360. A cross-section of the inertia generator may be taken along line 24-24. Inertia generator support rib 368 may not only help provide structural support for the inertia generator, it may also help constrain any hot melt that is injected using aperture 366.

As best illustrated in FIGS. 12 and 15, the inertia generator further comprises a heelward sole surface 361 and a toeward sole surface 363 that slope upwardly from the center sole portion 362 to the sole 314 when viewed in the normal address position. The heelward sole surface 361 may have a generally triangular shape, with: a base that faces generally forward and heelward (and may be substantially parallel to the heel sole insert 344, a first edge adjacent the center sole portion 362 that extends rearwardly from the toeward end of the base generally parallel to the center sole portion, and a second edge that extends from the heelward end of the base at a position on the sole 314 to a position that is "raised up" from the sole at or proximate to the heelward side of the center sole portion 362 at the rear 332 of the golf club head. The toeward sole surface 363 may likewise have a generally triangular shape, with: a base that faces generally forward and toeward (and may be substantially parallel to the toe sole insert 348, a first edge adjacent the center sole portion 362 that extends rearwardly from the heelward end of the base generally parallel to the center sole portion, and a second edge that extends from the toeward end of the base at a position on the sole 314 to a position that is "raised up" from the sole at or proximate to the toeward side of the center sole portion 362 at the rear 332 of the golf club head. The inertia generator is configured so that a center of gravity 365 may in certain embodiments be positioned toeward of the x axis and lower (or closer to the ground plane 317) than the z-axis. In other words, the inertia generator may help to move the club's overall center of gravity 350 toeward, while also lowering its center of gravity, reducing Zup, as described above.

Example values for the inertia generator's center of gravity 365 are set forth below. In certain embodiments, the inertia generator may have a center of gravity 365 relative to the center 323 of the striking surface 318 as measured on the:

x-axis ($CG_x$) of between −10 mm and −25 mm, such as between −15 mm and −20 mm;

y-axis ($CG_y$) of between 80 and 110 mm, such as between 90 and 100 mm; and z-axis ($CG_z$) of between 0 and −20 mm, such as between −10 mm and −20 mm.

Additionally, due to its shape and orientation, the inertia generator is configured to generally align with a typical swing path, permitting increased inertia generated during a golf swing. Example moments of inertia for golf club head 300 are set forth below.

As best illustrated in FIG. 14A, the crown can be formed to have a recessed peripheral ledge or seat 338 to receive the crown insert 335, such that the crown insert is either flush with the adjacent surfaces of the body to provide a smooth seamless outer surface or, alternatively, slightly recessed below the body surfaces. The crown insert 335 may cover a large opening 340 (illustrated in FIG. 14A) at the top and rear of the body, forming part of the crown 312 of the golf club head. Heel sole insert 344 and toe sole insert 348 may be secured to the body 310 to cover heel sole opening 342 and toe sole opening 346, respectively, in the sole rearward of the hosel (illustrated in FIG. 16). Heel sole opening 342 has a heel sole ledge 343 for supporting heel sole insert 344. Similarly, toe sole opening 346 has a toe sole ledge 347 for supporting toe sole insert 348. The golf club head may comprise a forward mass pad 380 positioned heelward and forward on the sole 314.

As best illustrated in FIG. 15, a plurality of characteristic time ("CT") tuning screws 375 may be inserted through apertures 374 in the striking surface. Dampening material such as tuning foam 376 may be inserted through one or both of these apertures into the inner cavity 394 of the golf club head 300 to adjust the characteristic time. For example, a dampening material may be added that, upon hardening, may lower the CT time. Additional details about providing tuning of the characteristic time are provided in U.S. patent application Ser. No. 15/857,407, filed Dec. 28, 2017, the entire contents are hereby incorporated by reference herein.

Positioned on a rear side of the inertia generator 360 is inertia generator mass element 385, which may comprise a steel or tungsten weight member or other suitable material. Inertia generator mass element 385 may be removably affixed to the rear of the inertia generator 360 using a fastener port 386 that is positioned in the rear of the inertia generator 360 and configured to receive a fastener 388, which may be removably inserted through an aperture 387 in the inertia generator mass element 385 and into the fastener port 386. Fastener port 386 and aperture 387 may be threaded so that fastener 388 can be loosened or tightened either to allow movement of, or to secure in position, inertia generator mass element 385. The fastener may comprise a head with which a tool (not shown) may be used to tighten or loosen the fastener, and a body that may, e.g., be threaded to interact with corresponding threads on the fastener port 386 and aperture 387 to facilitate tightening or loosening the fastener 388.

The fastener port 386 can have any of a number of various configurations to receive and/or retain any of a number of fasteners, which may comprise simple threaded fasteners, such as described herein, or which may comprise removable weights or weight assemblies, such as described in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference herein.

Figure 17:
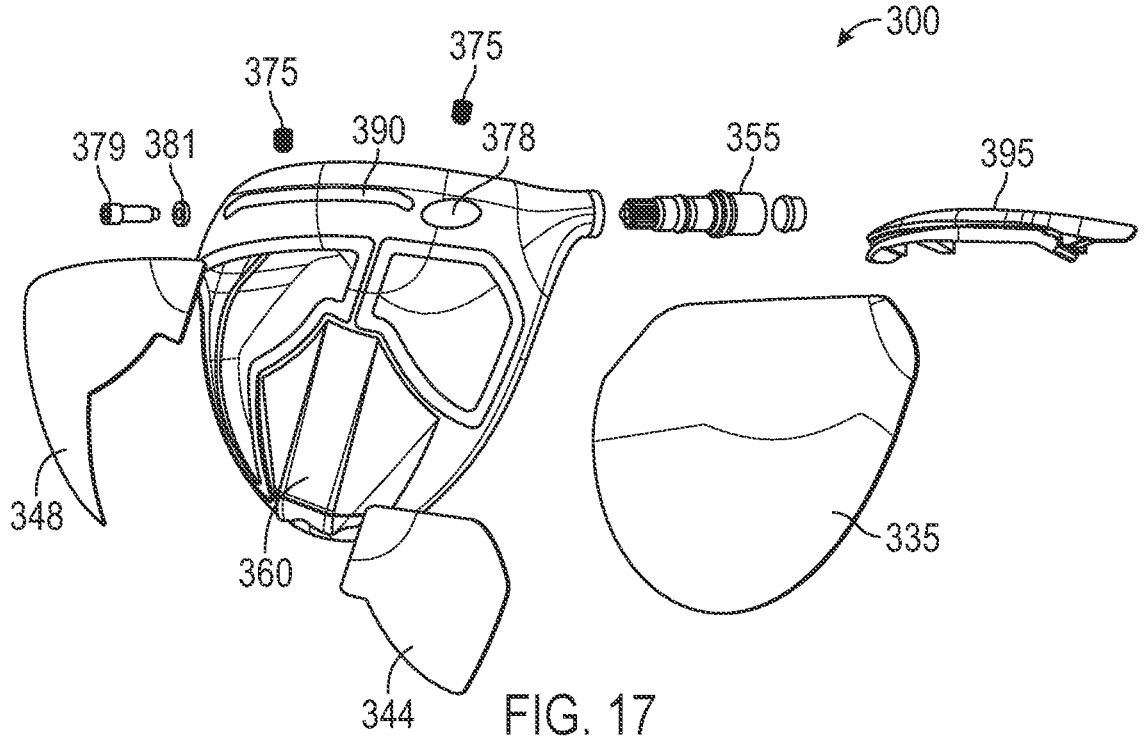
FIG. 17 is an exploded perspective view of a golf club head in accord with one embodiment of the current disclosure.
Figure 18:
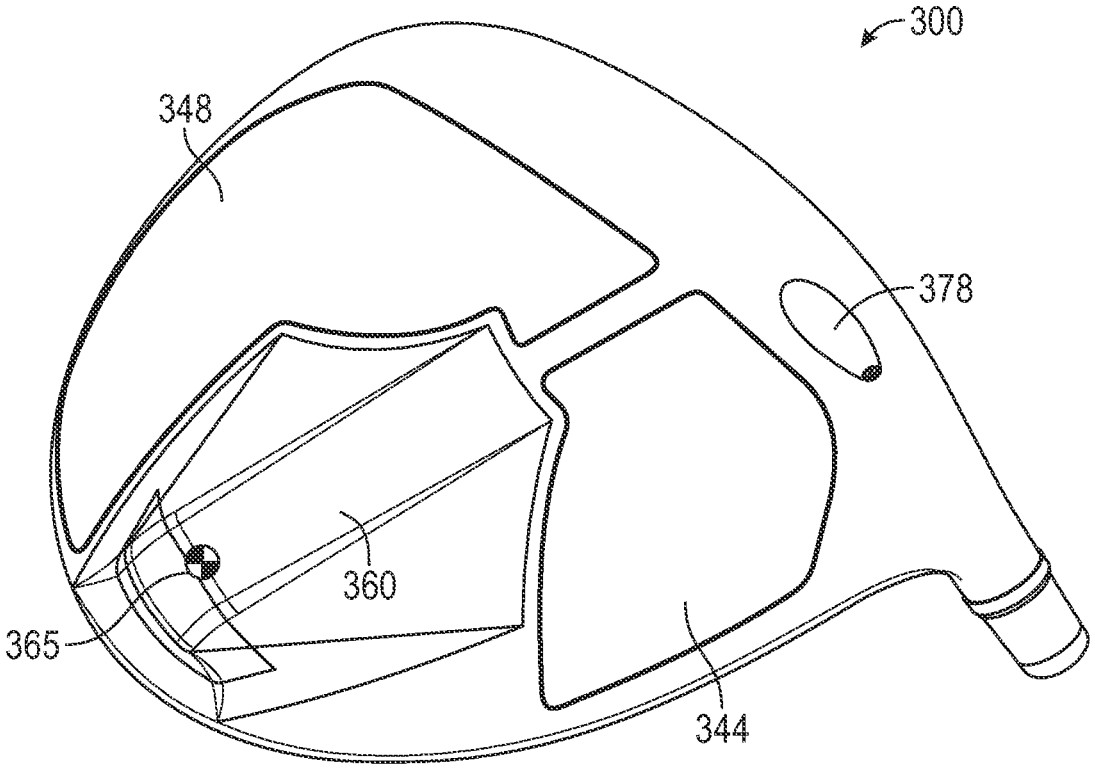
FIG. 18 is a bottom perspective view from a heel side of a golf club head in accord with one embodiment of the current disclosure.

As illustrated in FIG. 17, the golf club head's hosel 320 has a hosel bore 324 that may accommodate a shaft connection assembly 355 that allows the shaft to be easily disconnected from the golf club head, and that may provide the ability for the user to selectively adjust a and/or lie-angle of the golf club. The shaft connection assembly 355 may comprise a shaft sleeve that can be mounted on the lower end portion of a shaft (not pictured), as described in U.S. Pat. No. 8,303,431. A recessed port 378 is provided on the sole 314, and extends from the sole 314 toward the hosel 320, and in particular the hosel bore 324. The hosel bore 324 extends from the hosel 320 through the golf club head 310 and opens within the recessed port 378 at the sole 314 of the golf club head 300. The hosel bore may contain threads that are configured to interact with a fastener such as a screw. The golf club head is removably attached to the shaft by shaft connection assembly 355 (which is mounted to the lower end portion of a golf club shaft (not shown)) by inserting one end of the shaft connection assembly 355 into the hosel bore 324, and inserting a screw 379 (or other suitable fixation device) upwardly through the recessed port 378 in the sole 314 and, in the illustrated embodiment, tightening the screw 379 into a threaded opening of the shaft connection assembly 355, thereby securing the golf club head to the shaft sleeve 302. A screw capturing device, such as in the form of an O-ring or washer 381, can be placed on the shaft of the screw 379 to retain the screw in place within the golf club head when the screw is loosened to permit removal of the shaft from the golf club head.

Figure 19:
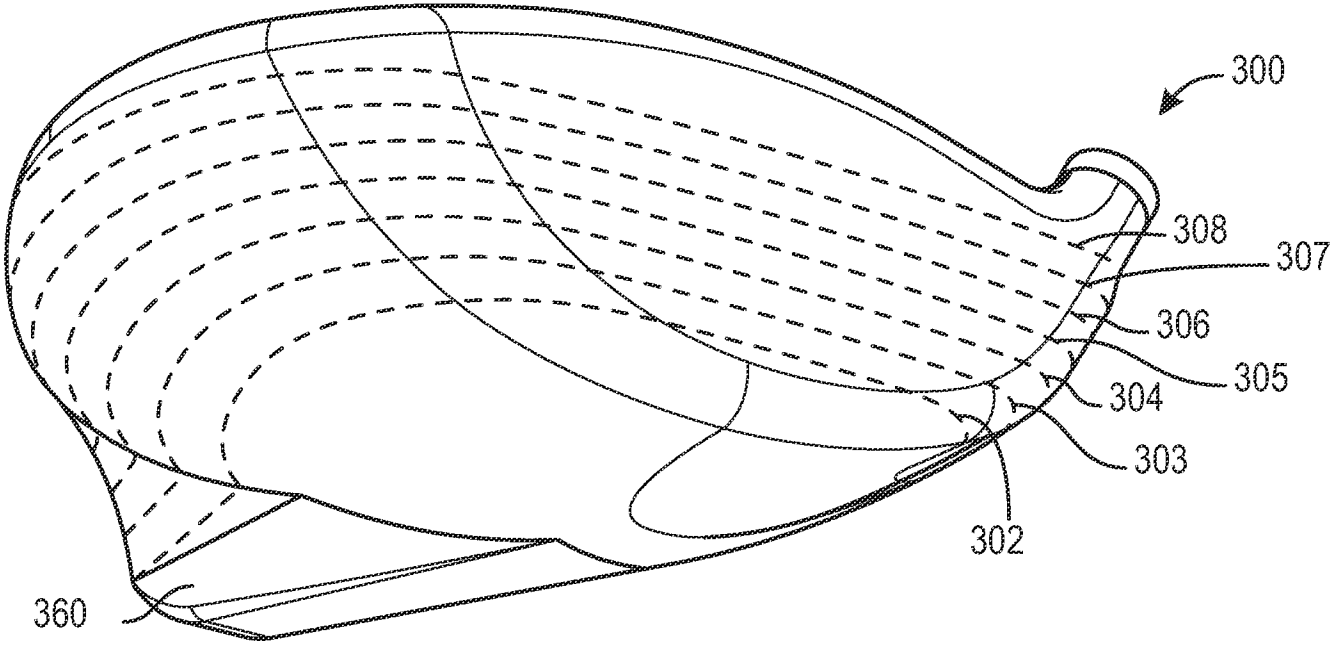
FIG. 19 is a perspective view from a toe side of a golf club head in accord with one embodiment of the current disclosure, providing elevation markers on the golf club head at various heights relative to a ground plane.

Illustrated in FIG. 19 are dashed lines surrounding golf club head 300. Each of these dashed lines represents a fixed distance above a ground plane when golf club head 300 is in normal address position, so that a cross-section of the golf club head taken at one of the respective lines would be positioned at a consistent height above the ground plane. For example, 10 mm cross-section line 302 represents the cross-section of golf club head 300 at a position 10 mm above the ground plane. In turn:

15 mm cross-section line 303 represents the cross-section of golf club head 300 at a position 15 mm above the ground plane;

20 mm cross-section line 304 represents the cross-section of golf club head 300 at a position 20 mm above the ground plane;

25 mm cross-section line 305 represents the cross-section of golf club head 300 at a position 25 mm above the ground plane;

30 mm cross-section line 306 represents the cross-section of golf club head 300 at a position 30 mm above the ground plane;

35 mm cross-section line 307 represents the cross-section of golf club head 300 at a position 35 mm above the ground plane; and 40 mm cross-section line 308 represents the cross-section of golf club head 300 at a position 40 mm above the ground plane.

As discussed above, the CGx orientation of the golf club head may be moved toeward (along the negative x-axis) or heelward (along the positive x-axis) to provide to generate specific properties of the golf club head, such as increasing MOI, increasing ball speed and reducing "gear effect." However, orientating the CGx toeward may result in the striking face of the golf club head remaining open at impact with the golf ball. In this example, when the CGx is oriented along the negative x-axis, it may be more difficult for the user to square (e.g., release) the club head in the downswing, resulting in users hitting the ball right (i.e., a "slice" or "blocked" shot). Conversely, when the orientating the CGx heelward may result in the striking face of the golf club head to be closed at impact with the golf ball. In this example, when the CGx is oriented along the positive x-axis, the club head may release early, making it more difficult for the user to keep the striking face from closing too quickly in the downswing, resulting in the user hitting the ball left (i.e., a "hook" or "pulled" shot). To overcome the missed shots resulting from the negative or positive CGx orientations, visual cues may be provided to offset the CGx orientation (i.e., altering the perceived angle of the face 110 for the user), allowing the user to hit the ball straighter with fewer misses.

As discussed above, in some embodiments, one or more features of the golf club head may be provided to alter the perceived angle of the face for the user. For example, referring back to FIG. 3, the golf club head 600 includes an alignment feature to alter the perceived angle of the face 110 for the user. In implementations with a negative CGx orientation, an alignment feature is provided to alter the perceived top line relative to striking face, with the perceived top line appearing to be square while the actual face angle is closed relative to the perceived top line. By closing the actual face angle relative to the perceived top line, the user counteracts the miss right by closing the club head in the downswing to square the striking face at impact with the golf ball. Conversely, in implementations with a positive CGx orientation, a different alignment feature is provided to alter the perceived top line relative to striking face, with the perceived top line appearing to be square while the actual face angle is open relative to the perceived top line. By opening the actual face angle relative to the perceived top line, the user counteracts the miss left by opening the club head in the downswing to square the striking face at impact with the golf ball.

For example, the alignment feature may be provided as a contrasting paint or shading of the crown 120 relative to the color or shading of the face 110. In this example, users tend to focus on the perceived top line produced by the contrasting paint, such as via white or another color paint contrasting with the metal striking face, even when the actual face angle is visible to the user. The user tends to ignore the actual face angle when contrasting paint of shading is provided. Further, the alignment feature may also provide for unconscious correction during the swing. Specifically, by perceiving the club to be square when the actual face angle is closed or open relative to the perceived top line, the user will naturally and unconsciously attempt to square the perceived top line at impact with the golf ball, correcting for the misses caused by the CGx orientation.

In some implementations, the alignment feature may alter the perceived top line from about 2 to about 4 degrees open or closed relative to the actual face angle. In some implementations, for each 5 percent change in negative or positive CGx orientation, the perceived top line is 1 degree open or closed, respectively, with respect to the actual face angle (i.e., opening or closing the perceived top line relative to the actual face angle), causing the user to close or open the actual face angle at the address position. Depending on the golf club, each degree of perceived top line change may affect lateral dispersion in a resultant shot by a set amount. For example, changing the perceived top line of a driver by one degree may reduce dispersion by approximately five yards. In another example, changing the perceived top line of a fairway wood by one degree may reduce dispersion by approximately three yards.

In some implementations, the alignment feature may be provided as a parabola defined relative to the striking face. For example, a point on parabola relative to the striking face is provided from about 2 to about 4 degrees open or closed relative to the angle of the striking face. Depending on the golf club, the radius of the alignment feature may affect lateral dispersion in a resultant shot by a set amount. For example, changing the radius of the parabola defining the topline of a driver by one degree may reduce dispersion by approximately five yards. In another example, changing the radius of the parabola defining the topline of a fairway wood by one degree may reduce dispersion by approximately three yards.

In some embodiments, grooves and/or score lines of the golf club head may be provided to alter the address position for the user, aligning the address position with the CG orientations. Referring back to FIG. 1B, grooves and/or score lines are located on the striking face 110, traditionally positioned at the center of face (CF) located at the origin 205 of the coordinate system 200. Orientating the CGx along the positive or negative x-axis, without moving scorelines from the CF, may cause the user to address the golf club head to the golf ball without aligning the CGx with the golf ball. If the user does not align the golf ball with the CGx, the user may strike the golf ball at a location on the striking face that does not correspond with the CGx location, decreasing ball speed and the accuracy of the golf shot. For example, for a positive CGx, striking the club at the CF does not correspond with the positive CGx orientation. Further, if the user strikes the ball at a location on the striking face corresponding to the positive CGx (i.e., toewardly of the score lines provided at CF), the user may believe that the shot was mishit, resulting in the user misaligning future shots. In some implementations, score lines and/or grooves are provided offset from CF at a location on the striking face corresponding the CGx, CGy and CGz orientations. The score lines and grooves also serve as an alignment aid at address. For example, in the example of a negative CGx, the score lines and/or grooves are positioned toewardly of CF to encourage the user to address and strike the ball more toewardly (i.e., aligned with the negative CGx). In this example, the score lines and/or grooves are positioned toeward of a geometric center of the face. Thus, the score lines and/or grooves are aligned for maximum performance (i.e., maximum ball speed, reducing gear effect, reducing dispersion, and the like).

Further, golf club designs are provided to counteract the left and right tendency that a player encounters when the ball impacts a high, low, heelward and/or toeward position on the club head striking face. One such golf club design incorporates a "twisted" bulge and roll contour, such as discussed in U.S. Pat. Nos. 9,814,944 and 10,265,586 and U.S. Patent Pub. No. 2019/0076705, which are incorporated herein by reference in their entireties.

Figure 20A:
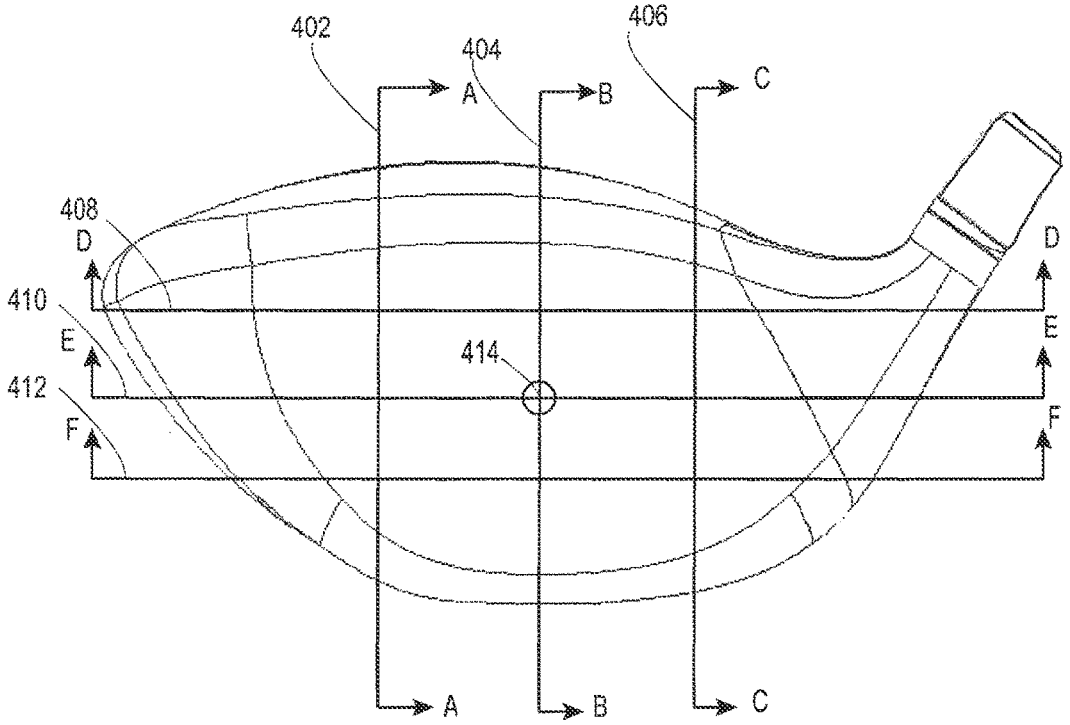
FIG. 20*a* is a front elevation view of a golf club according to an embodiment.

FIG. 20*a* illustrates a plurality of vertical planes 402,404, 406 and horizontal planes 408,410,412. More specifically, the toe side vertical plane 402, center vertical plane 404 (passing through center face), and heel vertical plane 406 are separated by a distance of 30 mm as measured from the center face location 414. The upper horizontal plane 408, the center horizontal plane 410 (passing through center face 414), and the lower horizontal plane 412 are spaced from each other by 15 mm as measured from the center face location 414.

Figure 20B:
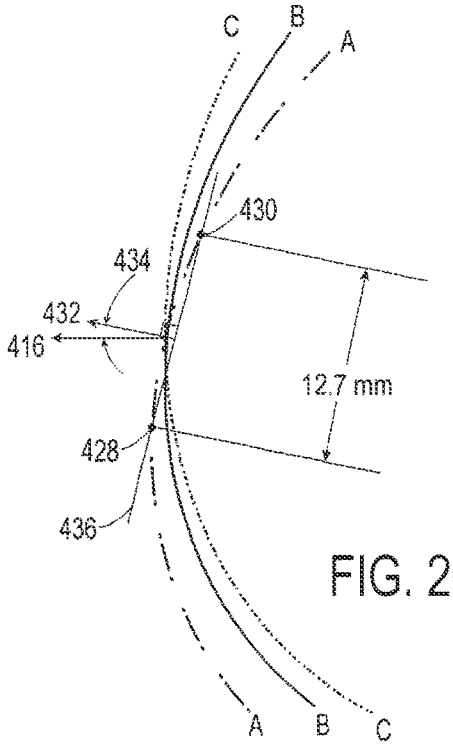
FIG. 20*b* is an exaggerated comparative view of face surface contours taken along section lines A-A, B-B, and C-C of FIG. 20*a*, as seen from a heel view.

FIG. 20*b* illustrates all three striking face surface roll contours A, B, C that are overlaid on top of one another as viewed from the heel side of the golf club. The three face surface contours are defined as face contours that intersect the three vertical planes 402,404, 406. Specifically, toe side contour A, represented by a dashed line, is defined by the intersection of the striking face surface and vertical plane 402 located on the toe side of the striking face. Center face vertical contour B, represented by a solid line, is defined by the intersection of the striking face surface and center face vertical plane 404 located at the center of the striking face. Heel side contour C, represented by a finely dashed line, is defined by the intersection of the striking face surface a vertical plane 406 located on the heel side of the striking face. Roll contours A, B, C are considered three different roll contours across the striking face taken at three different locations to show the variability of roll across the face. The toe side vertical contour A is more lofted (having positive LA°Δ) relative to the center face vertical contour B. The heel side vertical contour C is less lofted (having a negative LA°Δ) relative to the center face vertical contour B.

FIG. 20*b* shows a loft angle change 434 that is measured between a center face vector 416 located at the center face 414 and the toe side roll curvature A having a face angle vector 432. The vertical pin distance of 12.7 mm is measured along the toe side roll curvature A from a center location to a crown side and a sole side to locate a crown side measurement 430 point and sole side measurement points 428. A segment line 436 connects the two points of measurement. A loft angle vector 432 is perpendicular to the segment line 436. The loft angle vector 432 creates a loft angle 434 with the center face vector 416 located at the center face point 414. As described, a more lofted angle indicates that the loft angle change (LA°Δ) is positive relative to the center face vector 416 and points above or higher relative to the center face vector 416 as is the case for the roll curvature A.

Figure 20C:
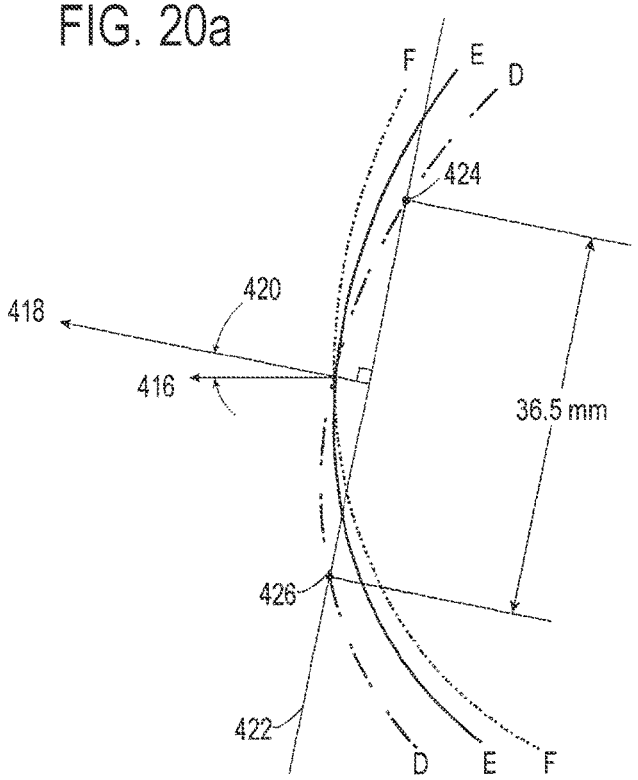
FIG. 20*c* is an exaggerated comparative view of face surface contours taken along section lines D-D, E-E, and F-F of FIG. 20*a*, as seen from a top view.

FIG. 20*c* further illustrates three striking face surface bulge contours D, E, F that are overlaid on top of one another as viewed from the crown side of the golf club. The three face surface contours are defined as face contours that intersect the three horizontal planes 408,410, 412. Specifically, crown side contour D, represented by a dashed line, is defined by the intersection of the striking face surface and upper horizontal plane 408 located on the upper side of the striking face toward the crown portion. Center face contour E, represented by a solid line, is defined by the intersection of the striking face surface and horizontal plane 408 located at the center of the striking face. Sole side contour F, represented by a finely dashed line, is defined by the intersection of the striking face surface a horizontal plane 412 located on the lower side of the striking face. Bulge contours D, E, F are considered three different bulge contours across the striking face taken at three different locations to show the variability of bulge across the face. The crown side bulge contour D is more open (having a positive FA°Δ, defined below) when compared to the center face bulge contour E. The sole side bulge contour F is more closed (having a negative FA°Δ when measured about the center vertical plane).

With the type of "twisted" bulge and roll contour defined above, a ball that is struck in the upper portion of the face will be influenced by horizontal contour D. A typical shot having an impact in the upper portion of a club face will influence the golf ball to land left of the intended target. However, when a ball impacts the "twisted" face contour described above, horizontal contour D provides a general curvature that points to the right to counter the left tendency of a typical upper face shot.

Likewise, a typical shot having an impact location on the lower portion of the club face will land typically land to the right of the intended target. However, when a ball impacts the "twisted" face contour described above, horizontal contour F provides a general curvature that points to the left to counter the right tendency of a typical lower face shot. It is understood that the contours illustrated in FIGS. 20*b* and 20*c* are severely distorted in order for explanation purposes.

In order to determine whether a 2-D contour, such as A, B, C, D, E, or F, is pointing left, right, up, or down, two measurement points along the contour can be located 18.25 mm from a center location or 36.5 mm from each other. A first imaginary line can be drawn between the two measurement points. Finally, a second imaginary line perpendicular to the first imaginary line can be drawn. The angle between the second imaginary line of a contour relative to a line perpendicular to the center face location provides an indication of how open or closed a contour is relative to a center face contour. Of course, the above method can be implemented in measuring the direction of a localized curvature provided in a CAD software platform in a 3D or 2D model, having a similar outcome. Alternatively, the striking surface of an actual golf club can be laser scanned or profiled to retrieve the 2D or 3D contour before implementing the above measurement method. Examples of laser scanning devices that may be used are the GOM Atos Core 185 or the Faro Edge Scan Arm HD. In the event that the laser scanning or CAD methods are not available or unreliable, the face angle and the loft of a specific point can be measured using a "black gauge" made by Golf Instruments Co. located in Oceanside, Calif. An example of the type of gauge that can be used is the M-310 or the digital-manual combination C-510 which provides a block with four pins for centering about a desired measurement point. The horizontal distance between pins is 36.5 mm while the vertical distance between the pins is 12.7 mm.

When an operator is measuring a golf club with a black gauge for loft at a desired measurement point, two vertical pins (out of the four) are used to measure the loft about the desired point that is equidistant between the two vertical pins that locate two vertical points. When measuring a golf club with a black gauge for face angle at a desired measurement point, two horizontal pins (out of the four) are used to measure the face angle about the desired point. The desired point is equidistant between the two horizontal points located by the pins when measuring face angle.

FIG. 20*c* shows a face angle 420 that is measured between a center face vector 416 located at the center face 414 and the crown side bulge curvature D having a face angle vector 418. The horizontal pin distance of 18.25 mm is measured along the crown side bulge curvature D from a center location to a heel side and a toe side to locate a heel side measurement 426 point and toe side measurement points 424. A segment line 422 connects the two points of measurement. A face angle vector 418 is perpendicular to the segment line 422. The face angle vector 418 creates a face angle 420 with the center face vector 416 located at the center face point 414. As described, an open face angle indicates that the face angle change (FA°Δ) is positive relative to the center face vector 416 and points to the right as is the case for the bulge curvature D.

Figure 21:
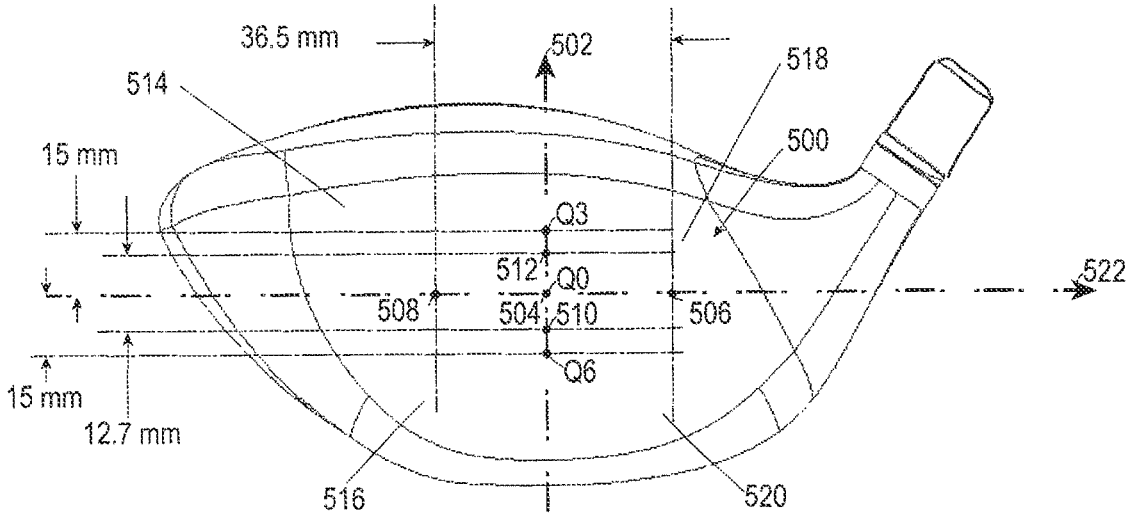
FIG. 21 is a front view of a golf club face with multiple measurement points and four quadrants.

FIG. 21 shows a desired measurement point Q0 located at the center of the striking face 500. A horizontal plane 522 and a vertical plane 502 intersect at the desired measurement point Q0 and divide the striking face 500 into four quadrants. The upper toe quadrant 514, the upper heel quadrant 518, the lower heel quadrant 520, and the lower toe quadrant 516 all form the striking face 500, collectively. In one embodiment, the upper toe quadrant 514 is more "open" than all the other quadrants. In other words, the upper toe quadrant 514 has a face angle pointing to the right, in the aggregate. In other words, if a plurality of evenly spaced points (for example a grid with measurement points being spaced from one another by 5 mm) covering the entire upper toe quadrant 514 were measured, it would have an average face angle that points right of the intended target more than any other quadrant.

The term "open" is defined as having a face angle generally pointing to the right of an intended target at address, while the term "closed" is defined as having a face angle generally pointing to the left of an intended target ad address. In one embodiment, the lower heel quadrant 520 is more "closed" than all the other quadrants, meaning it has a face angle, in the aggregate, that is pointing more left than any of the other quadrants.

If the edge of the striking surface 500 is not visually clear, the edge of the striking face 500 is defined as a point at which the striking surface radius becomes less than 127 mm. If the radius is not easily computed within a computer modeling program, three points that are 0.1 mm apart can be used as the three points used for determining the striking surface radius. A series of points will define the outer perimeter of the striking face 500. Alternatively, if a radius is not easily obtainable in a computer model, a 127 mm curvature gauge can be used to detect the edge of the face of an actual golf club head. The curvature gauge would be rotated about a center face point to determine the face edge.

In one illustrative example in FIG. 21, the face angle and loft are measured for a center face point Q0 when an easily measureable computer model method is not available, for example, when an actual golf club head is measured. A black gauge is utilized to measure the face angle by selecting two horizontal points 506,508 along the horizontal plane 522 that are 36.5 mm apart and centered about the center face point Q0 so that the horizontal points 506,508 are equidistant from the center face point Q0. The two pins from the black gauge engage these two points and provide a face angle measurement reading on the angle measurement readout provided. Furthermore, a loft is measured about the Q0 point by selecting two vertical points 512,510 that are spaced by a vertical distance of 12.7 mm apart from each other. The two vertical pins from the black gauge engage these two vertical points 512,510 and provide a loft angle measurement reading on the readout provided.

The positive x-axis 522 for face point measurements extends from the center face toward the heel side and is tangent to the center face. The positive z-axis 502 for face point measurements extends from the center face toward the crown of the club head and is tangent to the center face. The x-z coordinate system at center face, without a loft component, is utilized to locate the plurality of points P0-P36 and Q0-Q8, as described below. The positive y-axis 504 extends from the face center and is perpendicular to the face center point and away from the internal volume of the club head. The positive y-axis 504 and positive z-axis 502 will be utilized as a reference axis when the face angle and loft angle are measured at another y-z coordinate location, other than center face.

FIG. 21 further shows two critical points Q3 and Q6 located at coordinates (0 mm, 15 mm) and (0 mm,−15 mm), respectively. As used herein, the terms "1° twist" and "2° twist" are defined as the total face angle change between these two critical point locations at Q3 and Q6. For example, a "1° twist" would indicate that the Q3 point has a 0.5° twist relative to the center face, Q0, and the Q6 point has a −0.5° twist relative to the center face, Q0. Therefore, the total degree of twist as an absolute value between the critical points Q3, Q6 is 1°, hence the nomenclature "1° twist".

Figure 22A:
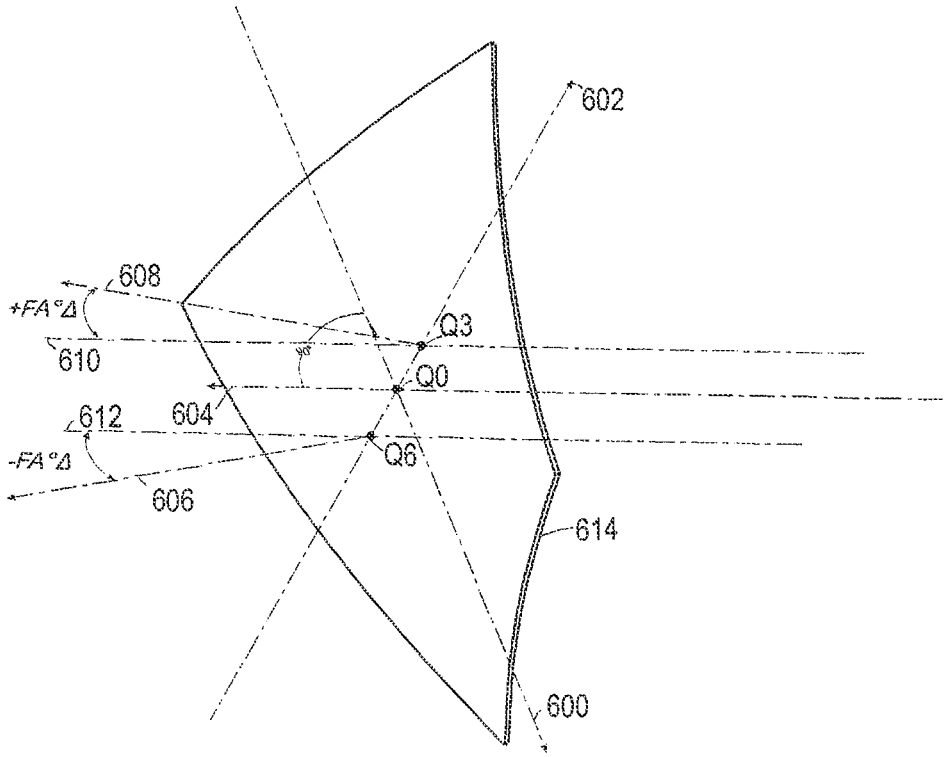
FIG. 22*a* is an isometric view of an exemplary twisted face surface plane.

To further the understanding of what is meant by a "twisted face", FIG. 22*a* provides an isometric view of an over-exaggerated twisted striking surface plane 614 of "10° twist" to illustrate the concept as applied to a golf club striking face. Each point located on the golf club face has an associated loft angle change (defined as "LA°Δ") and face angle change (defined as "FA°Δ"). Each point has an associated loft angle change (defined as "LA°Δ") and face angle change (defined as "FA°Δ").

FIG. 22*a* shows the center face point, Q0, and the two critical points Q3, Q6 described above, and a positive x-axis 600, positive z-axis 604, and positive y-axis 602 located on a twisted plane in an isometric view. The center face has a perpendicular axis 604 that passes through the center face point Q0 and is perpendicular to the twisted plane 614. Likewise, the critical points Q3 and Q6 also have a reference axis 610, 612 which is parallel to the center face perpendicular axis 604. The reference axes 610, 612 are utilized to measure a relative face angle change and loft angle change at these critical point locations. The critical points Q3, Q6 each have a perpendicular axis 608, 606 that is perpendicular to the face. Thus, the face angle change is defined at the critical points as the change in face angle between the reference axis 610,612 and the relative perpendicular axis 608, 606.

Figure 22B:
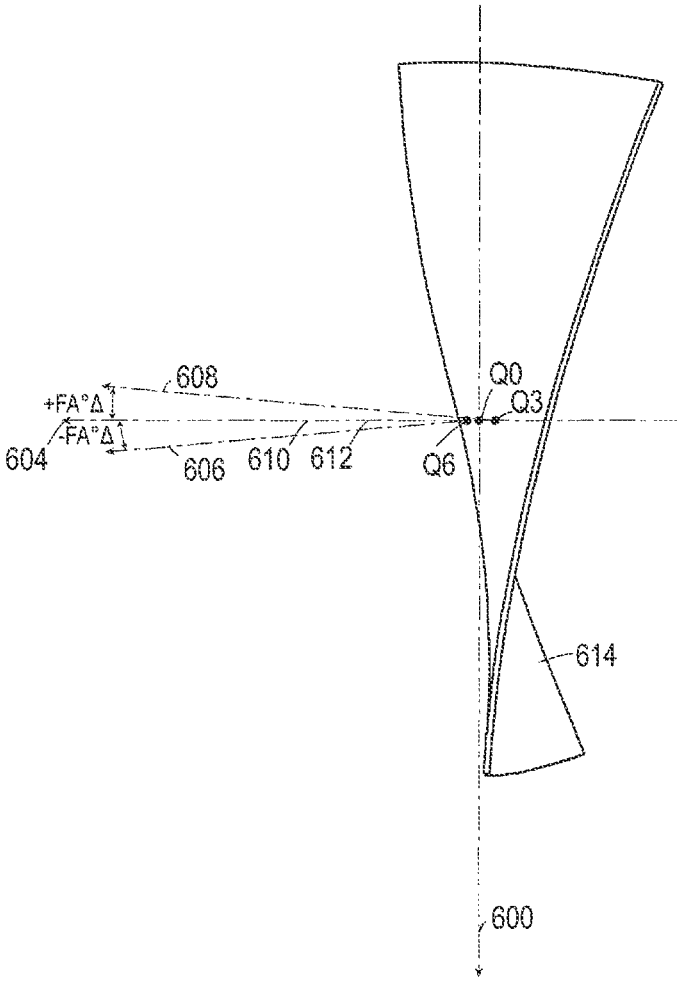
FIG. 22*b* is a top view of an exemplary twisted face surface plane.

FIG. 22*b* shows a top view of the twisted plane 614 and further illustrates how the face angle change is measured between the perpendicular axes 608, 606 at the critical points and the reference axes 610, 612 that are parallel with the center face perpendicular axis 604. A positive face angle change +FA°Δ indicates a perpendicular axis at a measured point that points to the right of the relative reference axis. A negative face angle change −FA°Δ indicates a perpendicular axis that points to the left of the relative reference axis. The face angle change is measured within the plane created by the positive x-axis 600 and positive z-axis 604.

Figure 22C:
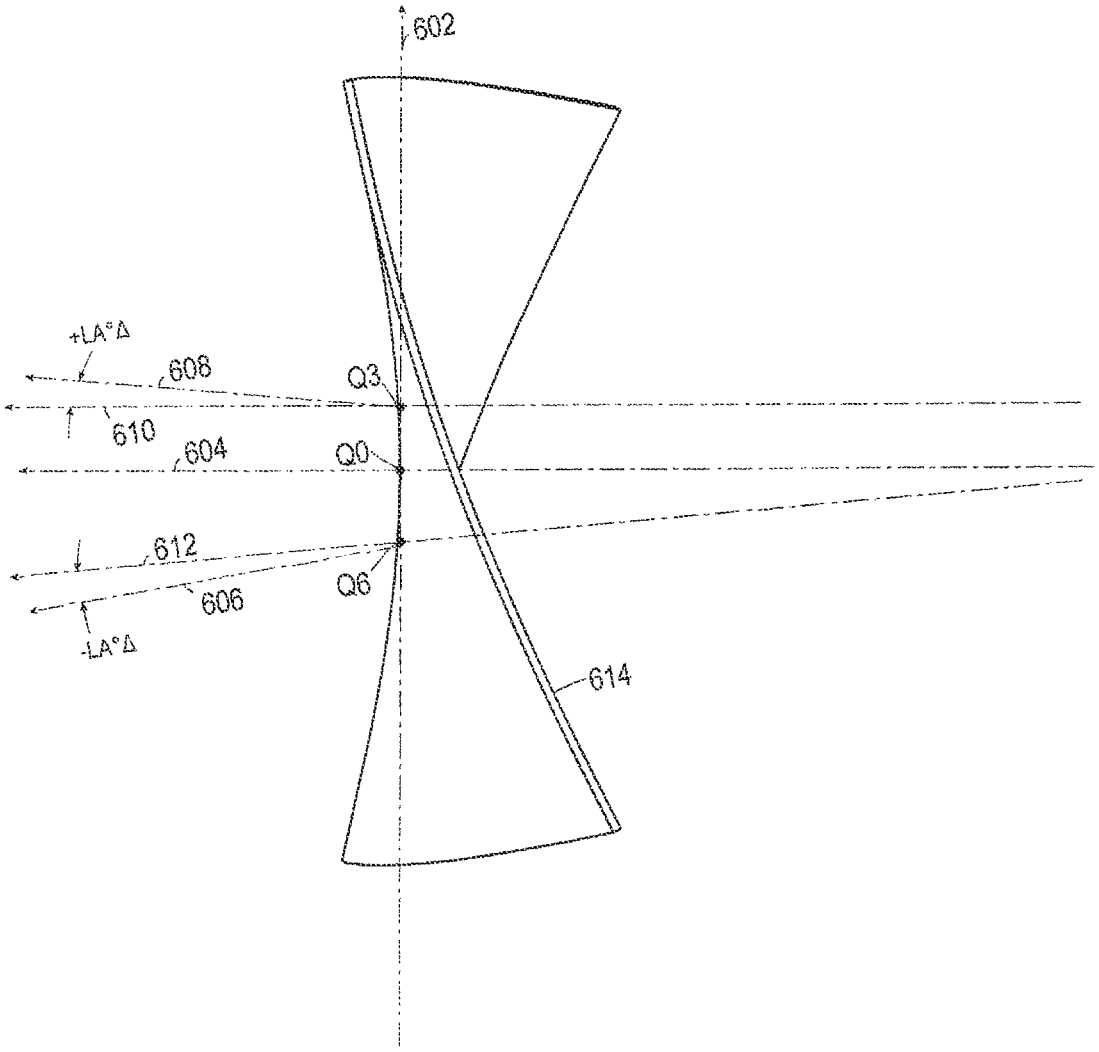
FIG. 22*c* is an elevated heel view of an exemplary twisted face surface plane.

FIG. 22*c* shows a heel side view of a twisted plane 614 and the loft angle change between the perpendicular axes 608,606 and the reference axes 610,612 at the critical point locations. A positive loft angle change +LA°Δ indicates a perpendicular axis at a measured point that points above the relative reference axis. A negative loft angle change −LA°Δ indicates a perpendicular axis that points below the relative reference axis. The loft angle is measured within the plane created by the positive z-axis 604 and positive y-axis 602 for a given measured point.

Figure 23:
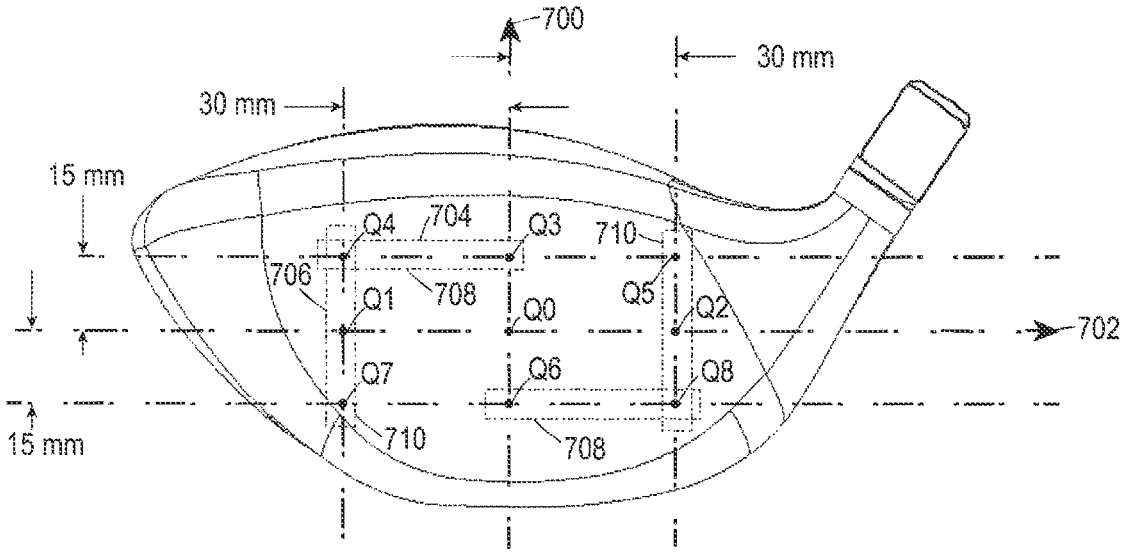
FIG. 23 illustrates a front view of a golf club with a predetermined set of measurement points.
Figure 24:
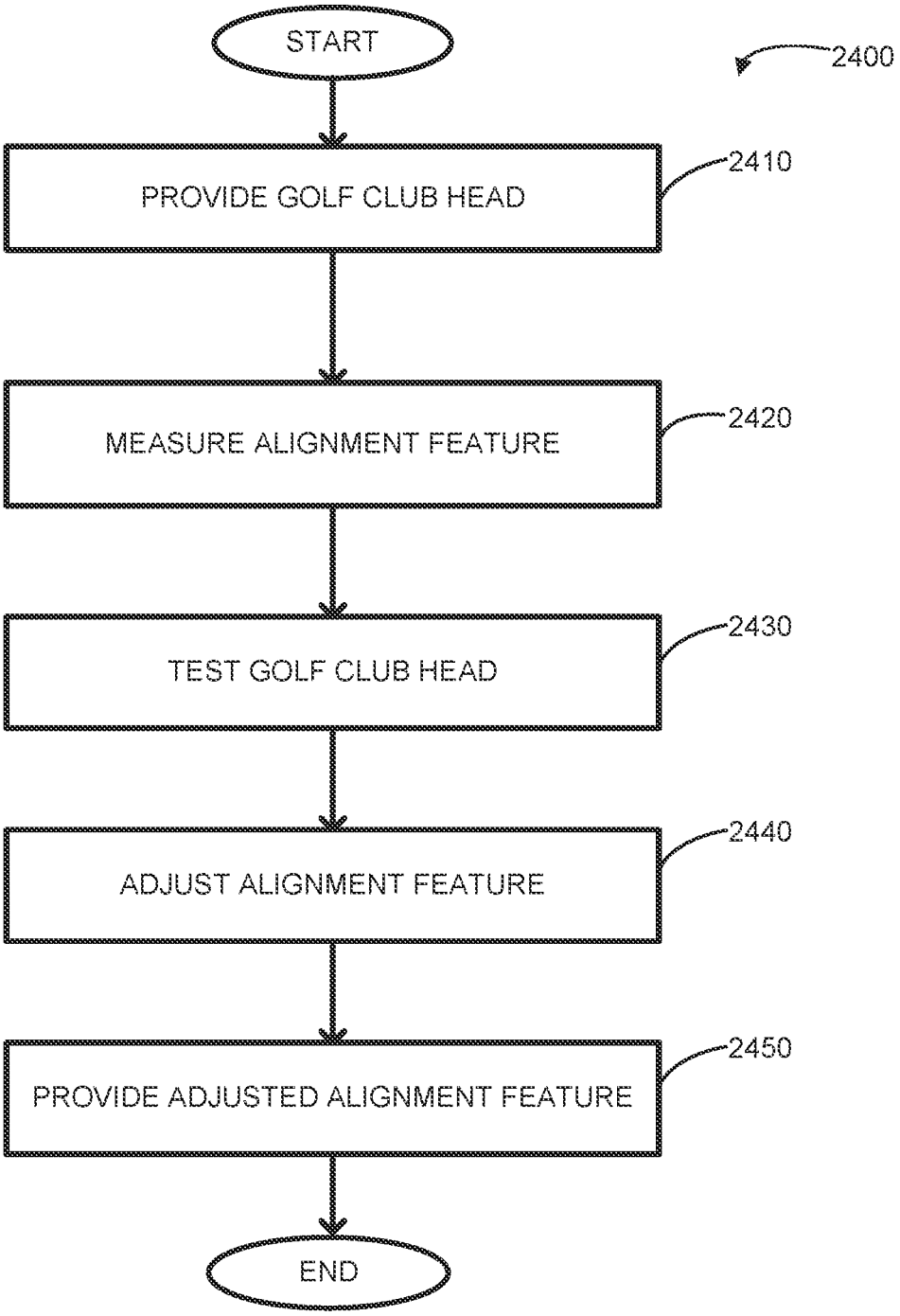
FIG. 24 is a flowchart of a method in accordance with one or more of the present embodiments.

FIG. 23 shows an additional plurality of points Q0-Q8 that are spaced apart across the striking face in a grid pattern. In addition to the critical points Q3, Q6 described above, heel side points Q5, Q2, Q8 are spaced 30 mm away from a vertical axis 700 passing through the center face. Toe side points Q4, Q1, Q7 are spaced 30 mm away from the vertical axis 700 passing through the center face. Crown side points Q3, Q4, Q5 are spaced 15 mm away from a horizontal axis 702 passing through the center face. Sole side points Q6, Q7, Q8 are spaced 15 mm away from the horizontal axis 702. Point Q5 is located in an upper heel quadrant at a coordinate location (30 mm, 15 mm) while point Q7 is located in a lower toe quadrant at a coordinate location (−30 mm, −15 mm). Point Q4 is located in an upper toe quadrant at a coordinate location (−30 mm, 15 mm) while point Q8 is located in a lower heel quadrant at a coordinate location (30 mm, −15 mm).

It is understood that many degrees of twist are contemplated and the embodiments described are not limiting. For example, a golf club having a "0.25° twist", "0.75° twist", "1.25° twist", "1.5° twist", "1.75° twist", "2.25° twist", "2.5° twist", "2.75° twist, "3° twist", "3.25° twist", "3.5° twist", "3.75° twist", "4.25° twist", "4.5° twist", "4.75° twist", "5° twist", "5.25° twist", "5.5° twist", "5.75° twist", "6° twist", "6.25° twist", "6.5° twist", "6.75° twist", "7° twist", "7.25° twist", "7.5° twist", "7.75° twist", "8° twist", "8.25° twist", "8.5° twist", "8.75° twist", "9° twist", "9.25° twist", "9.5° twist", "9.75° twist", and "10° twist" are considered other possible embodiments of the present invention. A golf club having a degree of twist greater than 0°, between 0.25° and 5°, between 0.1° and 5°, between 0° and 5°, between 0° and 10°, or between 0° and 20° are contemplated herein.

Utilizing the grid pattern of FIG. 23, a plurality of embodiments having a nominal center face loft angle of 9.5°, a bulge of 330.2 mm, and a roll of 279.4 mm were analyzed having a "0.5° twist", "1° twist", "2° twist", and "4° twist". A comparison club having "0° twist" is provided for reference in contrast to the embodiments described.

For example, if a head has a bulge radius (Bulge), and roll radius (Roll), it is possible to define two bounding surfaces for the desired twisted face surface by specifying two different twist amounts (DEG). In an embodiment, the striking face has a bulge radius between 228.6 mm and 355.6 mm. In another embodiment, the striking face has a bulge radius between 228.6 mm and 330.2 mm. Additional and different bulge radii may be used.

Table 1 shows the LA°Δ and FA°Δ relative to center face for points located along the vertical axis 700 and horizontal axis 702 (for example points Q1, Q2, Q3, and Q6). With regard to points located away from the vertical axis 700 and horizontal axis 702, the LA°Δ and FA°Δ are measured relative to a corresponding point located on the vertical axis 700 and horizontal axis 702, respectively.

For example, regarding point Q4, located in the upper toe quadrant of the golf club head at a coordinate of (−30 mm, 15 mm), the LA°Δ is measured relative to point Q3 having the same vertical axis 700 coordinate at (0 mm, 15 mm). In other words, both Q3 and Q4 have the same y-coordinate location of 15 mm. Referring to Table 1, the LA°Δ of point Q4 is 0.4° with respect to the loft angle at point Q3. The LA°Δ of point Q4 is measured with respect to point Q3 which is located in a corresponding upper toe horizontal band 704.

In addition, regarding point Q4, located in the upper toe quadrant of the golf club head at a coordinate of (−30 mm, 15 mm), the FA°Δ is measured relative to point Q1 having the same horizontal axis 702 coordinate at (−30 mm, 0 mm). In other words, both Q1 and Q4 have the same x-coordinate location of −30 mm. Referring to Table 1, the FA°Δ of point Q4 is 0.2° with respect to the face angle at point Q1. The FA°Δ of point Q4 is measured with respect to point Q1 which is located in a corresponding upper toe vertical band 706.

To further illustrate how LA°Δ and FA°Δ are calculated for points located within a quadrant that are away from a vertical or horizontal axis, the LA°Δ of point Q8 is measured relative to a loft angle located at point Q6 within a lower heel quadrant horizontal band 708. Likewise, the FA°Δ of point Q8 is measured relative to a face angle located at point Q2 within a lower heel quadrant vertical band 710.

In summary, the LA°Δ and FA°Δ for all points that are located along either a horizontal 702 or vertical axis 700 are measured relative to center face Q0. For points located within a quadrant (such as points Q4, Q5, Q7, and Q8) the LA°Δ is measured with respect to a corresponding point located in a corresponding horizontal band, and the FA°Δ of a given point is measured with respect to a corresponding point located in a corresponding vertical band. In FIG. 23, not all bands are shown in the drawing for the improved clarity of the drawing.

The reason that points located within a quadrant have a different procedure for measuring LA°Δ and FA°Δ is that this method eliminates any influence of the bulge and roll curvature on the LA°Δ and FA°Δ numbers within a quadrant. Otherwise, if a point located within a quadrant is measured with respect to center face, the LA°Δ and FA°Δ numbers will be dependent on the bulge and roll curvature. Therefore utilizing the horizontal and vertical band method of measuring LA°Δ and FA°Δ within a quadrant eliminates any undue influence of a specific bulge and roll curvature. Thus the LA°Δ and FA°Δ numbers within a quadrant should be applicable across any range of bulge and roll curvatures in any given head. The above described method of measuring LA°Δ and FA°Δ within a quadrant has been applied to all examples herein.

The relative LA°Δ and FA°Δ can be applied to any lofted driver, such as a 9.5°, 10.5°, 12° lofted clubs or other commonly used loft angles such as for drivers, fairway woods, hybrids, irons, or putters.

In some implementations, a "twisted" bulge and roll contour of the striking face of the golf club head may alter the perceived angle of the face for the user. For example, referring back to FIG. 21, the upper toe quadrant 514 is more "open" than all the other quadrants of the striking face, resulting in the perceived angle of the face to appear open to the user at address. The perceived angle of the face resulting from the "twisted" bulge and roll contour of the striking face may cause misalignment by the user at addresses, such as setting up the actual face angle of the club closed with respect to the intended target line, resulting in the user hitting the ball left (i.e., a "hook" or "pulled" shot). Further, the perceived angle of the face resulting from the "twisted" bulge and roll contour may be aesthetically unpleasing to the user, with a square striking face appearing open at address. To correct for the perceived angle of the face resulting from the "twisted" bulge and roll contour, an alignment feature is provided to alter the perceived top line relative to striking face.

In some embodiments, an alignment feature is provided to alter the perceived angle of the face for the user to appear closed with respect to the upper toe quadrant 514 of the striking face. In other embodiments, an alignment feature is provided to alter the perceived angle of the face for the user to appear closed with respect to the actual face angle. In the aforementioned embodiments, the alignment feature counteracts the open appearance of "twisted" bulge and roll contour. In some embodiments, the alignment feature may be provided as a contrasting paint or shading of the crown 120 relative to the color or shading of the face 110. In some embodiments, the contrasting paint or shading extends from the crown 120 onto the face 110. In some implementations, a negative CGx is provided along with a "twisted" bulge and roll contour on the striking face. In some implementations, the negative CGx counteracts some of the alignment issues caused by the "twisted" bulge contour, and vice versa. For example, the "twisted" bulge and roll contour on the striking face may be combined with one or more adjustable weights and/or a discretionary mass strategically positioned at an angle with respect to the striking face. Other combinations of the present embodiments may be provided.

In an embodiment, an alignment feature is provided to alter the perceived angle of the face of a golf club head with a "twisted" bulge and roll contour on the striking face. In this embodiment, the performance of the golf club had can be improved by decreasing lateral dispersion of the golf club head. For example, in the case of a right-handed golfer, lateral dispersion is measured indicating that the golf club has a dispersion tendency for a right miss. The right miss

TABLE 1

| Relative to Center Face and Bands | | | | | | | | | | | | |
|---|---|---|---|---|---|---|---|---|---|---|---|---|
| | X-axis | Y-Axis | Example 1 0.5° twist | | Example 2 1° twist | | Example 3 2° twist | | Example 4 4° twist | | 0° twist | |
| Point | (mm) | (mm) | LA° Δ | FA°Δ | LA°Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 | 0 | 0 |
| Q1 | −30 | 0 | 0.5 | 5.7 | 1 | 5.7 | 2 | 5.6 | 4 | 5.6 | 0 | 5.7 |
| Q2 | 30 | 0 | −0.5 | −5.7 | −1 | −5.7 | −2 | −5.6 | −4 | −5.6 | 0 | −5.7 |
| Q3 | 0 | 15 | 3.4 | 0.25 | 3.4 | 0.5 | 3.4 | 1 | 3.4 | 2 | 3.4 | 0 |
| Q4 | −30 | 15 | 0.4 | 0.2 | 0.9 | 0.4 | 1.9 | 1 | 3.9 | 2 | 0 | 0 |
| Q5 | 30 | 15 | −0.5 | 0.3 | −1 | 0.5 | −2 | 0.9 | −4 | 1.9 | 0 | 0 |
| Q6 | 0 | −15 | −3.4 | −0.25 | −3.4 | −0.5 | −3.4 | −1 | −3.4 | −2 | −3.4 | 0 |
| Q7 | −30 | −15 | 0.5 | −0.3 | 1 | −0.5 | 2 | −0.9 | 4 | −2 | 0 | 0 |
| Q8 | 30 | −15 | −0.5 | −0.2 | −1 | −0.4 | −2 | −1 | −4.1 | −2 | 0 | 0 |

may be the result of the "twisted" bulge and roll contour causing the perceived angle of the face of the golf club head to appear open. The alignment feature may be altered to counteract for the right miss, such as by altering the perceived face angle to appear closed with respect to the closed with respect to the actual face angle. The amount that the alignment feature may be altered may be based on the amount of the lateral dispersion, such as by altering the alignment feature about 1 degree with respect to the intended target line for about every 3-5 yards of lateral dispersion from the intended target line. In the case of a left-handed golfer, if the lateral dispersion is measured indicating that the golf club has a dispersion tendency for a left miss, the alignment feature may be altered to counteract for the left miss by altering the perceived face angle to appear closed with respect to the closed with respect to the actual face angle.

In another embodiment, a different alignment feature is provided to alter the perceived angle of the face of a golf club head with a "twisted" bulge and roll contour on the striking face. In this embodiment, the performance of the golf club had can also be improved by decreasing lateral dispersion of the golf club head. For example, in the case of a right-handed golfer, lateral dispersion is measured indicating that the golf club has a dispersion tendency for a left miss. The left miss may be the result of the "twisted" bulge and roll contour causing the perceived angle of the face of the golf club head to appear closed. The alignment feature may be altered to counteract for the left miss, such as by altering the perceived face angle to appear open with respect to the closed with respect to the actual face angle. The amount that the alignment feature may be altered may be based on the amount of the lateral dispersion, such as by altering the alignment feature about 1 degree with respect to the intended target line for about every 3-5 yards of lateral dispersion from the intended target line. In the case of a left-handed golfer, if the lateral dispersion is measured indicating that the golf club has a dispersion tendency for a right miss, the alignment feature may be altered to counteract for the right miss by altering the perceived face angle to appear closed with respect to the closed with respect to the actual face angle.

In an embodiment, a method 2400 is provided for determining an alignment feature for a golf club head, such as in a head with a negative CGx, a "twisted" bulge and roll, or another design. This method may be performed using one or more of the golf club head embodiments discussed above.

At 2410, a golf club head is provided with an alignment feature. In an embodiment, the golf club head is a new design to be tested prior to large scale manufacturing. In this embodiment, the golf club head may have one or more alignment features. The one or more alignment features may be based on previous designs, such as retained topline properties from a previous design, or may a new alignment feature, such as based on a computer aided design (CAD) model or another club head design. For example, the golf club head may have undergone a complete remodel, such as incorporating a substantial golf club head shape change, or may have been slightly redesigned based on a previous golf club head design. In another embodiment, The golf club head may have only minor differences from another golf club head design, such as a different loft that may result in differences between golf club head designs.

At 2420, the alignment feature is measured. For example, in an embodiment using a top line as an alignment feature, a top line radius is measured. Other alignment features may be measured. Additionally or alternatively, a Sight Adjusted Perceived Face Angle (SAPFA) or other metric of the golf club head may also be measured.

At 2430, the golf club head is tested. For example, a prototype of the new golf club head design are provided for player testing. In this example, one or more players may test the golf club head. Based on the testing, a lateral dispersion of the golf club head may be measured. Other performance metrics may also be measured. Lateral dispersion may be indicative that a different alignment feature may provide better performance, such as less lateral dispersion. In another example, an impression of the alignment feature on the user may also be measured. In this example, if the golf club head face appears too open or too closed during the test, a different alignment feature may improve appeal or confidence in the golf club head to the testers.

At 2440, the alignment feature is adjusted. For example, based on the testing, the one or more alignment features may be adjusted to increase performance and/or appeal of the golf club head. In this example, a top line radius may be adjusted. Based on the lateral dispersion measured during testing, a top line radius may be adjusted one degree for every five yards of lateral dispersion with a driver and adjusted one degree for every three yards of lateral dispersion with a fairway wood. Other adjustment amounts may be provided. Further, additional and different adjustments to the one or more alignment features may be provided.

After the alignment feature is adjusted, one or more of acts 2430 and 2440 may be repeated for additional testing and/or adjustment. In some embodiments, individual player testing may also be performed, such as for individual tour players. At 2450, the adjusted alignment feature is provided for manufacturing. For example, after testing and adjusting one or more alignment features, the golf club head design is manufactured.

Discretionary mass generally refers to the mass of material that can be removed from various structures providing mass that can be distributed elsewhere for tuning one or more mass moments of inertia and/or locating the golf club head center-of-gravity. Golf club head walls provide one source of discretionary mass. In other words, a reduction in wall thickness reduces the wall mass and provides mass that can be distributed elsewhere. Thin walls, particularly a thin crown, provide significant discretionary mass compared to conventional golf club heads.

For example, a golf club head made from an alloy of steel can achieve about 4 grams of discretionary mass for each 0.1 mm reduction in average crown thickness. Similarly, a golf club head made from an alloy of titanium can achieve about 2.5 grams of discretionary mass for each 0.1 mm reduction in average crown thickness. Discretionary mass achieved using a thin crown, e.g., less than about 0.65 mm, can be used to tune one or more mass moments of inertia and/or center-of-gravity location.

To achieve a thin wall on a golf club head body, such as a thin crown, a golf club head body can be formed from an alloy of steel or an alloy of titanium.

Some examples of titanium alloys that can be used to form any of the striking faces and/or club heads described herein can comprise titanium, aluminum, molybdenum, chromium, vanadium, and/or iron. For example, in one representative embodiment the alloy may be an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy).

In another representative embodiment, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti.

In another representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti.

In another representative embodiment, the alloy may comprise 8% Al by weight, 2.5% Mo by weight, 2% Cr by weight, 1% V by weight, and/or 0.5% Fe by weight, with the balance comprising Ti. Such titanium alloys can have the formula Ti-8Al-2.5Mo-2Cr-1V-0.5Fe. As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%.

In some embodiments, striking faces and/or club head bodies can be cast from Ti-8Al-2.5Mo-2Cr-1V-0.5Fe. In some embodiments, striking surfaces and club head bodies can be integrally formed or cast together from Ti-8Al-2.5Mo-2Cr-1V-0.5Fe, depending upon the particular characteristics desired.

The mechanical parameters of Ti-8Al-2.5Mo-2Cr-1V-0.5Fe given above can provide surprisingly superior performance compared to other existing titanium alloys. For example, due to the relatively high tensile strength of Ti-8Al-2.5Mo-2Cr-1V-0.5Fe, cast striking faces comprising this alloy can exhibit less deflection per unit thickness compared to other alloys when striking a golf ball. This can be especially beneficial for metalwood-type clubs configured for striking a ball at high speed, as the higher tensile strength of Ti-8Al-2.5Mo-2Cr-1V-0.5Fe results in less deflection of the striking face, and reduces the tendency of the striking face to flatten with repeated use. This allows the striking face to retain its original bulge, roll, and "twist" dimensions over prolonged use, including by advanced and/or professional golfers who tend to strike the ball at particularly high club velocities.

For further details concerning titanium casting, please refer to U.S. Pat. No. 7,513,296, incorporated herein by reference.

Additionally, the thickness of a club hosel may be varied to provide for additional discretionary mass, as described in U.S. Pat. No. 9,731,176, the entire contents of which are hereby incorporated by reference.

In addition to the alignment features described herein, the golf club heads of the present invention may also incorporate additional, such features including but not limited to:

1. movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
2. slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
3. aerodynamic shape features including those described in more detail in U.S. Patent Publication No. 2013/0123040A1, the entire contents of which are incorporated by reference herein in their entirety;
4. removable shaft features including those described in more detail in U.S. Pat. No. 8,303,431, the contents of which are incorporated by reference herein in in their entirety;
5. adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
6. adjustable sole features including those described in more detail in U.S. Pat. No. 8,337,319, U.S. Patent Publication Nos. US2011/0152000A1, US2011/0312437, US2012/0122601A1, and U.S. patent application Ser. No. 13/686,677, the entire contents of each of which are incorporated by reference herein in their entirety.

The designs, embodiments and features described herein may also be combined with other features and technologies in the club-head including:

1. variable thickness face features described in more detail in U.S. patent application Ser. No. 12/006,060, U.S. Pat. Nos. 6,997,820, 6,800,038, and 6,824,475, which are incorporated herein by reference in their entirety;
2. composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety;

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

The invention claimed is:

1. A golf club head comprising:

a golf club body having a face, a crown and a sole together defining an interior cavity, the golf club body including a heel portion and a toe portion and having an x, y and z axes which are orthogonal to each other having their origin at USGA center face, wherein the golf club head has a volume of at least 420 $cm^3$, wherein at least one of the sole or the crown is at least in part a composite material, wherein the x-axis is tangential to the face and parallel to a ground plane, wherein negative locations on the x-axis extend from the USGA center face to the toe portion, wherein positive locations on the x-axis extend from the USGA center face to the heel portion, wherein negative locations on the z-axis extend from the USGA center face to the sole, wherein positive locations on the z-axis extend from the USGA center face to the crown, wherein a center of gravity of the golf club head with respect to the x-axis (CGx) is oriented from about 0 mm to about −10 mm;

wherein the center of gravity of the golf club head with respect to the z-axis (CGz) is positioned below the USGA center face;

wherein a Delta 1 of the golf club head is greater than 20; wherein a moment of inertia about the z-axis is greater than 400 $kg \cdot mm^2$;

wherein the golf club head has an alignment feature delineating a transition between at least a first portion of the crown having an area of contrasting shade or color with a shade or color of at least one of the face and a second portion of the crown; and wherein the alignment feature has:

a Sight Adjusted Perceived Face Angle (SAPFA) of from about −2 to about 10 degrees; and a Radius of Curvature (circle fit) of from about 300 mm to about 1000 mm.

2. The golf club head of claim 1, wherein the CGx is oriented from about 0 mm to about −4 mm.

3. The golf club head of claim 1, wherein the SAPFA is altered about 1 degree with respect to an intended target line for about every 5 yards of lateral dispersion from the intended target line.

4. The golf club head of claim 1, wherein the SAPFA is altered about 1 degree with respect to an intended target line for about every 3 yards of lateral dispersion from the intended target line.

5. The golf club head of claim 1, wherein the SAPFA is altered about 1 degree with respect to an intended target line for each 5 percent change of a CGx orientation.

6. The golf club head of claim 1, further comprising score lines on the face and the score lines are offset from the USGA center face.

7. The golf club head of claim 6, wherein the score lines are offset toewardly from the USGA center face.

8. The golf club head of claim 6, wherein the score lines are centered about a location on the face having an x-axis coordinate corresponding to a CGx orientation.

9. The golf club head of claim 1, wherein the golf club head has a crown height to face height ratio of at least 1.12.

10. The golf club head of claim 1, wherein the alignment feature is more rounded proximate to the toe portion and less rounded proximate to the heel portion.

11. The golf club head of claim 1, wherein the golf club head has a discretionary mass positioned toeward along the negative x-axis and rearward of the center of gravity of the golf club head and closer to the ground plane than the center of gravity of the golf club head.

12. The golf club head of claim 1, further comprising a weight attached to the golf club head rearward of the center of gravity of the golf club head and closer to the ground plane than the center of gravity of the golf club head.

13. The golf club head of claim 1, wherein the face is at least in part a composite material.

14. The golf club head of claim 1, wherein the alignment feature comprises an electronic display for displaying one or more images, wherein the electronic display forms at least a portion of the crown.

15. The golf club head of claim 14, wherein the electronic display is operably connected to a memory, a microprocessor, and a battery within the golf club head.

16. The golf club head of claim 15, wherein;

the electronic display is configured to communicate with a user operable electronic device that is separate from the golf club head via a wireless communication protocol; and the electronic display is configured to receive one or more images from the user operable electronic device, wherein the electronic display is configured to store the one or more images in the memory, and wherein the electronic display is configured to display the one or more images.

17. The golf club head of claim 14, wherein the electronic display comprises a segmented display.

18. The golf club head of claim 17, wherein the electronic display comprises an e-ink display.

19. The golf club head of claim 14, wherein the electronic display comprises an e-ink display.

20. The golf club head of claim 14, further comprising:

a weight attached to the golf club head rearward of the center of gravity of the golf club head and closer to the ground plane than the center of gravity of the golf club head, and wherein the face is at least in part a composite material.

21. The golf club head of claim 20, wherein the golf club head has a discretionary mass positioned toeward along the negative x-axis and rearward of the center of gravity of the golf club head and closer to the ground plane than the center of gravity of the golf club head.

22. A golf club head comprising:

a golf club body having a face, a crown and a sole together defining an interior cavity, the golf club body including a heel portion and a toe portion and having an x, y and z axes which are orthogonal to each other having their origin at USGA center face, wherein the golf club head has a volume of at least 420 $cm^3$, wherein at least a portion of the face comprises a composite material, wherein the x-axis is tangential to the face and parallel to a ground plane, wherein negative locations on the x-axis extend from the USGA center face to the toe portion, wherein positive locations on the x-axis extend from the USGA center face to the heel portion, wherein negative locations on the z-axis extend from the USGA center face to the sole, wherein positive locations on the z-axis extend from the USGA center face to the crown, wherein a center of gravity of the golf club head with respect to the x-axis (CGx) is oriented from about 0 mm to about −10 mm;

wherein the center of gravity of the golf club head with respect to the z-axis (CGz) is positioned below the USGA center face;

wherein a Delta 1 of the golf club head is greater than 20;

wherein a moment of inertia about the z-axis is greater than 400 $kg \cdot mm^2$;

wherein the golf club head has an alignment feature delineating a transition between at least a first portion of the crown having an area of contrasting shade or color with a shade or color of at least one of the face and a second portion of the crown; and wherein the alignment feature has:

a Sight Adjusted Perceived Face Angle (SAPFA) of from about −2 to about 10 degrees; and a Radius of Curvature (circle fit) of from about 300 mm to about 1000 mm.

23. The golf club head of claim 22, wherein the crown is at least in part a composite material.

24. The golf club head of claim 23, wherein the sole is at least in part a composite material.

25. A golf club head comprising:

a golf club body having a face, a crown and a sole together defining an interior cavity, the golf club body including a heel portion and a toe portion and having an x, y and z axes which are orthogonal to each other having their origin at USGA center face, wherein the golf club head has a volume of at least 420 $cm^3$, wherein at least one of the sole or the crown is at least in part a composite material, wherein the x-axis is tangential to the face and parallel to a ground plane, wherein negative locations on the x-axis extend from the USGA center face to the toe portion, wherein positive locations on the x-axis extend from the USGA center face to the heel portion, wherein negative locations on the z-axis extend from the USGA center face to the sole, wherein positive locations on the z-axis extend from the USGA center face to the crown, wherein a center of gravity of the golf club head with respect to the x-axis (CGx) is oriented from about 0 mm to about −10 mm;

wherein the center of gravity of the golf club head with respect to the z-axis (CGz) is positioned below the USGA center face;

wherein a Delta 1 of the golf club head is greater than 20;

wherein a moment of inertia about the z-axis is greater than 400 $kg \cdot mm^2$;

wherein the golf club head has an alignment feature delineating a transition between at least a first portion of the crown having an area of contrasting shade or color with a shade or color of at least one of the face and a second portion of the crown; and wherein the alignment feature has:

a Sight Adjusted Perceived Face Angle (SAPFA) of from about −2 to about 10 degrees; and a Radius of Curvature (circle fit) of from about 300 mm to about 1000 mm.

26. The golf club head of claim 25, further comprising at least one crown opening having a crown ledge surrounding the crown opening and a composite crown insert attached to the crown ledge and covering the crown opening, and at least one sole opening having a sole ledge surrounding the sole opening and a composite sole insert attached to the sole ledge and covering the sole opening.

27. The golf club head of claim 26, further comprising a weight attached to the golf club head rearward of the center of gravity of the golf club head and closer to the ground plane than the center of gravity of the golf club head.

28. The golf club head of claim 27, further comprising a forward mass pad positioned heelward and forward on the sole.

29. The golf club head of claim 28, wherein the face is at least in part a composite material.

* * * * *